US008998692B2

(12) United States Patent
Soltys

(10) Patent No.: US 8,998,692 B2
(45) Date of Patent: Apr. 7, 2015

(54) SYSTEMS, METHODS AND ARTICLES TO FACILITATE DELIVERY OF SETS OR PACKETS OF PLAYING CARDS

(75) Inventor: Richard Soltys, Mercer Island, WA (US)

(73) Assignee: Bally Gaming, Inc., Las Vegas, NV (US)

( * ) Notice: Subject to any disclaimer, the term of this patent is extended or adjusted under 35 U.S.C. 154(b) by 2778 days.

(21) Appl. No.: 11/479,991

(22) Filed: Jun. 29, 2006

(65) Prior Publication Data

US 2007/0298865 A1 Dec. 27, 2007

Related U.S. Application Data

(60) Provisional application No. 60/815,910, filed on Jun. 21, 2006.

(51) Int. Cl.

| | |
|---|---|
| ***A63F 1/12*** | (2006.01) |
| ***A63F 1/14*** | (2006.01) |
| *A63F 9/24* | (2006.01) |

(52) U.S. Cl.
CPC .... *A63F 1/14* (2013.01); *A63F 9/24* (2013.01)

(58) Field of Classification Search
USPC ..... 273/149 R, 149 P, 309; 463/21, 22, 46, 463/47
See application file for complete search history.

(56) References Cited

U.S. PATENT DOCUMENTS

| | | | | |
|---|---|---|---|---|
| 1,034,402 | A | 7/1912 | Hardy | |
| 1,727,800 | A | 9/1929 | Albert | |
| 1,890,504 | A | 12/1932 | Ferguson, Jr. | |
| 2,567,223 | A | 9/1951 | Maher | |
| 2,663,418 | A | 12/1953 | Grunwald | 206/62 |
| 2,694,662 | A | 11/1954 | Hunter, Jr. | 154/121 |
| 2,731,271 | A | 1/1956 | Brown | |
| 3,222,071 | A | 12/1965 | Lang | 273/149 |
| 3,312,473 | A | 4/1967 | Friedman et al. | 273/149 |
| 3,339,223 | A | 9/1967 | Laby | 16/105 |
| 3,377,070 | A | 4/1968 | Nottoli | 273/149 |
| 3,493,728 | A | 2/1970 | Braden, Jr. et al. | |
| 3,561,756 | A | 2/1971 | Barnett | 271/41 |

(Continued)

FOREIGN PATENT DOCUMENTS

| | | |
|---|---|---|
| DE | 3807127 A1 | 9/1989 |
| DE | 44 39 502 C1 | 9/1995 |

(Continued)

OTHER PUBLICATIONS

English Translation of German Patent No. DE 197 48 930, publication date of May 14, 1998, inventor: Markeev.

(Continued)

*Primary Examiner* — Bach Hoang
(74) *Attorney, Agent, or Firm* — Frank Abramonte; Marvin A. Hein; Philip J. Anderson

(57) ABSTRACT

A system and method may provide sets or packets of playing cards for forming part or all of a hand of playing cards. Each set or packet may be formed before starting to form another set or packet. Sets or packets may be formed in respective playing card receiving compartments. The playing cards may be withdrawn from a plurality of playing card receiving compartments of an intermediary playing card receiver in random or pseudo-random fashion, which may, or may not, be based at least in part on the selected payout or house odds and/or house advantage.

60 Claims, 21 Drawing Sheets

(56) References Cited

U.S. PATENT DOCUMENTS 3,667,759 A 6/1972 Barr ..... 273/152.1
3,690,670 A 9/1972 Cassady et al. ..... 273/149 P
3,735,982 A 5/1973 Gerfin ..... 273/1 E
3,751,041 A 8/1973 Seifert ..... 273/149 P
3,752,962 A 8/1973 Greskovics ..... 235/61.11
3,814,436 A 6/1974 Boren ..... 273/149 P
3,897,954 A 8/1975 Erickson et al. ..... 273/149 R
3,907,282 A 9/1975 Hunter ..... 271/233
3,929,339 A 12/1975 Mattioli ..... 273/148 A
3,937,311 A 2/1976 Gehrke ..... 192/45
3,937,312 A 2/1976 Gehrke ..... 192/45
3,942,616 A 3/1976 Elmore ..... 192/45
3,972,573 A 8/1976 Marola ..... 308/217
3,990,555 A 11/1976 Carullo ..... 192/45
3,993,176 A 11/1976 Marola et al. ..... 192/45
3,993,177 A 11/1976 Gehrke ..... 192/45
3,994,377 A 11/1976 Elmore ..... 192/45
4,031,376 A 6/1977 Corkin, Jr. ..... 235/156
4,241,921 A 12/1980 Miller ..... 273/148 A
4,244,582 A 1/1981 Raees et al. ..... 273/293
4,310,160 A 1/1982 Willette et al. ..... 273/149 R
4,373,726 A 2/1983 Churchill et al. ..... 273/138 A
4,377,285 A 3/1983 Kadlic ..... 273/148 A
4,448,419 A 5/1984 Telnaes ..... 273/143 R
4,457,512 A 7/1984 Stevenson ..... 273/148
4,497,488 A 2/1985 Plevyak et al. ..... 273/149 R
4,512,580 A 4/1985 Matviak ..... 273/148 A
4,531,187 A 7/1985 Uhland ..... 364/412
4,531,909 A 7/1985 Takeshita ..... 432/37
4,534,562 A 8/1985 Cuff et al. ..... 273/149 P
4,586,712 A 5/1986 Lorber et al. ..... 273/149 R
4,636,846 A 1/1987 Villarreal ..... 358/100
4,659,082 A 4/1987 Greenberg ..... 273/149 R
4,662,637 A 5/1987 Pfeiffer ..... 273/149 P
4,667,959 A * 5/1987 Pfeiffer et al. ..... 273/149 R
4,693,480 A 9/1987 Smith ..... 273/296
4,725,079 A 2/1988 Koza et al. ..... 283/73
4,728,108 A 3/1988 Neuwahl ..... 273/296
4,750,743 A 6/1988 Nicoletti ..... 273/148 A
4,770,421 A 9/1988 Hoffman ..... 273/149 R
4,807,884 A 2/1989 Breeding ..... 273/149 R
4,817,528 A 4/1989 Baker ..... 101/395
4,822,050 A 4/1989 Normand et al. ..... 273/149 P
4,832,341 A 5/1989 Muller et al. ..... 273/139
4,832,342 A 5/1989 Plevyak et al. ..... 273/149 R
4,885,700 A 12/1989 Kondziolka et al. ..... 364/519
4,951,950 A 8/1990 Normand et al. ..... 273/149 P
4,969,648 A 11/1990 Hollinger et al. ..... 273/149 R
4,995,615 A 2/1991 Cheng ..... 273/292
4,998,737 A 3/1991 Lamle ..... 273/296
5,000,453 A 3/1991 Stevens et al. ..... 273/149 R
5,039,102 A 8/1991 Miller ..... 273/148 R
5,053,612 A 10/1991 Pielemeier et al. ..... 235/462
5,067,713 A 11/1991 Soules et al. ..... 273/149 P
5,096,197 A 3/1992 Embury ..... 273/149 R
5,110,134 A 5/1992 Laughlin et al. ..... 273/293
5,114,153 A 5/1992 Rosenwinkel et al. ..... 273/292
5,121,921 A 6/1992 Friedman et al. ..... 273/149 P
5,157,602 A 10/1992 Fields et al. ..... 364/412
5,186,464 A 2/1993 Lamle ..... 273/149 R
5,199,710 A * 4/1993 Lamle ..... 463/22
5,224,712 A 7/1993 Laughlin et al. ..... 273/304
5,240,140 A 8/1993 Huen ..... 221/13
5,259,907 A 11/1993 Soules et al. ..... 156/277
5,261,667 A 11/1993 Breeding ..... 273/149 R
5,275,400 A 1/1994 Weingardt et al. ..... 273/85 CP
5,275,411 A 1/1994 Breeding ..... 273/149 R
5,303,921 A 4/1994 Breeding ..... 273/149 R
5,312,104 A 5/1994 Miller ..... 273/148 R
5,332,219 A 7/1994 Marnell, II et al. ..... 273/138 A
5,344,146 A 9/1994 Lee ..... 273/149 R
5,356,145 A 10/1994 Verschoor ..... 273/149 R
5,362,053 A 11/1994 Miller ..... 273/148 R
5,374,061 A 12/1994 Albrecht ..... 273/149 R
5,382,024 A 1/1995 Blaha ..... 273/149 R
5,397,133 A 3/1995 Penzias ..... 273/439
5,416,308 A 5/1995 Hood et al. ..... 235/454
5,417,431 A 5/1995 Gluck ..... 273/293
5,431,399 A 7/1995 Kelley ..... 273/149 P
5,445,377 A 8/1995 Steinbach ..... 273/149 R
5,487,544 A 1/1996 Clapper, Jr. ..... 273/138 A
5,511,784 A 4/1996 Furry et al. ..... 273/143 R
5,518,249 A 5/1996 Sines et al. ..... 273/304
5,575,475 A 11/1996 Steinbach ..... 273/149 R
5,584,483 A 12/1996 Sines et al. ..... 273/149 R
5,605,334 A 2/1997 McCrea, Jr. ..... 273/309
5,605,504 A 2/1997 Huang ..... 463/22
5,613,680 A 3/1997 Groves et al. ..... 273/138.2
5,632,483 A 5/1997 Garczynski et al. ..... 273/148 R
5,636,843 A 6/1997 Roberts ..... 273/292
5,654,050 A 8/1997 Whalen-Shaw ..... 428/35.7
5,655,961 A 8/1997 Acres et al. ..... 463/27
5,669,816 A 9/1997 Garczynski et al. ..... 463/12
5,676,372 A 10/1997 Sines et al. ..... 273/149 R
5,681,039 A 10/1997 Miller ..... 273/148 R
5,683,085 A 11/1997 Johnson et al. ..... 273/149 R
5,685,543 A 11/1997 Garner ..... 273/148 A
5,690,324 A 11/1997 Otomo et al. ..... 270/58.02
5,692,748 A 12/1997 Frisco et al. ..... 273/149 R
5,695,189 A 12/1997 Breeding et al. ..... 273/149 R
5,698,839 A 12/1997 Jagielinski et al. ..... 235/493
5,707,287 A 1/1998 McCrea, Jr. ..... 463/27
5,711,525 A 1/1998 Breeding ..... 273/292
5,718,427 A 2/1998 Cranford et al. ..... 273/149 R
5,722,893 A 3/1998 Hill et al. ..... 463/47
5,735,525 A 4/1998 McCrea, Jr. ..... 273/309
5,766,074 A 6/1998 Cannon et al. ..... 463/16
5,769,458 A 6/1998 Carides et al. ..... 283/102
5,770,533 A 6/1998 Franchi ..... 463/42
5,772,505 A 6/1998 Garczynski et al. ..... 463/12
5,779,545 A 7/1998 Berg et al. ..... 463/22
5,779,546 A 7/1998 Meissner et al. ..... 463/25
5,788,573 A 8/1998 Baerlocher et al. ..... 463/16
5,791,988 A 8/1998 Nomi ..... 463/11
5,803,808 A 9/1998 Strisower ..... 463/11
5,803,809 A 9/1998 Yoseloff ..... 463/13
5,823,534 A 10/1998 Banyai ..... 273/269
5,830,064 A 11/1998 Bradish et al. ..... 463/22
5,831,669 A 11/1998 Adrain ..... 348/143
5,842,921 A 12/1998 Mindes et al. ..... 463/16
5,863,249 A 1/1999 Inoue ..... 463/20
5,867,586 A 2/1999 Liang ..... 382/112
5,871,400 A 2/1999 Yfantis ..... 463/22
5,895,048 A 4/1999 Smith, Jr. ..... 273/293
5,911,626 A 6/1999 McCrea, Jr. ..... 463/27
5,919,091 A 7/1999 Bell et al. ..... 463/25
5,934,866 A 8/1999 Redden ..... 414/798.9
5,936,527 A 8/1999 Isaacman et al. ..... 340/572.1
5,941,769 A 8/1999 Order ..... 463/12
5,941,771 A 8/1999 Haste, III ..... 463/17
5,944,310 A 8/1999 Johnson et al. ..... 273/149 R
5,945,654 A 8/1999 Huang ..... 235/449
5,949,050 A 9/1999 Fosbenner et al. ..... 235/449
5,954,654 A 9/1999 Eaton et al. ..... 600/462
5,967,893 A 10/1999 Lawrence et al. ..... 463/10
5,967,894 A 10/1999 Kinoshita et al. ..... 463/13
5,989,122 A 11/1999 Roblejo ..... 463/22
6,010,404 A 1/2000 Walker et al. ..... 463/21
6,019,368 A 2/2000 Sines et al. ..... 273/149 R
6,039,650 A 3/2000 Hill ..... 463/47
6,042,150 A 3/2000 Daley ..... 283/86
6,062,981 A 5/2000 Luciano, Jr. ..... 463/26
6,066,439 A 5/2000 Nohr et al. ..... 430/347
6,068,258 A 5/2000 Breeding et al. ..... 273/149 R
6,068,552 A 5/2000 Walker et al. ..... 463/21
6,093,103 A 7/2000 McCrea, Jr. ..... 463/27
6,117,009 A 9/2000 Yoseloff ..... 463/20
6,117,012 A 9/2000 McCrea, Jr. ..... 463/27
6,120,588 A 9/2000 Jacobson ..... 106/31.16
6,126,166 A 10/2000 Lorson et al. ..... 273/148 R
6,139,014 A 10/2000 Breeding et al. ..... 273/149 R
6,145,838 A 11/2000 White ..... 273/295
6,149,154 A 11/2000 Grauzer et al. ..... 273/149 R
6,152,822 A 11/2000 Herbert ..... 463/22

(56) References Cited

U.S. PATENT DOCUMENTS

| | | | | |
|---|---|---|---|---|
| 6,159,096 | A | 12/2000 | Yoseloff | 463/20 |
| 6,161,476 | A | 12/2000 | Yoneoka | 101/118 |
| 6,166,763 | A | 12/2000 | Rhodes et al. | 348/143 |
| 6,186,892 | B1 | 2/2001 | Frank et al. | 463/19 |
| 6,193,607 | B1 | 2/2001 | Kay | 463/22 |
| 6,196,547 | B1 | 3/2001 | Pascal et al. | 273/292 |
| 6,217,447 | B1 | 4/2001 | Lofink et al. | 463/12 |
| 6,220,959 | B1 | 4/2001 | Holmes, Jr. et al. | 463/13 |
| 6,234,898 | B1 | 5/2001 | Belamant et al. | 463/25 |
| 6,250,632 | B1 | 6/2001 | Albrecht | 273/149 R |
| 6,254,096 | B1 | 7/2001 | Grauzer et al. | 273/149 R |
| 6,254,484 | B1 | 7/2001 | McCrea, Jr. | 463/27 |
| 6,267,248 | B1 | 7/2001 | Johnson et al. | 209/547 |
| 6,267,671 | B1 | 7/2001 | Hogan | 463/25 |
| 6,276,267 | B1 | 8/2001 | Yoneoka | 101/114 |
| 6,293,546 | B1 | 9/2001 | Hessing et al. | 273/138.2 |
| 6,293,864 | B1 | 9/2001 | Romero | 463/12 |
| 6,299,167 | B1 | 10/2001 | Sines et al. | 273/149 R |
| 6,299,170 | B1 | 10/2001 | Yoseloff | 273/292 |
| 6,299,536 | B1 | 10/2001 | Hill | 463/47 |
| 6,312,334 | B1 | 11/2001 | Yoseloff | 463/25 |
| 6,313,871 | B1 | 11/2001 | Schubert | 348/143 |
| 6,315,664 | B1 | 11/2001 | Baerlocher et al. | 463/21 |
| 6,325,373 | B1 | 12/2001 | Breeding et al. | 273/149 R |
| 6,346,044 | B1 | 2/2002 | McCrea, Jr. | 463/27 |
| 6,357,746 | B1 | 3/2002 | Sadowski | 273/148 R |
| 6,361,044 | B1 | 3/2002 | Block et al. | 273/149 R |
| 6,371,482 | B1 | 4/2002 | Hall, Jr. | 273/138.1 |
| 6,386,973 | B1 | 5/2002 | Yoseloff | 463/13 |
| 6,394,902 | B1 | 5/2002 | Glavich | 463/20 |
| 6,402,142 | B1 | 6/2002 | Warren et al. | 273/149 R |
| 6,403,908 | B2 | 6/2002 | Stardust et al. | 209/587 |
| 6,406,023 | B1 | 6/2002 | Rowe | 273/292 |
| 6,406,369 | B1 | 6/2002 | Baerlocher et al. | 463/20 |
| 6,409,595 | B1 | 6/2002 | Uihlein et al. | 463/29 |
| 6,413,162 | B1 | 7/2002 | Baerlocher et al. | 463/20 |
| 6,425,824 | B1 | 7/2002 | Baerlocher et al. | 463/16 |
| 6,439,425 | B1 | 8/2002 | Masek | 221/241 |
| 6,446,864 | B1 | 9/2002 | Kim et al. | 235/382 |
| 6,457,715 | B1 | 10/2002 | Friedman | 273/274 |
| 6,460,848 | B1 | 10/2002 | Soltys et al. | 273/149 R |
| 6,464,581 | B1 | 10/2002 | Yoseloff | 463/20 |
| 6,468,156 | B1 | 10/2002 | Hughs-Baird et al. | 463/25 |
| 6,471,208 | B2 | 10/2002 | Yoseloff et al. | 273/143 R |
| 6,485,366 | B1 | 11/2002 | Rowe | 463/13 |
| 6,502,116 | B1 | 12/2002 | Kelly et al. | 708/250 |
| 6,508,709 | B1 | 1/2003 | Karmarkar | 463/42 |
| 6,514,140 | B1 | 2/2003 | Storch | 463/25 |
| 6,517,435 | B2 | 2/2003 | Soltys et al. | 463/25 |
| 6,517,436 | B2 | 2/2003 | Soltys et al. | 463/29 |
| 6,517,437 | B1 | 2/2003 | Wells et al. | 463/30 |
| 6,520,856 | B1 | 2/2003 | Walker et al. | 463/21 |
| 6,520,857 | B2 | 2/2003 | Soltys et al. | 463/29 |
| 6,527,271 | B2 | 3/2003 | Soltys et al. | 273/148 R |
| 6,530,836 | B2 | 3/2003 | Soltys et al. | 463/29 |
| 6,530,837 | B2 | 3/2003 | Soltys et al. | 463/29 |
| 6,533,276 | B2 | 3/2003 | Soltys et al. | 273/148 R |
| 6,533,662 | B2 | 3/2003 | Soltys et al. | 463/25 |
| 6,533,664 | B1 | 3/2003 | Crumby | 463/42 |
| 6,543,770 | B1 | 4/2003 | Kaji et al. | 273/148 R |
| 6,561,897 | B1 | 5/2003 | Bourbour et al. | 463/13 |
| 6,568,678 | B2 | 5/2003 | Breeding et al. | 273/149 R |
| 6,579,179 | B2 | 6/2003 | Poole et al. | 463/25 |
| 6,579,180 | B2 | 6/2003 | Soltys et al. | 463/25 |
| 6,579,181 | B2 | 6/2003 | Soltys et al. | 463/25 |
| 6,581,747 | B1 | 6/2003 | Charlier et al. | 194/214 |
| 6,582,301 | B2 | 6/2003 | Hill | 463/11 |
| 6,588,750 | B1 | 7/2003 | Grauzer et al. | 273/149 R |
| 6,588,751 | B1 | 7/2003 | Grauzer et al. | 273/149 R |
| 6,595,857 | B2 | 7/2003 | Soltys et al. | 463/29 |
| 6,599,185 | B1 | 7/2003 | Kaminkow et al. | 463/16 |
| 6,629,889 | B2 | 10/2003 | Mothwurf | 463/25 |
| 6,638,161 | B2 | 10/2003 | Soltys et al. | 463/12 |
| 6,651,981 | B2 | 11/2003 | Grauzer et al. | 273/149 R |
| 6,651,982 | B2 | 11/2003 | Grauzer et al. | 273/149 R |
| 6,652,379 | B2 | 11/2003 | Soltys et al. | 463/22 |
| 6,655,684 | B2 | 12/2003 | Grauzer et al. | 273/149 R |
| 6,659,460 | B2 | 12/2003 | Blaha et al. | 273/149 R |
| 6,663,490 | B2 | 12/2003 | Soltys et al. | 463/25 |
| 6,676,127 | B2 | 1/2004 | Johnson et al. | 273/149 R |
| 6,676,516 | B2 | 1/2004 | Baerlocher et al. | 463/25 |
| 6,676,522 | B2 | 1/2004 | Rowe et al. | 463/42 |
| 6,685,568 | B2 | 2/2004 | Soltys et al. | 463/47 |
| 6,688,979 | B2 | 2/2004 | Soltys et al. | 463/25 |
| 6,698,756 | B1 | 3/2004 | Baker et al. | 273/149 R |
| 6,698,759 | B2 | 3/2004 | Webb et al. | 273/292 |
| 6,712,693 | B1 | 3/2004 | Hettinger | 463/20 |
| 6,712,696 | B2 | 3/2004 | Soltys et al. | 463/25 |
| 6,719,288 | B2 | 4/2004 | Hessing et al. | 273/149 R |
| 6,726,099 | B2 | 4/2004 | Becker et al. | 235/380 |
| 6,726,205 | B1 | 4/2004 | Purton | 273/148 R |
| 6,728,740 | B2 | 4/2004 | Kelly et al. | 708/250 |
| 6,729,956 | B2 | 5/2004 | Wolf et al. | 463/25 |
| 6,729,961 | B1 | 5/2004 | Millerschone | 463/30 |
| 6,752,312 | B1 | 6/2004 | Chamberlain et al. | 235/375 |
| 6,758,751 | B2 | 7/2004 | Soltys et al. | 463/29 |
| 6,857,961 | B2 | 2/2005 | Soltys et al. | 463/47 |
| 6,889,979 | B2 | 5/2005 | Blaha et al. | 273/149 R |
| 6,896,618 | B2 | 5/2005 | Benoy et al. | 463/25 |
| 6,912,812 | B2 | 7/2005 | Inage | 49/409 |
| 6,923,719 | B2 | 8/2005 | Wolf | 463/16 |
| 6,955,599 | B2 | 10/2005 | Bourbour et al. | 463/13 |
| 6,964,612 | B2 | 11/2005 | Soltys et al. | 463/47 |
| 6,991,540 | B2 | 1/2006 | Marlow | 463/16 |
| 6,991,544 | B2 | 1/2006 | Soltys et al. | 463/42 |
| 7,005,985 | B1 | 2/2006 | Steeves | 340/572.1 |
| 7,011,309 | B2 | 3/2006 | Soltys et al. | 273/149 R |
| 7,029,009 | B2 | 4/2006 | Grauzer et al. | 273/149 P |
| 7,036,818 | B2 | 5/2006 | Grauzer et al. | 273/149 R |
| 7,073,791 | B2 | 7/2006 | Grauzer et al. | 273/149 R |
| 7,077,332 | B2 | 7/2006 | Verschuur et al. | 235/492 |
| 7,114,718 | B2 | 10/2006 | Grauzer et al. | 273/149 R |
| 7,137,627 | B2 | 11/2006 | Grauzer et al. | 273/149 R |
| 7,213,812 | B2 | 5/2007 | Schubert et al. | 273/149 R |
| 7,222,852 | B2 | 5/2007 | Soltys et al. | 273/148 R |
| 7,234,698 | B2 | 6/2007 | Grauzer et al. | 273/149 R |
| 7,255,344 | B2 | 8/2007 | Grauzer et al. | 273/149 R |
| 7,264,241 | B2 | 9/2007 | Schubert et al. | 273/149 R |
| 7,271,727 | B2 | 9/2007 | Steeves | 340/572.7 |
| 7,278,923 | B2 | 10/2007 | Grauzer et al. | 463/47 |
| 7,291,068 | B2 | 11/2007 | Bryant et al. | 463/25 |
| 7,322,576 | B2 | 1/2008 | Grauzer et al. | 273/149 R |
| 7,338,044 | B2 | 3/2008 | Grauzer et al. | 273/149 R |
| 7,341,254 | B2 | 3/2008 | Loewenstein et al. | 273/292 |
| 7,384,044 | B2 | 6/2008 | Grauzer et al. | 273/149 R |
| 7,390,256 | B2 | 6/2008 | Soltys et al. | 463/12 |
| 7,413,191 | B2 | 8/2008 | Grauzer et al. | 273/149 R |
| 7,427,233 | B2 | 9/2008 | Walker et al. | 463/16 |
| 7,500,915 | B2 | 3/2009 | Wolf et al. | 463/27 |
| 7,510,194 | B2 | 3/2009 | Soltys et al. | 273/293 |
| 7,525,283 | B2 | 4/2009 | Cheng et al. | 320/108 |
| 7,578,739 | B2 | 8/2009 | Gauselmann | 463/27 |
| 7,617,151 | B2 | 11/2009 | Rowe | 705/39 |
| 7,684,874 | B2 | 3/2010 | Schlottmann et al. | 700/9 |
| 7,744,462 | B2 | 6/2010 | Grav et al. | 463/27 |
| 7,753,790 | B2 | 7/2010 | Nguyen et al. | 463/42 |
| 7,753,798 | B2 | 7/2010 | Soltys et al. | 463/47 |
| 7,780,525 | B2 | 8/2010 | Walker et al. | 463/29 |
| 2002/0024179 | A1 | 2/2002 | Chida | 273/307 |
| 2002/0063389 | A1 | 5/2002 | Breeding et al. | 273/292 |
| 2002/0142846 | A1 | 10/2002 | Paulsen | 463/43 |
| 2002/0147042 | A1 | 10/2002 | Vuong et al. | 463/40 |
| 2002/0163125 | A1 | 11/2002 | Grauzer et al. | 273/149 R |
| 2002/0187821 | A1* | 12/2002 | Soltys et al. | 463/11 |
| 2003/0032474 | A1 | 2/2003 | Kaminkow | 463/25 |
| 2003/0036425 | A1 | 2/2003 | Kaminkow et al. | 463/25 |
| 2003/0064774 | A1 | 4/2003 | Fujimoto et al. | 463/16 |
| 2003/0078789 | A1 | 4/2003 | Oren | 705/1 |
| 2003/0083126 | A1 | 5/2003 | Paulsen | 463/25 |
| 2003/0090064 | A1 | 5/2003 | Hoyt et al. | 273/292 |
| 2003/0176209 | A1 | 9/2003 | Soltys et al. | 463/13 |
| 2003/0232651 | A1 | 12/2003 | Huard et al. | 463/42 |
| 2004/0033095 | A1 | 2/2004 | Saffari et al. | 400/120.01 |
| 2004/0043815 | A1 | 3/2004 | Kaminkow | 463/25 |

(56) References Cited

U.S. PATENT DOCUMENTS

| | | | | |
|---|---|---|---|---|
| 2004/0067789 | A1 | 4/2004 | Grauzer et al. | 463/11 |
| 2004/0100026 | A1 | 5/2004 | Haggard | 273/304 |
| 2004/0108255 | A1 | 6/2004 | Johnson | 209/547 |
| 2004/0108654 | A1 | 6/2004 | Grauzer et al. | 273/148 R |
| 2004/0132529 | A1 | 7/2004 | Mkrtchyan et al. | 463/29 |
| 2004/0150702 | A1 | 8/2004 | Tsuyoshi et al. | 347/100 |
| 2004/0169332 | A1 | 9/2004 | Grauzer et al. | 273/149 R |
| 2004/0207156 | A1 | 10/2004 | Soltys et al. | 273/292 |
| 2004/0224777 | A1 | 11/2004 | Smith et al. | 463/47 |
| 2005/0012270 | A1 | 1/2005 | Schubert et al. | 273/149 R |
| 2005/0023752 | A1 | 2/2005 | Grauzer et al. | 273/149 R |
| 2005/0026680 | A1 | 2/2005 | Gururajan | 463/25 |
| 2005/0026681 | A1 | 2/2005 | Grauzer et al. | 463/29 |
| 2005/0026682 | A1 | 2/2005 | Grauzer et al. | 463/29 |
| 2005/0040594 | A1 | 2/2005 | Krenn | 273/149 R |
| 2005/0043094 | A1 | 2/2005 | Nguyen et al. | 463/42 |
| 2005/0051955 | A1 | 3/2005 | Schubert et al. | 273/149 R |
| 2005/0051965 | A1 | 3/2005 | Gururajan | 273/292 |
| 2005/0054408 | A1* | 3/2005 | Steil et al. | 463/11 |
| 2005/0059479 | A1 | 3/2005 | Soltys et al. | 463/29 |
| 2005/0062226 | A1 | 3/2005 | Schubert et al. | 273/149 R |
| 2005/0062227 | A1 | 3/2005 | Grauzer et al. | 273/149 R |
| 2005/0073102 | A1 | 4/2005 | Yoseloff et al. | 273/292 |
| 2005/0093230 | A1 | 5/2005 | Grauzer et al. | 273/149 R |
| 2005/0101367 | A1 | 5/2005 | Soltys et al. | 463/12 |
| 2005/0121852 | A1 | 6/2005 | Soltys et al. | 273/149 P |
| 2005/0137005 | A1 | 6/2005 | Soltys et al. | 463/13 |
| 2005/0146094 | A1 | 7/2005 | Soltys et al. | 273/292 |
| 2005/0164761 | A1 | 7/2005 | Tain | 463/13 |
| 2005/0181856 | A1 | 8/2005 | Cannon et al. | 463/16 |
| 2005/0215311 | A1 | 9/2005 | Hornik et al. | 463/20 |
| 2005/0239542 | A1 | 10/2005 | Olsen | 463/27 |
| 2005/0282626 | A1 | 12/2005 | Manfredi et al. | 463/25 |
| 2005/0288083 | A1 | 12/2005 | Downs, III | 463/11 |
| 2005/0288084 | A1 | 12/2005 | Schubert | 463/11 |
| 2005/0288085 | A1 | 12/2005 | Schubert et al. | 463/11 |
| 2006/0001217 | A1 | 1/2006 | Soltys et al. | 273/292 |
| 2006/0046849 | A1 | 3/2006 | Kovacs | 463/39 |
| 2006/0205508 | A1 | 9/2006 | Green | 463/40 |
| 2006/0247013 | A1 | 11/2006 | Walker et al. | 463/20 |
| 2007/0015583 | A1 | 1/2007 | Tran | 463/40 |
| 2007/0057469 | A1 | 3/2007 | Grauzer et al. | 273/309 |
| 2007/0060365 | A1 | 3/2007 | Tien et al. | 463/42 |
| 2007/0077990 | A1 | 4/2007 | Cuddy et al. | 463/25 |
| 2007/0093298 | A1 | 4/2007 | Brunet | 463/42 |
| 2007/0111775 | A1 | 5/2007 | Yoseloff | 463/16 |
| 2007/0168251 | A1 | 7/2007 | Hilbert et al. | 705/14 |
| 2007/0259711 | A1 | 11/2007 | Thomas | 463/22 |
| 2007/0298865 | A1 | 12/2007 | Soltys | 463/22 |
| 2007/0298868 | A1 | 12/2007 | Soltys | 463/25 |
| 2008/0090651 | A1 | 4/2008 | Baerlocher | 463/27 |
| 2008/0113704 | A1 | 5/2008 | Jackson | 463/13 |
| 2008/0113773 | A1 | 5/2008 | Johnson et al. | 463/25 |
| 2008/0119284 | A1 | 5/2008 | Luciano, Jr. et al. | 463/42 |
| 2009/0005176 | A1 | 1/2009 | Morrow et al. | 463/43 |
| 2009/0115133 | A1 | 5/2009 | Kelly et al. | 273/274 |
| 2009/0117994 | A1 | 5/2009 | Kelly et al. | 463/25 |
| 2009/0118001 | A1 | 5/2009 | Kelly et al. | 463/29 |
| 2009/0118005 | A1 | 5/2009 | Kelly et al. | 463/31 |
| 2009/0163279 | A1 | 6/2009 | Hermansen et al. | 463/42 |
| 2009/0270170 | A1 | 10/2009 | Patton | 463/36 |
| 2009/0275374 | A1 | 11/2009 | Nelson et al. | 463/16 |
| 2009/0275393 | A1 | 11/2009 | Kisenwether et al. | 463/25 |
| 2009/0275411 | A1 | 11/2009 | Kisenwether et al. | 463/42 |
| 2010/0016068 | A1 | 1/2010 | White et al. | 463/25 |
| 2010/0113125 | A1 | 5/2010 | Bernard et al. | 463/20 |
| 2010/0125851 | A1 | 5/2010 | Singh et al. | 718/104 |

FOREIGN PATENT DOCUMENTS

| | | | |
|---|---|---|---|
| DE | 197 48 930 | A1 | 5/1998 |
| EP | 0 327 069 | A2 | 8/1989 |
| EP | 0 790 848 | | 8/1997 |
| EP | 0 700 980 | B1 | 11/1999 |
| EP | 1 291 045 | A2 | 3/2003 |
| FR | 530732 | | 12/1921 |
| FR | 24238 | | 3/1922 |
| FR | 2 775 196 | | 8/1999 |
| GB | 2 246 520 | A | 2/1992 |
| GB | 2 370 791 | A | 7/2002 |
| GB | 2 380 143 | A | 4/2003 |
| JP | 8255059 | | 10/1996 |
| WO | WO 96/36253 | | 11/1996 |
| WO | WO 99/43403 | | 9/1999 |
| WO | WO 02/05914 | A1 | 1/2002 |
| WO | WO 02/051512 | A2 | 7/2002 |
| WO | WO 03/004116 | A1 | 1/2003 |
| WO | 2005/035084 | | 4/2005 |
| WO | WO 2006/039308 | A2 | 4/2006 |
| WO | 2006/110348 | | 10/2006 |

OTHER PUBLICATIONS

U.S. Appl. No. 11/558,409, filed Nov. 9, 2006, Soltys.
U.S. Appl. No. 10/885,875, filed Jul. 7, 2004, Soltys et al.
U.S. Appl. No. 10/902,436, filed Jul. 29, 2004, Soltys et al.
U.S. Appl. No. 10/962,166, filed Oct. 8, 2004, Soltys et al.
U.S. Appl. No. 11/059,743, filed Feb. 16, 2005, Soltys et al.
U.S. Appl. No. 11/112,793, filed Apr. 21, 2005, Soltys et al.
U.S. Appl. No. 11/337,375, filed Jan. 23, 2006, Soltys et al.
U.S. Appl. No. 11/352,416, filed Feb. 10, 2006, Soltys.
U.S. Appl. No. 11/428,240, filed Jun. 30, 2006, Fleckenstein.
U.S. Appl. No. 11/428,244, filed Jun. 30, 2006, Soltys.
U.S. Appl. No. 11/428,249, filed Jun. 30, 2006, Fleckenstein.
U.S. Appl. No. 11/428,253, filed Jun. 30, 2006, Fleckenstein.
U.S. Appl. No. 11/428,258, filed Jun. 30, 2006, Fleckenstein.
U.S. Appl. No. 11/428,264, filed Jun. 30, 2006, Soltys.
U.S. Appl. No. 11/428,286, filed Jun. 30, 2006, Soltys et al.
U.S. Appl. No. 11/437,590, filed May 19, 2006, Soltys et al.
U.S. Appl. No. 11/478,360, filed Jun. 29, 2006, Fleckenstein.
U.S. Appl. No. 11/479,930, filed Jun. 30, 2006, Soltys et al.
U.S. Appl. No. 11/479,963, filed Jun. 29, 2006, Fleckenstein.
U.S. Appl. No. 11/480,273, filed Jun. 30, 2006, Soltys.
U.S. Appl. No. 11/480,275, filed Jun. 30, 2006, Fleckenstein.
U.S. Appl. No. 11/480,295, filed Jun. 29, 2006, Fleckenstein.
U.S. Appl. No. 11/480,321, filed Jun. 30, 2006, Soltys.
U.S. Appl. No. 11/480,345, filed Jun. 30, 2006, Fleckenstein.
U.S. Appl. No. 11/480,349, filed Jun. 30, 2006, Soltys et al.
U.S. Appl. No. 11/519,244, filed Sep. 11, 2006, Soltys et al.
U.S. Appl. No. 60/838,280, filed Aug. 17, 2006, Soltys et al.
Bulaysky, J., "Tracking the Tables," *Casino Journal*, May 2004, pp. 44-47, accessed Dec. 21, 2005, URL=http://www.ascendgaming.com/cj/vendors_manufacturers_table/Trackin916200411141AM.htm, 5 pages.
Burke, A., "Tracking the Tables," reprinted from *International Gaming & Wagering Business*, Aug. 2003, 4 pages.
Griffin, P., *The Theory of Blackjack*, GBC Press, Las Vegas, Nevada, 1979, 190 pages.
Gros, R., "All You Ever Wanted to Know About Table Games," reprinted from *Global Gaming Business*, Aug. 1, 2003, 2 pages.
Pro, L.V., "Book Review—The Card Counter's Guide to Casino Surveillance," *Blackjack Insider Newsletter*, May 2003, #40, accessed Aug. 25, 2006, URL=http:/bjinsider.com/newsletter_40_surveillance.shtml, 5 pages.
Scarne, J., *Scarne's Encyclopedia of Games*, Harper & Row, New York, 1973, p. 153.
Scarne, J., *Scarne's New Complete Guide to Gambling*, Simon & Schuster, Inc., New York, 1974, pp. 358-359.
Snyder, A., "The High-Tech Eye," excerpt from *Blackjack Forum*, Spring 1997, accessed Dec. 21, 2005, from Casino Software & Services, LLC, URL=http://www.casinosoftware.com/bj_forum.html.
Terdiman, D., "Who's Holding the Aces Now?", reprinted from *Wired News*, Aug. 18, 2003, 2 pages.
Ward, K., "BJ Tracking System has Players Down for the Count," *Gaming Today*, Mar. 5, 2002, accessed Dec. 21, 2005, from Casino Software & Services, LLC, URL=http://www.casinosoftware.com/gaming_today.html.

(56) References Cited

OTHER PUBLICATIONS

Winkler, C., "Product Spotlight: MindPlay," reprinted from *Gaming and Leisure Technology*, Fall 2003, 2 pages.
Bally TMS, "MP21—Automated Table Tracking/Features," 2 pages, Nov. 2005.
Bally TMS, "MPBacc—Intelligent Table Tracking/Features," 2 pages, Nov. 2005.
Bally TMS, "MPBacc—Specifications/Specifications," 2 pages, Nov. 2005.
Bravo Gaming Systems, "Casino Table Wager Analysis and Player Tracking System—Table Operations/Unique Features," accessed Apr. 11, 2005, URL=http://www.genesisgaming.com, 4 pages.
Casino Software & Services, LLC., accessed Aug. 25, 2006, URL=http:/casinosoftware.com/home.html, 6 pages.
International Guild of Hospitality & Restaurant Managers, "Shuffle Master, Inc. (NasdaqNM:SHFL)," accessed Dec. 30, 2003, URL=http://hospitalityguide.com/Financial/Casinos/Shuffle.htm, 3 pages.
Mikohn, "Mikohn Tablelink—The Industry's Premier Table Tracking Solution Delivers Improvements Straight to the Bottom Line," 2 pages, before Jan. 1, 2004.
Mikohn, "Tablelink™, The New Standard in Table Games," before Jan. 1, 2004, 14 pages.
Plaintiff's Declaration of Lawrence Luciano in Opposition to Shuffle Master's Motion for Preliminary Injunction, *Card, LLC* v. *Shuffle Master, Inc*., D. Nev. (No. CV-N-03-0244-ECR-(RAM)), Nov. 24, 2003.
Shuffle Master, Inc., "Shuffle Master Announces New Products; Intelligent Table System to be Debuted at G2E," Sep. 10, 2003, 2 pages.
Humble, L., *The World's Greatest Blackjack Book*, Random House, Inc., New York, 1987, p. 182.
MagTek, "Port Powered Swipe Reader," Technical Reference Manual, Manual Part No. 99875094 Rev 12, Jun. 2003, 20 pages.

* cited by examiner

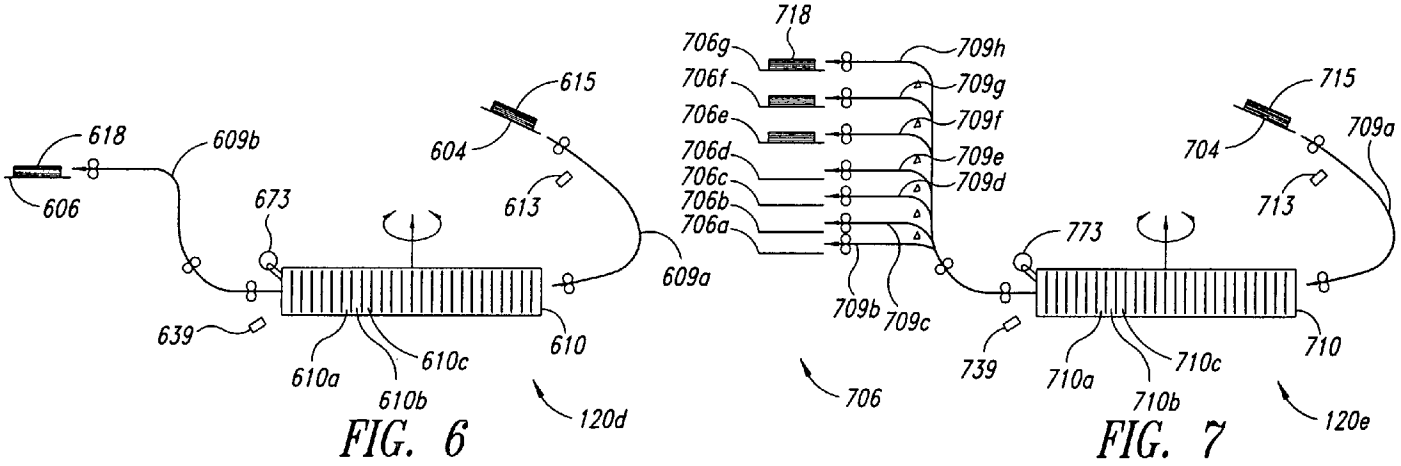
FIG. 6
FIG. 7
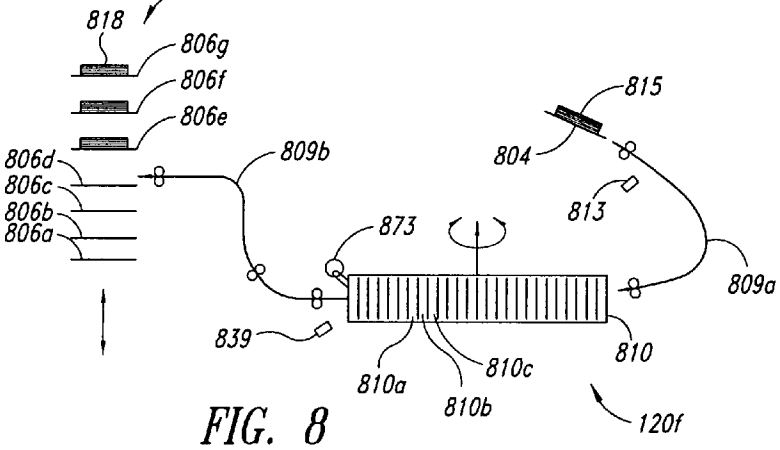
FIG. 8

SYSTEMS, METHODS AND ARTICLES TO FACILITATE DELIVERY OF SETS OR PACKETS OF PLAYING CARDS

CROSS-REFERENCE TO RELATED APPLICATION

This application claims the benefit under 35 U.S.C. §119 (e) of U.S. Provisional Patent Application Ser. No. 60/815,910, entitled "SYSTEMS, METHODS AND ARTICLES TO FACILITATE DELIVERY OF SETS OR PACKETS OF PLAYING CARDS," and filed Jun. 21, 2006.

BACKGROUND

1. Field

This description generally relates to the field of table gaming, and more particularly to games played with playing cards.

2. Description of the Related Art

There are numerous games played with playing cards. For example, blackjack, baccarat, various types of poker, LET IT RIDE®, and/or UNO®, to name a few. Games may be played with one or more standard decks of playing cards. A standard deck of playing cards typically comprises fifty-two playing cards, each playing card having a combination of a rank symbol and a suit symbol, selected from thirteen rank symbols (i.e., 2, 3, 4, 5, 6, 7, 8, 9, 10, J, Q, K, and A) and four suit symbols (i.e., ♡, ♧, ♢, and ♤). Some games may include non-standard playing cards, for example playing cards with symbols other than the rank and suit symbols associated with a standard deck, such as those used in the game marketed under the brand UNO® by Mattel.

In some instances playing card games involve wagering, where money and/or prizes may be won. In other instances playing card games are played for fun or recreation without wagering. In either case, it is typically desirable to randomize the set of playing cards before dealing the playing cards to the participants (e.g., players and/or dealer). Randomizing is typically referred to as shuffling, which may be performed manually by riffling or interleaving the corners of two stacks of playing cards by hand, or may be performed automatically by an automatic card shuffling machine.

While there may exist variation from casino-to-casino, playing card games typically have a fixed set of theoretical or "true" odds associated with them. The theoretical or true odds are reflected in the schedule of payout or "house" odds associated with the game, and typically provide for a house edge or advantage (e.g., theoretical hold). Many casinos set a house advantage or theoretical hold of at least 0.5%, which means that the house would likely earn 0.5% of every dollar wagered for the particular game over the long term. The house advantage may be as high as 30%, for example for the game Let-It-Ride®.

A casino may, for example, provide a schedule of payout or house odds for blackjack. A typical house odds schedule may provide for a 1:1 or "even money" payout for all winning bets with the exception of blackjack (i.e., initial two cards dealt to player have a total value of twenty-one). A blackjack may be paid at 3:1, unless the dealer also has a blackjack which is typically considered a tie (i.e., push) and no money is exchanged. The theoretical or true odds reflect the statistical probabilities of the occurrence of certain events over a large number of attempts or trials.

The casino typically has a house advantage due to a difference between the theoretical or true odds and the payout or house odds. The casino may achieve a higher house advantage due to specific rules of the game. For example, under most blackjack rules the dealer selects hit cards only after all of the players have completed their hands. This provides the opportunity for the players to draw hands with a value exceeding twenty-one (i.e., bust) and lose, without the dealer having to take any hit cards. Thus, the dealer avoids the possibility of busting, and losing to a player that has already gone bust. Consequently, the house enjoys a further advantage over the true odds of the game. The casino may obtain a further house advantage by setting the rules with respect to when the dealer must take additional playing cards (e.g., stand on hand with value of a hard or soft 17 points, hit on 16 points, etc.). The casino may obtain a further house advantage by selecting the total number of decks from which the card game will be dealt. Thus, while the basic rules determine the theoretical or true odds of the game, variations in the rules as well as the house odds may effect the house advantage.

At least in blackjack, the theoretical true odds reflect the probability of certain outcomes over a large number of hands, predicated on "perfect play" by a player. Typically, players cannot play perfectly, and may make decisions (e.g., hit or stand, split, double down) that do not accord with the decision that would provide the highest probability of winning (e.g., "basic" strategy). This provides a further advantage to the casino or house. Some players adopt various playing strategies to obtain or to try to exceed the theoretical odds. Some of these strategies are legal, some illegal, and some while legal, are discouraged by certain gaming establishments. For example, a player may play basic strategy as outlined in numerous references on gaming. Some players may tracking the playing cards that appear on the gaming table using various card counting strategies (e.g., fives count, tens count), also outlined in numerous references on gaming. This may allow the player to adjust the amount of wagers based on whether the cards remaining to be dealt are thought to be favorable or unfavorable. For example, a set or "deck" having a relatively high percentage of playing cards with a value of ten is typically considered favorable to the dealer, while a relatively low percentage of playing cards with values of 2-8 is typically considered favorable to the player.

Casinos and other gaming establishments are continually looking for ways to make gaming fresher and more exciting for their patrons. For example, many casinos may offer games in which hands of playing cards are composed of playing cards specific to the hand as well as some number of playing cards that are common to two or more hands. Casinos may also wish to speed up games, for example by providing playing cards in sets or packets. Casinos may further desire the ability to allow the placement of bonus wagers and/or progressive wagers. New approaches to varying existing card games are highly desirable.

BRIEF SUMMARY

In one embodiment, a method of operating a card handling system comprises for each of at least some of a number of participants, retrieving at least two playing cards from respective ones of a plurality of playing card receiving compartments of a first intermediary playing card receiver based on a number of pseudo-randomly generated virtual playing card values; and for each of the at least some of the number of participants, forming a distinct set of playing cards from the at least two retrieved playing cards for delivery to the respective participant. Forming a distinct set of playing cards from the at least two retrieved playing cards for delivery to the respective one of the at least some of the participants may comprise transferring the at least two retrieved playing cards to a second intermediary playing card receiver.

In another embodiment, a method of operating a card handling system comprises transferring a plurality of playing cards from a playing card input receiver along at least one playing card transport path toward at least a first intermediary playing card receiver; locating at least some of the playing cards at least partially into respective ones of a number of playing card receiving compartments of the first intermediary playing card receiver, such that there is no more than one playing card in any one of the playing card receiving compartments of the first intermediary playing card receiver at a time; and for each of at least one playing card receiving compartment of a plurality of playing card receiving compartments of a second intermediary playing card receiver: retrieving at least two playing cards from respective ones of the playing card receiving compartments of the first intermediary playing card receiver based on a number of randomly generated virtual playing card values, and forming a distinct set of at least two playing cards at least partially received in the respective one of the playing card receiving compartments from the playing cards retrieved from the playing card receiving compartments of the first playing card receiver.

In another embodiment, a processor-readable medium stores instructions that causes a processor to operate a playing card handing system, by: transferring a plurality of playing cards from a playing card input receiver along at least one playing card transport path toward at least a first intermediary playing card receiver; locating at least some of the playing cards at least partially into respective ones of a number of playing card receiving compartments of the first intermediary playing card receiver, such that there is no more than one playing card in any one of the playing card receiving compartments of the first intermediary playing card receiver at a time; and for each of at least one playing card receiving compartment of a plurality of playing card receiving compartments of a second intermediary playing card receiver: retrieving at least two playing cards from respective ones of the playing card receiving compartments of the first intermediary playing card receiver based on a number of randomly generated virtual playing card values, and forming a distinct set of at least two playing cards at least partially received in the respective one of the playing card receiving compartments of the second intermediary playing card receiver from the playing cards retrieved from the playing card receiving compartments of the first playing card receiver.

In another embodiment, a card handing system comprises a playing card input receiver sized and dimension to receive a number of playing cards; a first intermediary playing card receiver comprising a plurality of playing card receiving compartments that each store at most one of the playing cards when in use; a second playing card receiver comprising a plurality of playing card compartments at least some of which each store at least two of the playing cards when in use; and a processor configured to cause a retrieval of at least two playing cards for each of at least some of a number of participants in a card game from respective ones of the plurality of playing card receiving compartments of the first intermediary playing card receiver based on a number of randomly generated virtual playing card values; and to cause a delivery of the at least two retrieved playing cards for each of the participants to a respective one of the playing card receiving compartments of the second playing card receiver to form a respective distinct set of playing cards for delivery to the respective participant.

In another embodiment, a card handing system comprises a playing card input receiver sized and dimension to receive a number of playing cards; a first intermediary playing card receiver comprising a plurality of playing card receiving compartments that each store at most one of the playing cards when in use; a second playing card receiver comprising a plurality of playing card compartments at least some of which each store at least two of the playing cards when in use; means for retrieving of at least two playing cards for each of at least some of a number of participants in a card game from respective ones of the plurality of playing card receiving compartments of the first intermediary playing card receiver based on a number of randomly generated virtual playing card values; and means for delivering of the at least two retrieved playing cards for each of the participants to a respective one of the playing card receiving compartments of the second playing card receiver to form a respective distinct set of playing cards for delivery to the respective participant.

In yet another embodiment, a method of operating a playing card handling system comprises determining a number of random virtual playing card values; and forming a first set of at least two playing cards that will comprise at least a portion of a first hand of playing cards for a round of a card game based on at least some of the number of virtual playing card values, before delivering any playing cards to form a second set of at least two playing cards that will comprise at least a portion of a second hand of playing cards for the same round of the card game.

In an even further embodiment, a playing card handling system comprises a playing card input receiver to receive a plurality of playing cards that are to be handled; a playing card output receiver having a single playing card receiving compartment to provide a respective set of at least two playing cards for forming at least a portion of each of at least two hands of playing cards dealt in a card game; at least a first intermediary playing card receiver comprising a plurality of playing card receiving compartments that each receive at most one playing card during use; at least a first playing card input transport path extending between the playing card input receiver and at least the first intermediary playing card receiver, along which the playing cards are transported from the playing card input receiver to at least the first intermediary playing card receiver; and at least a first playing card output transport path extending between the first intermediary playing card receiver and the playing card output receiver, along which the playing cards are transported from the first intermediary playing card receiver to the playing card output receiver without any intervening multiple compartment playing card receivers therebetween.

In yet a further embodiment, a playing card handling system comprises at least a first intermediate playing card receiver comprising a plurality of playing card receiving compartments that each receive at most one playing card during use; a playing card output receiver to make accessible to a user a number of sets of at least two playing cards for each of a plurality of hands of playing cards; and at least a first playing card output transport path extending between the first intermediary playing card receiver and the playing card output receiver along which the playing cards are transported without stopping at any intervening locations therebetween.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

FIG. 6 is a schematic diagram of a simplified playing card handling system, according to another illustrated embodiment.

FIG. 7 is a schematic diagram of a simplified playing card handling system, according to another illustrated embodiment.

FIG. 8 is a schematic diagram of a simplified playing card handling system, according to another illustrated embodiment.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with servers, networks, displays, media handling and/or printers have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Further more, the particular features, structures, or characteristics may be combined in any suitable manner in one or more embodiments.

The headings provided herein are for convenience only and do not interpret the scope or meaning of the embodiments.

Description of Gaming Environments

Figure 1:
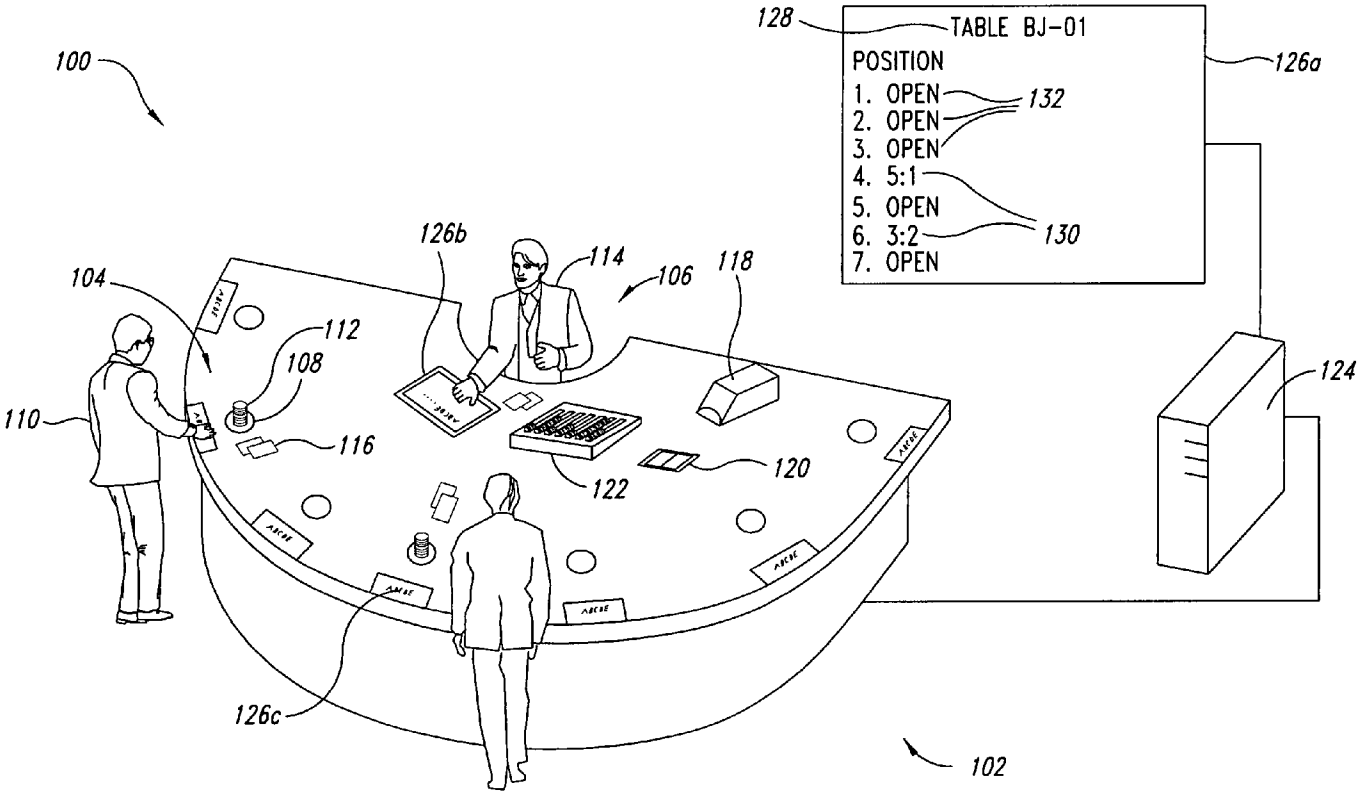
FIG. 1 is a schematic view of a gaming environment, including a gaming table, a host computing system, and at least one display visible to a number of participants, according to one illustrated embodiment.

FIG. 1 shows a gaming environment 100 according one illustrated embodiment.

The gaming environment 100 includes one or more gaming tables 102 having a number of player positions 104 (only one called out in Figure) and a dealer position 106. The player positions 104 are typically associated with a wagering area demarcated on the playing surface of the gaming table 102 and commonly referred to as a betting circle 108 (only one called out in Figure). A player 110 (only one called out in Figure) places a bet or wager by locating one or more chips 112 or other items of value in the betting circle 108.

A dealer 114 deals playing cards 116 to the players 110. In some games, the dealer 114 may deal playing cards to the dealer's own self. The dealer 114 may deal playing cards 116 from a handheld deck or from a card shoe 118. The dealer 114 may retrieve the playing cards 116 from a playing card handling system 120, for example, an automatic shuffling machine. The dealer 114 may load the retrieved playing cards 116 into the card shoe 118, if the card shoe 118 is present on the gaming table 102. The dealer 114 uses a chip tray 122 for storing wagers collected from losing players 110 and for paying out winnings to winning players 110.

The gaming environment 100 may also include a host computing system 124 and one or more displays 126*a*, 126*b* (collectively 126). The host computing system 124 is communicatively coupled to one or more systems and subsystems at the gaming table 102, and to the displays 126*a*, 126*b*. The host computing system 124 may, for example, control or provide information to the display 126*a*, 126*b* for displaying information about the game being played at the gaming table 102. For example, the host computing system 124 can cause the displays 126*a*, 126*b* to display a table identifier 128 that identifies the gaming table 102. The host computing system 124 may also display information about the various player positions 104. For example, the host computing system 124 can cause the display 126*a*, 126*b* to display payout or house odds 130 for each of the player positions 104. Additionally, or alternatively, the host computing system 124 can cause the display 126*a*, 126*b* to display a status indication of the player position 104. For example, the display 126*a*, 126*b* may display information 132 indicating that a player position 104 is open or is not currently open.

One or more of the displays 126*a* may be in the line-of-sight or otherwise visible from one or more of the player positions 104. The display 126*a* may be viewable by some or all of the players 110 at the various gaming tables 102*a*-102*d*. The displays 126*a* may be viewable by other patrons of the casino. Such may advantageously create excitement amongst the patrons. Such also advantageously allows pit bosses or other casino personnel to easily keep track of the payout or house odds selected by the players 110 in the various player positions 104 at multiple tables. The pit bosses or other casino personnel may quickly and easily discern suspect or extraordinarily high payout or house odds selections.

One or more of the displays 126*b* may be in the line-of-sight or otherwise visible from the dealer position 106. Some embodiments may only include a display 126*b* visible from the dealer position 106, and may or may not include a shield or other features that prevent the players 110 from seeing the information displayed on the display 126*b* visible from the dealer position 106.

One or more displays may provide an input interface for the dealer 114. For example, the display 126*b* may take the form of a touch sensitive display, presenting a graphical user interface (GUI) with one or more user selectable icons. The display 126*b* may be positioned within reach (e.g., within approximately 3 feet) of the dealer position 106. Such may allow the dealer 114 to enter odds information for each of the respective player positions 104. For example, the dealer 114 may enter payout or house odds, such as standard blackjack payout or house odds 3:2 for player position 6, while entering non-standard blackjack payout or house odds (e.g., 5:1) for the fourth player position.

One or more displays 126*c* (only one called in the Figure) may be positioned proximate respective ones of the player positions 104. The host computing system 124 can cause the displays 126*c* to display information regarding the game. In particular, the host computing system 124 can cause the displays 126*c* to display information regarding payout or house odds for all of the player positions 104. Alternatively, the host computing system 124 can cause the displays 126*c* to display information regarding payout or house odds for only the respective player position 104 to which the display 126*c* is proximate.

The displays 126*c* may take the form of touch screen displays presenting a GUI with user selectable icons. The user selectable icons may allow the players 110 to select payout or house odds for a particular hand or game. The user selectable icons may allow the player 110 to select between a set of predefined house odds (e.g., 1:1, 2:1, 3:1, . . . , 100:1, . . . , 1000:1, etc.) or may permit the user to enter a user defined set of payout or house odds. Alternatively, or additionally, other user input devices may be employed, for example, keypads and/or keyboards. The user selected house odds may be displayed on the display 126*b* viewable by the dealer 114. In other embodiments, the payout or house odds may be kept secret from the dealer 114 as well as from the other players 110.

Discussion of Suitable Computing Environment

Figure 2:
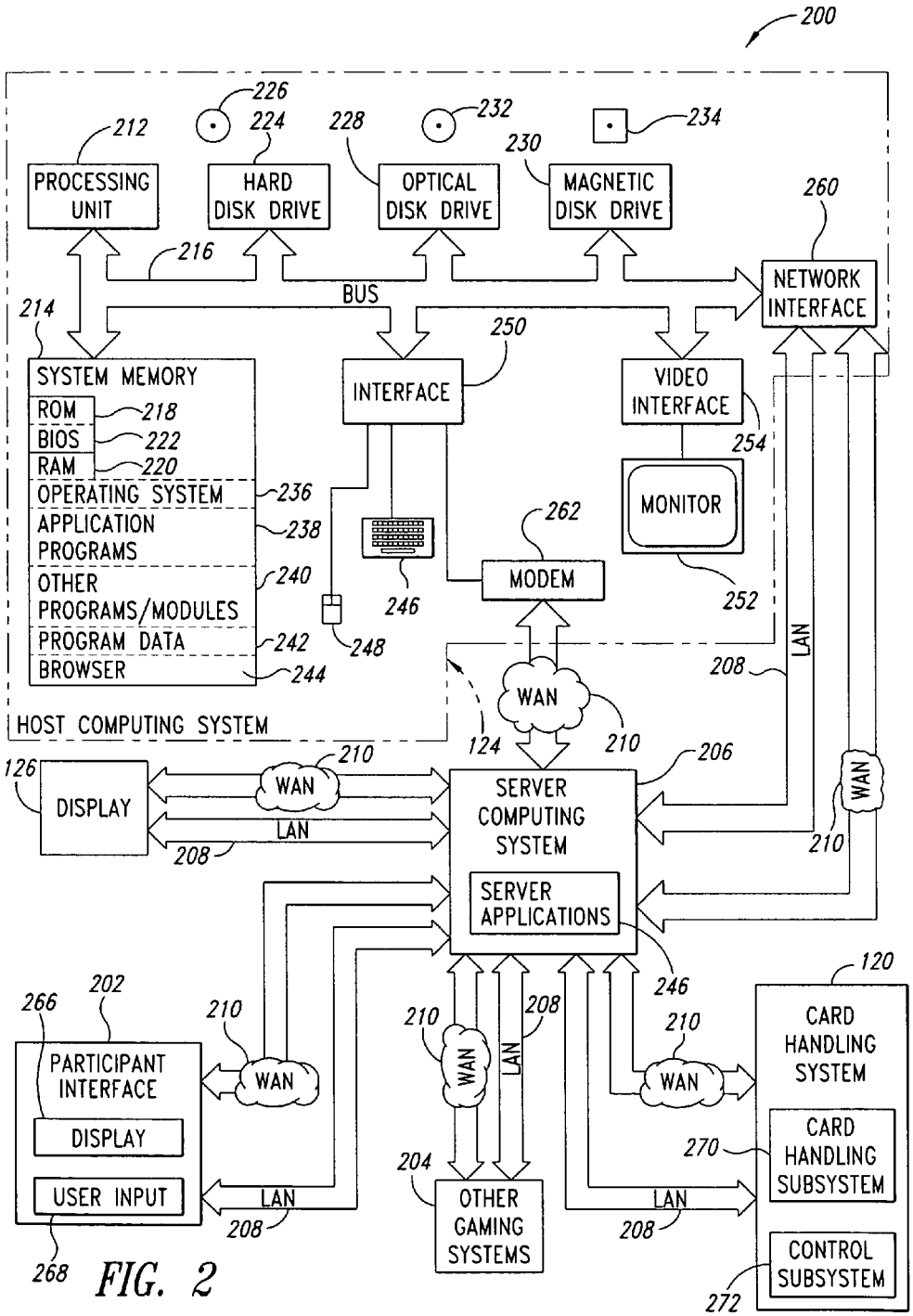
FIG. 2 is a schematic diagram of a gaming system, including a host computing system, gaming table system, participant interface, other gaming systems, and server computing system communicatively coupling at least some of the other elements, according to one illustrated embodiment.

FIG. 2 and the following discussion provide a brief, general description of a suitable computing environment 200 in which the various illustrated embodiments can be implemented. Although not required, the embodiments will be described in the general context of computer-executable instructions, such as program application modules, objects, or macros being executed by a computer. Those skilled in the relevant art will appreciate that the illustrated embodiments as well as other embodiments can be practiced with other computer system configurations, including hand-held devices, multiprocessor systems, microprocessor-based or programmable consumer electronics, personal computers ("PCs"), network PCs, mini computers, mainframe computers, and the like. The embodiments can be practiced in distributed computing environments where tasks or modules are performed by remote processing devices, which are linked through a communications network. In a distributed computing environment, program modules may be located in both local and remote memory storage devices.

FIG. 2 shows the computing environment 200 comprising one or more host computing systems 124, displays 126, participant interfaces 202, playing card handling systems 120, other gaming systems 204, and/or server computing systems 206 coupled by one or more communications channels, for example one or more local area networks (LANs) 208 or wide area networks (WANs) 210. The computing environment 200 may employ other computers, such as conventional personal computers, where the size or scale of the system allows.

The host computing system 124 may take the form of a conventional mainframe or mini-computer, that includes a processing unit 212, a system memory 214 and a system bus 216 that couples various system components including the system memory 214 to the processing unit 212. Non-limiting examples of commercially available systems include, but are not limited to, an 80×86 or Pentium series microprocessor from Intel Corporation, U.S.A., a PowerPC microprocessor from IBM, a Sparc microprocessor from Sun Microsystems, Inc., a PA-RISC series microprocessor from Hewlett-Packard Company, or a 68xxx series microprocessor from Motorola Corporation. The host computing system 124 will at times be referred to in the singular herein, but this is not intended to limit the embodiments to a single host computing system since in typical embodiments, there will be more than one host computing system or other device involved.

The processing unit 212 may be any logic processing unit, such as one or more central processing units (CPUs), digital signal processors (DSPs), application-specific integrated circuits (ASICs), etc. Unless described otherwise, the construction and operation of the various blocks shown in FIG. 2 are of conventional design. As a result, such blocks need not be described in further detail herein, as they will be understood by those skilled in the relevant art.

The system bus 216 can employ any known bus structures or architectures, including a memory bus with memory controller, a peripheral bus, and a local bus. The system memory 214 includes read-only memory ("ROM") 218 and random access memory ("RAM") 220. A basic input/output system ("BIOS") 222, which can form part of the ROM 218, contains basic routines that help transfer information between elements within the host computing system 124, such as during start-up.

The host computing system 124 also includes a hard disk drive 224 for reading from and writing to a hard disk 226, and an optical disk drive 228 and a magnetic disk drive 230 for reading from and writing to removable optical disks 232 and magnetic disks 234, respectively. The optical disk 232 can be a CD-ROM, while the magnetic disk 234 can be a magnetic floppy disk or diskette. The hard disk drive 224, optical disk drive 228 and magnetic disk drive 230 communicate with the processing unit 212 via the system bus 216. The hard disk drive 224, optical disk drive 228 and magnetic disk drive 230 may include interfaces or controllers (not shown) coupled between such drives and the system bus 216, as is known by those skilled in the relevant art. The drives 224, 228 and 230, and their associated computer-readable media 226, 232, 234, provide nonvolatile storage of computer readable instructions, data structures, program modules and other data for the host computing system 124. Although the depicted host computing system 124 employs hard disk 224, optical disk 228 and magnetic disk 230, those skilled in the relevant art will appreciate that other types of computer-readable media that can store data accessible by a computer may be employed, such as magnetic cassettes, flash memory cards, digital video disks ("DVD"), Bernoulli cartridges, RAMs, ROMs, smart cards, etc.

Program modules can be stored in the system memory 214, such as an operating system 236, one or more application programs 238, other programs or modules 240 and program data 242. The system memory 214 may also include communications programs for example a Web client or browser 244 for permitting the host computing system 124 to access and exchange data with sources such as Web sites of the Internet, corporate intranets, or other networks as described below, as well as other server applications on server computing systems such as those discussed further below. The browser 244 in the depicted embodiment is markup language based, such as Hypertext Markup Language (HTML), Extensible Markup Language (XML) or Wireless Markup Language (WML), and operates with markup languages that use syntactically delimited characters added to the data of a document to represent the structure of the document. A number of Web clients or browsers are commercially available such as those from America Online and Microsoft of Redmond, Wash.

While shown in FIG. 2 as being stored in the system memory 214, the operating system 236, application programs 238, other programs/modules 240, program data 242 and browser 244 can be stored on the hard disk 226 of the hard disk drive 224, the optical disk 232 of the optical disk drive 228 and/or the magnetic disk 234 of the magnetic disk drive 230. An operator, such as casino personnel, can enter commands and information into the host computing system 124 through input devices such as a touch screen or keyboard 246 and/or a pointing device such as a mouse 248. Other input devices can include a microphone, joystick, game pad, tablet, scanner, etc. These and other input devices are connected to the processing unit 212 through an interface 250 such as a serial port interface that couples to the system bus 216, although other interfaces such as a parallel port, a game port or a wireless interface or a universal serial bus ("USB") can be used. A monitor 252 or other display device is coupled to the system bus 216 via a video interface 254, such as a video adapter. The host computing system 124 can include other output devices, such as speakers, printers, etc.

The host computing system 124 can operate in a networked environment using logical connections to one or more remote computers and/or devices, for example the server computing system 206. The server computing system 206 can be another personal computer, a server, another type of computer, or a collection of more than one computer communicatively linked together and typically includes many or all of the elements described above for the host computing system 124. The server computing system 206 is logically connected to one or more of the host computing systems 124 under any known method of permitting computers to communicate, such as through one or more LANs 208 and/or WANs 210 such as the Internet. Such networking environments are well known in wired and wireless enterprise-wide computer networks, intranets, extranets, and the Internet. Other embodiments include other types of communication networks including telecommunications networks, cellular networks, paging networks, and other mobile networks.

When used in a LAN networking environment, the host computing system 124 is connected to the LAN 208 through an adapter or network interface 260 (communicatively linked to the system bus 216). When used in a WAN networking environment, the host computing system 124 may include a modem 262 or other device, such as the network interface 260, for establishing communications over the WAN 210. The modem 262 is shown in FIG. 2 as communicatively linked between the interface 250 and the WAN 210. In a networked environment, program modules, application programs, or data, or portions thereof, can be stored in the server computing system 206. In the depicted embodiment, the host computing system 124 is communicatively linked to the server computing system 206 through the LANs 208 and/or WAN 210, for example with TCP/IP middle layer network protocols. However, other similar network protocol layers are used in other embodiments, such as User Datagram Protocol ("UDP"). Those skilled in the relevant art will readily recognize that the network connections shown in FIG. 2 are only some examples of establishing communication links between computers, and other links may be used, including wireless links.

The server computing system 206 is also communicatively linked to one or more other computing systems or devices, such as the display 126, participant interface 202, playing card handling system 120 and/or other gaming systems 204, typically through the LAN 208 or the WAN 210 or other networking configuration such as a direct asynchronous connection (not shown).

The server computing system 206 includes server applications 264 for the routing of instructions, programs, data and agents between the host computing system 124, display 126, playing card handling system 120, participant interface 202, and/or other gaming systems 204. For example the server applications 264 may include conventional server applications such as WINDOWS NT 4.0 Server, and/or WINDOWS 2000 Server, available from Microsoft Corporation or Redmond, Wash. Additionally, or alternatively, the server applications 264 can include any of a number of commercially available Web servers, such as INTERNET INFORMATION SERVICE from Microsoft Corporation and/or IPLANET from Netscape.

The participant interface 202 may include one or more displays 266 and user input devices 268. The participant interface 202 may take the form of one or more of the displays 126*b*, 126*c* (FIG. 1). As discussed above, the displays 126 may take the form of touch screen displays. Alternatively, or additionally, the participant interface 202 may employ a separate user input device, for example a keyboard or keypad. The participant interface 202 may further include one or more sound transducers, such as a speaker and/or microphone.

The participant interface 202 may include one or more controllers, memories and may store and execute one or more applications for providing information to, and collecting information from the participants 110, 114 (FIG. 1). For example, the players 110 may select payout or house odds and/or house advantage via the participant interface 202, for example via a GUI. The participant interface 202 may provide the player 110 with a selection of predefined payout or house odds and/or house advantages, or may receive payout or house odds and/or house advantage defined by the player 110. The participant interface 202 may permit the players 110 to select from a variety of bonus and/or progressive gaming options. Likewise, the participant interface 202 may provide the dealer 114 with the selected payout or house odds and/or house advantage for the various players 110, and may permit the dealer to enter the payout or house odds or house advantage for the various player positions 104.

Additionally, the participant interface 202 may include instructions for handling security such as password or other access protection and communications encryption. The participant interface 202 can also provide statistics (win, loss, time, etc.) to the players 110 and/or dealer 114. The statistics may be provided in real-time or almost real-time. Further, the participant interface 202 may allow the player 110 to request drinks, food, and/or services. The participant interface 202 may allow the dealer 114 to request assistance, for example requesting more chips or new playing cards. Other information may include one or more of player identification data, preference data, statistical data for the particular player and/or other players, account numbers, account balances, maximum and/or minimum wagers, etc.

Various playing card handling systems 120 are discussed in detail below, and may include one or more playing card handling subsystems 270 and one or more controller subsystems 272, which may include one or more programmed microprocessors, application specific integrated circuits (ASICs), memories or the like.

The other gaming systems 204 may include one or more sensors, detectors, input devices, output devices, actuators, and/or controllers such as programmed microprocessor and/or ASIC or the like. The controllers may execute one or more gaming applications. The gaming applications can include instructions for acquiring wagering and gaming event information from the live gaming at the gaming table 102 (FIG. 1). The other gaming systems 204 may collect information via images (visible, infrared, ultraviolet), radio or microwave electromagnetic radiation, and/or by detecting magnetic, inductance, or mechanical energy. Such may be implemented in the card shoe 118, chip tray 122, or other areas at or proximate the gaming table 102. For example, the other gaming systems 204 may acquire images of the wagers 112 and/or identifiers on playing cards 116. The gaming applications can also include instructions for processing, at least partially, the acquired wagering and gaming event information, for example, identifying the position and size of each wager and/or the value of each hand of playing cards. The gaming applications may include statistical packages for producing statistical information regarding the play at a particular gaming table, the performance of one or more players, and/or the performance of the dealer 114 and/or game operator. The gaming applications can also include instructions for providing a video feed and/or simulation of some or all of the participant positions 104, 106. Gaming applications may determine, track, monitor or otherwise process outcomes of games, amounts of wagers, average wager, player identity information, complimentary benefits information ("comps"), player performance data, dealer performance data, chip tray accounting information, playing card sequences, etc. Some suitable applications are described in one or more of commonly assigned U.S. patent applications: Ser. No. 60/442,368, filed Apr. 21, 1999; Ser. No. 09/474,858 filed Dec. 30, 1999, entitled "METHOD AND APPARATUS FOR MONITORING CASINO GAMING"; Ser. No. 60/259,658, filed Jan. 4, 2001; Ser. No. 09/849,456 filed May 4, 2001, Ser. No. 09/790,480, filed Feb. 21, 2001, entitled "METHOD, APPARATUS AND ARTICLE FOR EVALUATING CARD GAMES, SUCH AS BLACKJACK".

Some embodiments may communicatively couple one or more of the systems 120, 124, 204, displays 126 and/or participant interfaces 402 without the use of the server computing system 206, or alternatively via multiple server computing systems.

Structural Aspects of the Playing Card Handling Systems

Figure 3A:
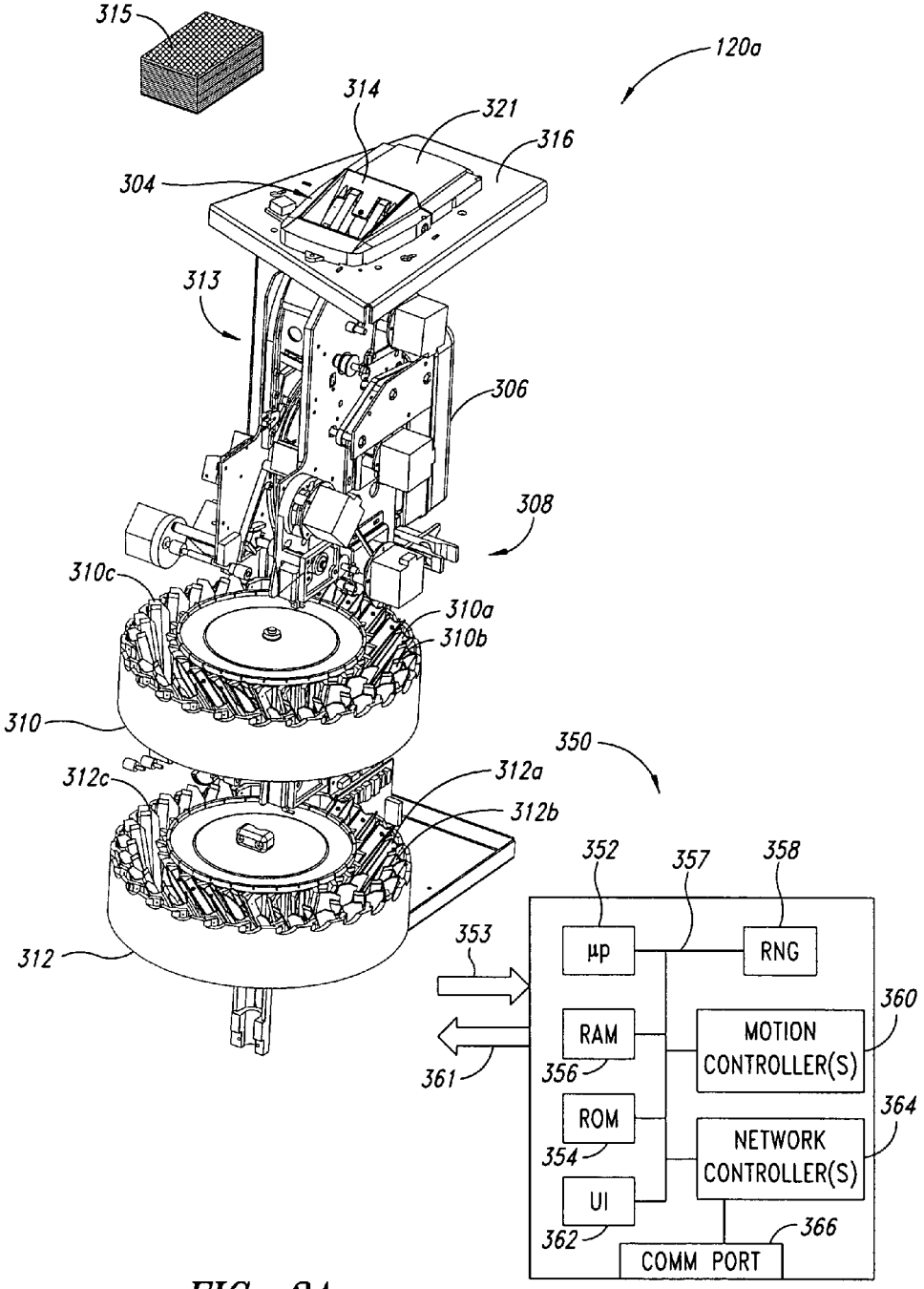
FIG. 3A is an isometric view of a playing card handling system according to one illustrated embodiment.
Figure 3B:
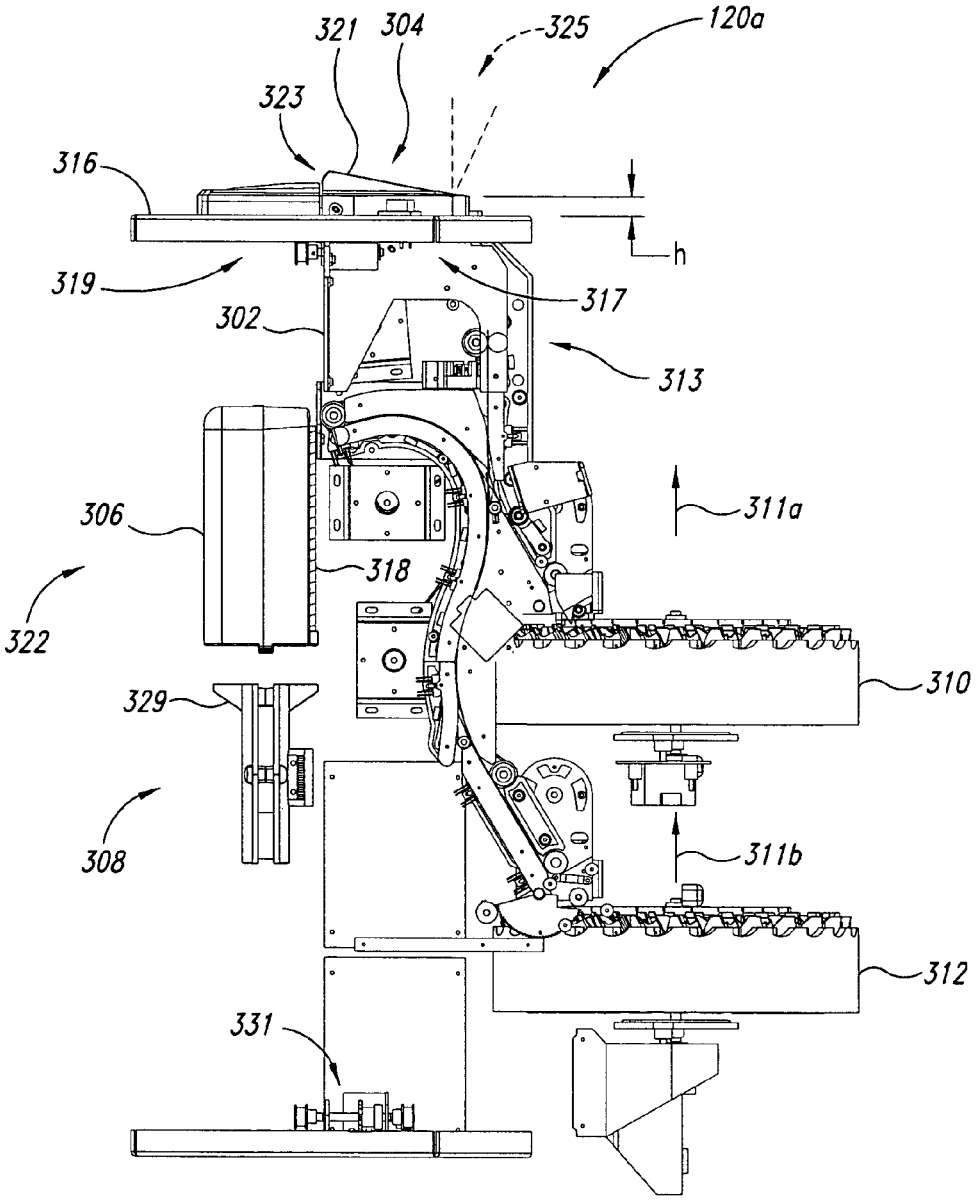
FIG. 3B is an isometric view of a playing card handling system of FIG. 5A.
Figure 3C:
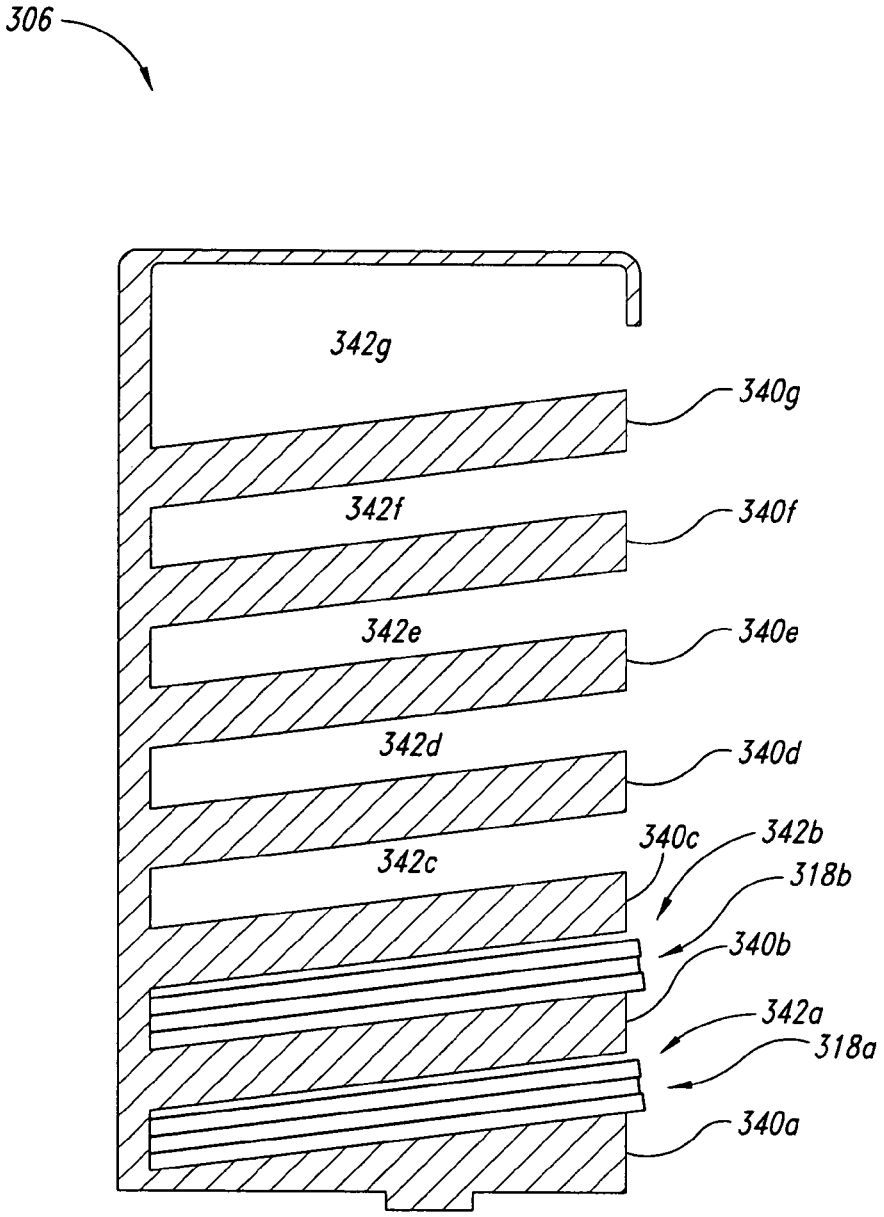
FIG. 3C is a cross sectional diagram of a playing card output receiver having a plurality of playing card receiving compartments which receive sets or packets of playing cards, according to one illustrated embodiment.

FIGS. 3A-3C show a playing card handling system 120*a* for handling playing cards according to one illustrated embodiment. As explained in detail below, the playing card handling system 120*a* is operable to provide one or more sets of randomized playing cards for use in a card game, which may, or may not be based on selected payout or house odds and/or house advantage.

The playing card handling system 120*a* can be coupled to or installed with or near the gaming table 102 (FIG. 1). In one embodiment, the playing card handling system 120*a* is installed away from the gaming table 102, for example, in a restricted area of a casino where decks of playing cards are received and shuffled.

The playing card handling system 120*a* includes a structural frame 302, a playing card input receiver 304, a playing card output receiver 306, a card elevator mechanism 308, a first intermediary playing card receiver 310, and an optional, second intermediary playing card receiver 312. The playing card handling system 120*a* may be partially or fully enclosed by a housing (not shown) and/or by the gaming table 102 (FIG. 1). At least one playing card input transport path 309 extends between the playing card input receiver 304 and at least one of the intermediary playing card receiver 310, 312.

At least one playing card input reading sensor 313 is positioned between the playing card input receiver 304 and the playing card output receiver 306. The playing card input reading sensor 313 is operable to read identifying information from the playing cards between the playing card input receiver 304 and at least one of the intermediary playing card receivers 310, 312. The information allows the playing cards to be identified, for example by rank and/or suit, or other values such as a point value of the playing card. The playing card input reading sensor 313 may, for example, take the form an optical machine-readable symbol reader, operable to read non-standard playing card markings from the playing cards, for example machine-readable symbols such as barcode, matrix or area code, or stacked code symbols (typically using a non-visible medium such as ultraviolet sensitive ink or the like). The playing card input reading sensor 313 may be operable to read standard playing card markings (e.g., rank, suit, pips). Such optical machine-readable symbol readers may take the form of a scanner or an imager. The playing card input reading sensor 313 may take the form of a magnetic strip reader or inductive sensor to read magnetic stripe or other indicia carried on or in the playing cards. The playing card input reading sensor 313 may take the form of an radio frequency reader, for example an radio frequency identification (RFID) interrogator where the playing cards carry RFID tags or circuits. The playing card input reading sensor 313 may, for example, read playing cards one at a time as the playing cards pass the playing card reading sensor 313 at a position along the playing card input transport path 309.

Accordingly, the physical card is uniquely identifiable. For example, if a bar code reader system is employed to read barcode information on a sensed card, the card characteristic determination logic 1648 can determine the unique character of the card. Thus, if a traditional 52-card deck is being used for a card game, the sensed physical card can then be uniquely identified by its rank and suit symbols (for example, the A ♠ card is uniquely identifiable by the letter "A" and the symbol "♠" and have a machine-readable symbol residing thereon indicating this value). Alternatively, each playing card may carry an identifier that is unique over more than fifty-two cards.

The playing card input reading sensor 313 may be positioned between the input card receiver 304 and the intermediary playing card receivers 310, 312. This allows the playing card handling system 120*a* to sort playing cards into appropriate ones of the first and the second intermediary playing card receivers 310, 312, or within selected ones of compartments or receptacles of the first and the second intermediary playing card receivers 310, 312.

The playing card input receiver 304 is sized and positioned to receive playing cards collected at the end of a hand or game (i.e., collected playing cards 315), which are to be randomized or otherwise handled. The collected playing cards 315 may be collected from the gaming table 102 during play or after a card game or round has been played. The playing card input receiver 304 may be carried or formed by a plate 316, which may be in turn be carried by, coupled to, or otherwise connected to the gaming table 102. The playing card input receiver 304 may include a card input ramp 314 on to which the collected playing cards 315 may be fed by a dealer or other person, as individual cards or as a group of cards. An input passage 317 extends through the plate 316 and the playing surface of the gaming table 102 (FIG. 1) to allow passage of the collected playing cards 315 from the playing card input receiver 304 to the at least one playing card input transport path 509 of the playing card handling system 120*a*.

The first and second intermediary playing card receivers 310, 312 may take the form of carousels, each pivotally mounted about respective vertical axes 311*a*, 311*b* (FIG. 3B), which are vertical with respect to gravity or a base. Carousels may advantageously employ bi-directional rotational motion, in contrast to racks or trays, which typically require translation. The vertical axes 311*a*, 311*b* may advantageously be coaxial, thereby minimizing the area or "footprint" of the playing card handling system 120*a*. The first and second intermediary playing card receivers 310, 312 include a plurality of card receiving compartments, each of the compartments sized to hold a respective playing card. For example, there may be sufficient compartments to hold two or more decks of playing cards. Also for example, the first intermediary playing card receiver 310 may include a plurality of playing card receiving compartments 310*a*, 310*b*, 310*c* (e.g., 180, only three called out in FIG. 3A), each sized to hold a respective playing card. Also for example, the second intermediary playing card receiver 312 may include a plurality of playing card receiving compartments 312*a*, 312*b*, 312*c* (e.g., 180, only three called out in FIG. 3A) each sized to hold a respective playing card. The number of card receiving compartments, as well as the number of inventory playing cards (i.e., playing cards in the playing card handling system 120*a*) can be greater or lesser than the illustrated embodiment. In addition, the number of intermediary playing card receptacles 310, 312 may be greater or lesser than the two shown in the illustrated embodiment.

The term "carousel" as used herein is intended to be a generic term for a structure that comprises an endless plurality of physical playing card receptacles, referred to as card receiving compartments for convenience, particularly suited for rotational movement. Some embodiments may employ other card storage devices, for example a rack having a generally rectangular structure of card receiving compartments, mounted for translation. The rack may, for example, be vertically-oriented. An wedge or portion of an annulus shaped structure of card receiving compartments, mounted for pivoting. It is appreciated that the various types of structures and/or orientations employing card receiving compartments are too numerous to describe in detail herein. Furthermore, such structures may be moved in any suitable direction, orientation and/or manner. Any such structure and/or orientation comprising a plurality of card receiving compartments configured to be a repository for inventory cards are intended to be included within the scope of this disclosure.

In one embodiment, playing cards may be loaded from the playing card input receiver 304 to one of the intermediary playing card receivers 310, 312 while concurrently unloading playing cards to the playing card output receiver 306 from the other of the intermediary playing card receivers 310, 312. This advantageously reduces any delay in providing playing cards to the gaming table 102. The first and second intermediary playing card receivers 310, 312 may be removable, allowing fresh playing cards to be loaded into the playing card handling system 120*a*. Loading of fresh playing cards may occur while the playing card handling system 102*a* is building a set of playing cards in the output receiver from the previously loaded intermediary playing card receiver 310, 312.

The playing card output receiver 306 is sized to receive a plurality of randomized playing cards 318 (e.g., 2-8 decks or 110-416 playing cards). As best illustrated in FIG. 3C, the playing card output receiver 306 may take the form of a cartridge or rectangular box with a number of floors 340*a*-340*g* forming a plurality of playing card receiving compartments 342-342*g*, and which are open, for example, on one or more sides to allow placement and removal of sets or packets of randomized playing cards 318*a*, 318*b* (only two illustrated). While illustrated with seven playing card receiving compartments 342*a*-342*g*, the playing card output receiver 306 may have fewer or greater playing card receiving compartments, which may equal the maximum number of expected participants for a given card table. As described in further detail below, each of the playing card receiving compartments 342*a*-342*g* stores a portion of at least one hand of playing cards for a respective hand to be dealt. Each set or packet of playing cards 318*a*, 318*b* may comprise a complete hand, may comprise a portion of a hand to which additional playing cards will be dealt, or may comprise a portion of a hand to which will be completed by a number of playing cards common to two or more hands.

The playing card output receiver 306 may pass through an output passage 319 that extends through the plate 316 and the playing surface of the gaming table 102 (FIG. 1), to allow the card elevator mechanism 308 to deliver the randomized playing cards 318 to the gaming table 102.

In one embodiment, the playing card handling system 120*a* is located completely below the playing surface of the gaming table 102. In another embodiment, a vertical sidewall formed around the playing card input receiver 304 and the output passage 319 has a height "h." The height "h" corresponds to a thickness of the gaming table top such that the top portions of the playing card input receiver 304 and the output passage 319 may be flush with or extend just a little bit above (e.g., low profile) the playing surface of the gaming table 102 (FIG. 1). The playing surface of the gaming table 102 typically comprises a felt cover on top of a foam pad, both of which are positioned on top of a sheet of composite, wood, or other type of material. One type of suitable surface 104 is described in detail in U.S. patent application Ser. No. 10/981,132. Some embodiments may omit the plate 316, and form the passages 317, 319 only through the playing surface of the gaming table 102. Still other embodiments may not locate the playing card handling system 120*a* under the playing surface of the playing table 102, thus such embodiments may omit the passages 317, 319 through the gaming table 102. To conserve space, in one embodiment the playing card input receiver 304 and the output passage 319 are positioned adjacent to one another.

Depending upon the embodiments and/or the type of card game, the randomized playing cards 318 may be delivered individually or as a group of cards. Embodiments of the playing card handling system 120*a* may be user configurable to provide sets or packets of randomized playing cards 318 having any specified number of playing cards, and/or any specified suit of cards, and/or any specified rank(s) of cards, and/or other cards such as bonus cards or the like.

A cover 321 may be manually moved from a closed position 323 to an opened position 325 (FIG. 3B, broken line), where in the closed position 323 the cover 321 is disposed over the output passage 319 so as to limit or preclude access or a view into the output passage 319, and where in the opened position 325 the cover 321 is spaced from the output passage 319 so as to not limit nor preclude access or a view into the output passage 319. The cover 321 may be pivotally or slideably coupled to the frame 302, plate 316 or other portion of the playing card handling system 120*a* for movement between the closed and the opened positions. In particular, the cover 321 may be pivotally coupled to the frame or other portion of the playing card handling system 120*a* for movement between the closed and the opened positions, 323, 325, respectively. Alternatively, the cover 321 may be slideably or pivotally coupled directly to the gaming table 102.

In one embodiment, the playing card output receiver 306 is moveable between a lowered position 322 and a raised position (not shown). In the raised position, at least a portion of the playing card output receiver 306 is positioned to permit the randomized playing cards 318 to be withdrawn from the playing card output receiver 306 by a dealer 114 (FIG. 1) or another person at the gaming table 102. For example, the raised position may, for example, be spaced sufficiently above the plate 316 to expose all or some of the randomized playing cards 318 above the surface 104 of the gaming table 102 (FIG. 1). In the lowered position 322, the playing card output receiver 306 is positioned such that the randomized playing cards 318 cannot be withdrawn from the playing card output receiver 306. For example, a top of the playing card output receiver 306 may be spaced flush with, or below the playing surface of the gaming table 102 and/or below a top of the plate 316.

The card elevator mechanism 308 moves the playing card output receiver 306 between the lowered position 352 and the raised position. The card elevator mechanism 308 may, for example, comprise a linkage 329 and an elevator motor 331 coupled to drive the linkage 329. FIGS. 3A and 3B employ a partially exploded view, showing the playing card output receiver 306 spaced from linkage 329 of the card elevator mechanism 308 to better illustrate the components. In use, the playing card output receiver 306 will be physically connected or coupled to the linkage 329. In one embodiment, the elevator motor 331 is a DC stepper motor. Alternatively, the elevator motor 331 may take the form of a servo-motor. The card elevator mechanism 308 may employ any suitable linkage, including but not limited to a belt, sprocket chain, gear, scissors linkage or the like (not shown for clarity). Activation of the elevator motor 331 moves the linkage 329 and the playing card output receiver 306 relative to the structural frame 302.

After the playing card output receiver 306 delivers the randomized playing cards 318 to the gaming table 102, the card elevator mechanism 308 returns the playing card output receiver 306 to the lowered position 322. The lowered position 322 may be aligned with an elevator branch.

In some embodiments, one or more external switches or sensors (not called out) are positioned to be accessible from an exterior of the playing card handling system 120*a*. The external switches may, for example, be carried by the plate 316, the playing surface of the gaming table 102, or a housing (not shown) of the playing card handling system 102*a*. The external switches or sensors may be selectively activated to cause the card elevator mechanism 308 to move the playing card output receptacle 306 to the lowered position 322. Additionally, or alternatively, the external switches or sensors may be selectively activated to cause the card elevator mechanism 308 to move the playing card output receptacle 306 to the raised position. In some embodiments, a cover switch (not called out) is responsive to movement and/or a position of the cover 321 to cause the card elevator mechanism 308 to automatically move the playing card output receiver 306 upward from the lowered position 322 to the raised position. Additionally or alternatively, the cover switch is responsive to movement and/or a position of the cover to cause the card elevator mechanism 308 to automatically move the playing card output receiver 306 downward from the raised position to the lowered position 322. The cover switch may be employed in addition to, or in place of, the external switches 231. The cover switch may take the form of a contact switch or sensor such as a proximity sensor, light sensor, infrared sensor, pressure sensor, or magnetic sensor such as a Reed switch.

One or more lowered position sensors (not shown) may detect when the playing card output receiver 306 is at the lowered position 322. The lowered position sensors may take a variety of forms including, but not limited to a proximity sensor, optical eye type sensor, and/or positional or rotational encoder. The lowered position sensors 235 may sense the position of the playing card output receiver 306, or the linkage 329 or shaft of elevator motor 331.

Some embodiments may employ an interlock or lockout feature. The lockout feature prevents the card elevator mechanism 308 from moving the playing card output receptacle 306 to the raised position until the playing card output receptacle 306 is loaded with a sufficient number of randomized playing cards 318. For example, the lockout feature may keep the playing card output receptacle 306 in the lowered position 322 until at least one hundred and twelve cards (e.g., two standard decks) have been loaded in the playing card output receptacle 306.

The playing card handling system 120*a* may include a control subsystem 350 (FIG. 3A). The control subsystem 350 may include one or more controllers, processors, ASIC and/or memories. For example, the control subsystem 350 may include a microprocessor 352, ROM 354 and RAM 356 coupled via one or more buses 357. The microprocessor 352 may employ signals 353 received from one or more sensors or actuations of the playing card handling system 120*a*.

The control subsystem 350 may also include one or more motor controllers 360 to send control signals 361 to control operation of the various motors and/or actuators of the playing card handling system 120*a*.

The control subsystem 350 may also include one or more user interfaces 362 to provide information to, and/or receive information from a user, for example the dealer 114 (FIG. 1). Any known or later developed user interface may be suitable, for example a touch screen display, keyboard, and/or keypad, voice activated, etc.

The control subsystem 350 may include one or more network controllers 364 and/or communications ports 366 for providing communications via communications channels, for example LANs 208 (FIG. 2) and/or WANs 210.

The control subsystem 350 may also include one or more random number generators 358. While illustrated as a dedicated device, in some embodiments the random number generator functionality may be implemented by the microprocessor 352. As discussed in detail below, the random number generator 358 produces a random numbers or virtual playing card values based at least in part on the selected payout or house odds and/or house advantage.

Figure 4A:
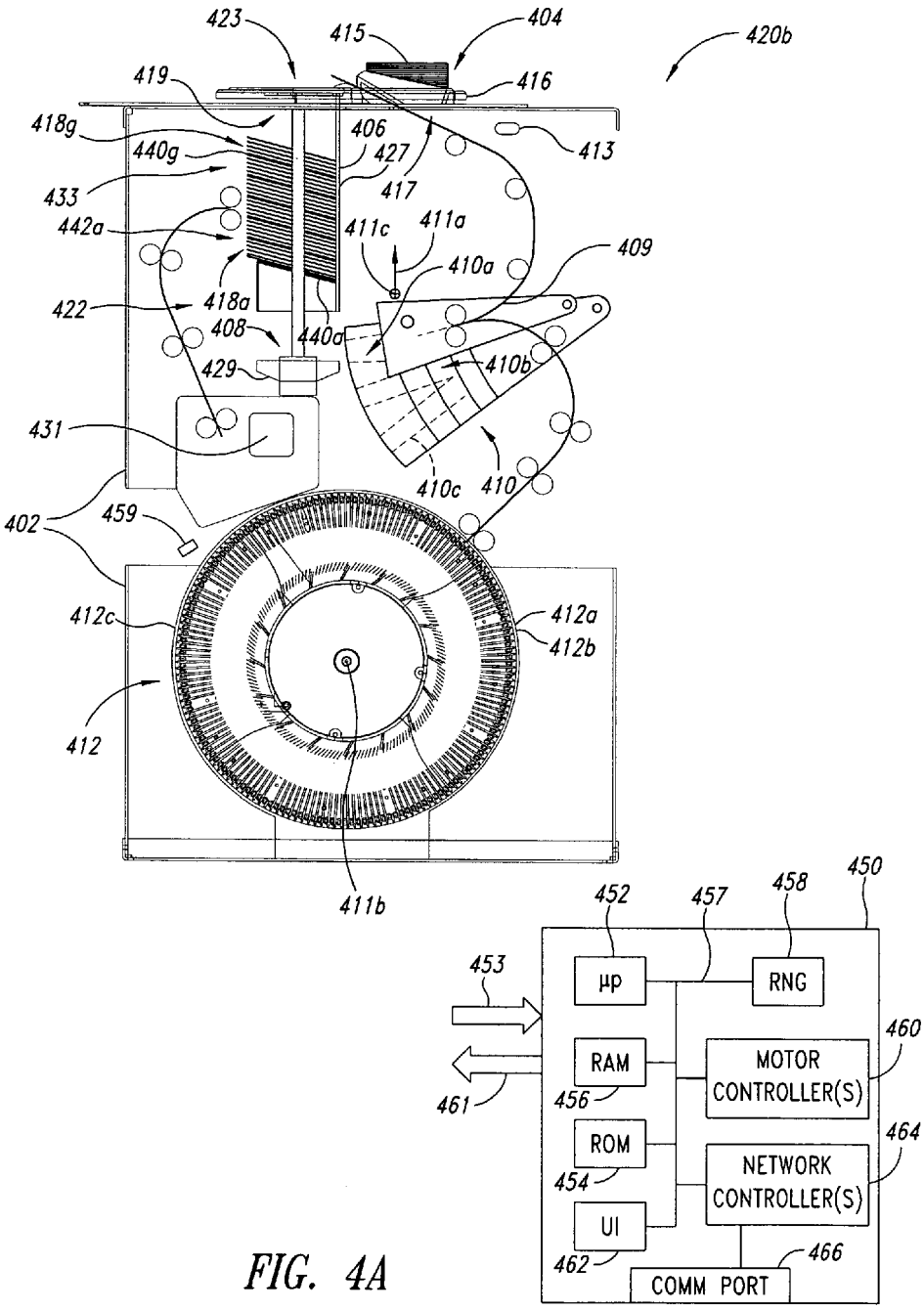
FIG. 4A is a side elevational view of a playing card handling system according to another illustrated embodiment.
Figure 4B:
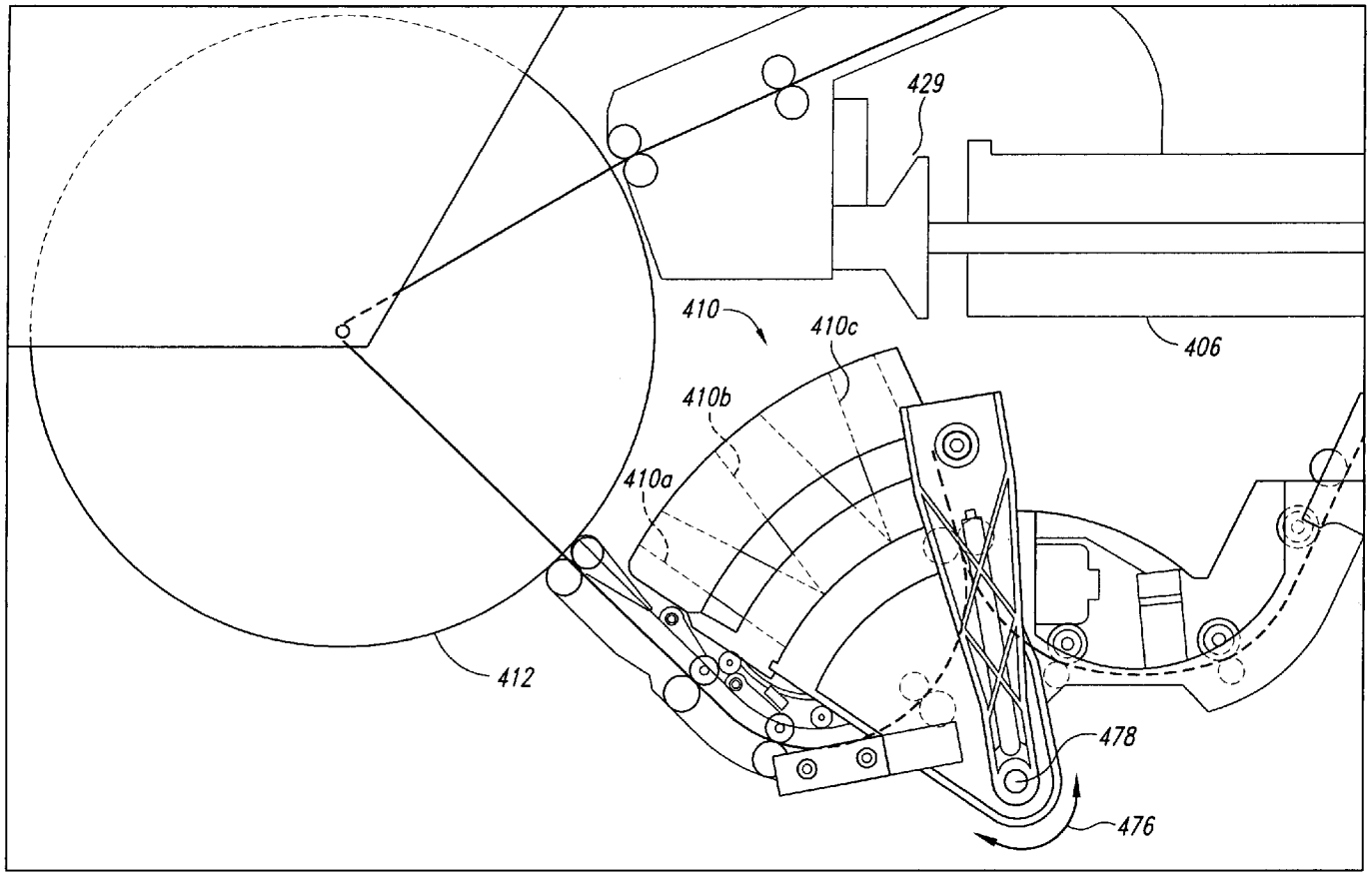
FIG. 4B is an isometric view of an intermediary playing card receiver according to an alternative illustrated embodiment, including a diagonal array of playing card receiving compartments.

FIGS. 4A and 4B show a playing card handling system 120*b* for handling playing cards according to another illustrated embodiment. As explained in detail below, the playing card handling system 120*b* is operable to provide one or more sets of randomized playing cards for use in a card game, which may, or may not be based on selected payout or house odds and/or house advantage.

The playing card handling system 120*b* can be coupled to or installed with or near the gaming table 102 (FIG. 1). In one embodiment, the playing card handling system 102*b* is installed away from the gaming table 102, for example, in a restricted area of a casino where decks of playing cards are received and shuffled.

The playing card handling system 120*b* includes a structural frame 402, a playing card input receiver 404, a playing card output receiver 406, a card elevator mechanism 408, a first intermediary playing card receiver 410, and a second intermediary playing card receiver 412. The playing card handling system 120*b* may be partially or fully enclosed by a housing (not shown) and/or by the gaming table 102 (FIG. 1). At least one playing card input transport path 409 extends between the playing card input receiver 404 and at least one of the intermediary playing card receiver 410, 412.

At least one playing card input reading sensor 413 is positioned between the playing card input receiver 404 and the playing card output receiver 406. The playing card input reading sensor 413 is operable to read identifying information form the playing cards between the playing card input receiver 404 and at least one of the intermediary playing card receivers 410, 412. The information allows the playing cards to be identified, for example by rank and/or suit, or other values such as a point value of the playing card. The playing card input reading sensor 413 may, for example, take the form an optical machine-readable symbol reader, operable to read machine-readable symbols (e.g., barcode, matrix or area codes, or stacked codes) from the playing cards. The playing card input reading sensor 413 may be operable to read standard playing card markings (e.g., rank, suit, pips). Such optical machine-readable symbol readers may take the form of a scanner or an imager. The playing card input reading sensor 413 may take the form of a magnetic strip reader or inductive sensor to read magnetic stripe or other indicia carried on or in the playing cards. The playing card input reading sensor 413 may take the form of an radio frequency reader, for example an radio frequency identification (RFID) interrogator where the playing cards carry RFID tags or circuits. The playing card input reading sensor 413 may, for example, read playing cards one at a time at one or more positions along the playing card input transport path 409.

The playing card input reading sensor 413 may be positioned between the input card receiver 404 and the intermediary playing card receivers 410, 412. This allows the playing card handling system to sort playing cards into appropriate ones of the first and/or the second intermediary playing card receivers 410, 412, or card receiving compartments or receptacles therein.

The playing card input receiver 404 is sized and positioned to receive playing cards collected at the end of a hand or game (i.e., collected playing cards 415), which are to be randomized or otherwise handled. The collected playing cards 415 may be collected from the gaming table 102 during play or after a card game or round has been played. The playing card input receiver 404 may be carried or formed by a plate 416, which may be in turn be carried by, coupled to, or otherwise connected to the gaming table 102. The playing card input receiver 404 may include a card input ramp (not shown) on to which the collected playing cards 415 may be fed by a dealer or other person, as individual cards or as a group of cards. An input passage 417 extends through the plate 416 and the playing surface of the gaming table 102 (FIG. 1) to allow passage of the collected playing cards 415 from the playing card input receiver 404 to the playing card input transport path of the playing card handling system 120*b*.

The first intermediary playing card receiver 410 may take the form of one or more (e.g., three) distinct playing card receiving compartments 410*a*, 410*b*, 410*c*, each sized to receive a plurality of playing cards therein. The first intermediary playing card receiver 410 may be moveable with respect to a playing card input path 409 that extends from the playing card input receiver 404. As illustrated, the first intermediary playing card receiver 410 may be translatable along a vertical axis 411*a* with respect to the playing card input transport path 409. Alternatively, the first intermediary playing card receiver 410 may be rotatable or pivotally moveable about a horizontal axis 411*c* (cross illustrating axis going into page of drawing sheet) with respect to the playing card input transport path 409. In such an embodiment, the first intermediary playing card receiver 410 may have an approximately annular profile.

The second intermediary playing card receiver 412 may take the form of a carousel, pivotally mounted about a horizontal axis 411*b*. Carousels may advantageously employ bidirectional rotational motion, in contrast to racks or trays, which typically require translation. The second intermediary playing card receiver 412 may include a plurality of card receiving compartments, each of the card receiving compartments sized to hold a respective playing card. For example, there may be sufficient compartments to hold two or more decks of playing cards. For example, the first intermediary playing card receiver 610 may include three playing card receiving compartments each sized to hold a plurality of playing cards (e.g., 110 playing cards each). Also for example, the second intermediary playing card receiver 412 may include a plurality of playing card receiving compartments 412*a*, 412*b*, 412*c* (e.g., 180, only three called out in FIG. 6A) each sized to hold a respective playing card.

The number of card receiving compartments, as well as the number of inventory playing cards (i.e., playing cards in the playing card handling system 120*a*) can be greater or lesser than the illustrated embodiment. In addition, the number of intermediary playing card receivers 410, 412 may be greater or lesser than that shown in the illustrated embodiment.

In one embodiment, playing cards are loaded from the playing card input receiver 404 to one of the intermediary playing card receivers 410, 412 based on when the particular playing card will be required to build a set of playing cards based on a random sequence of virtual playing card values. Thus, for example, a set of virtual playing card values may be generated or otherwise formed. The set may be divided into two or more subsets. For example, where the first intermediary playing card receiver has three distinct card receiving compartments 410*a*-410*c*, the set may be divided into four subsets, one for each of the playing card compartments 410*a*-410*c* of the first intermediary playing card receiver 410, and one for the second intermediary playing card receiver 412. The resulting subsets do not necessarily have to be of equal size. Playing cards that will required the earliest (e.g., those in the first quarter of the set of virtual playing card values) will be transported directly to the second intermediary playing card receiver 412. Playing card required next (e.g., those in the second quarter of the set of virtual playing card values) may be loaded into a first one of the compartments 410*a* of the first playing card receiver 410. Playing card required next (e.g., those in the third quarter of the set of virtual playing card values) may be loaded into a second one of the compartments 410*b* of the first playing card receiver 410, while playing cards required last (e.g., those in the fourth quarter of the set of virtual playing card values) may be loaded into a third one of the compartments 610*c* of the first playing card receiver 410.

After, or while the second intermediary playing card receiver 412 is being emptied, playing cards from the first card receiving compartment 410*a*, then from the second card receiving compartment 410*b* and finally from the third card receiving compartment 410*c* may be loaded into compartments of the second playing card receiver 412. During this process, the playing card handling system 120*b* knows or tracks the position or location of each playing card, having initially identified the playing cards with the playing card reading sensor 413, and tracking the various destinations of the playing cards. In some embodiments, playing cards are loaded concurrently with unloading of the playing cards. For example, one of the card receiving compartments may receive a playing card with a playing card value representing the ACE of spades (A♠). ) The playing card receiving compartments do not have to be permanently assigned to a respective playing card value, but rather can be assigned "on the fly" as playing cards are placed into the intermediary playing card receiver. The relationships may be stored in a memory, for example as a card receiving compartment attribute table.

This multiple intermediary card receiver approach allows the playing card handling system 120*b* to handle a very large number of playing cards without incurring unacceptable delays in providing randomized playing card to the gaming table 102. The first and/or the second intermediary playing card receivers 410, 412 may be removable allowing fresh playing cards to be loaded into the playing card handling system 120*b*. Loading of fresh playing cards may occur while the playing card handling system 120*b* is building a set of playing cards in the output receiver from the previously loaded intermediary playing card receiver 410, 412.

A playing card inventory sensor 439 may be positioned to read identifying information form the playing cards in the intermediary playing card receivers 410, 412. Such may allow an inventory of the intermediary playing card receivers 410, 412 to be performed, for example on a periodic basis or in response to an anomaly or possibly anomalous event, for example a loss of power. Such may additionally, or alternatively, allow the identity of each playing card to be confirmed before the playing card is removed from the respective playing card receiving compartment of the intermediary playing card receivers 410, 412. Preventing the removal of incorrect playing may eliminate the need for additional structure to reinsert the incorrect playing card, and may allow detection of improper operation.

The playing card output receiver 406 is sized to receive a plurality of randomized playing cards 418 (e.g., 2-8 decks or 110-416 playing cards). As illustrated, the playing card output receiver 406 may take the form of a cartridge or rectangular box with a number of floors 440*a*-440*g* (only two called out in FIG. 4A) forming a plurality of playing card receiving compartments 442-442*g* (only two called out in FIG. 4A), and open, for example, on one or more sides to allow placement and removal of sets or packets of randomized playing cards 418*a*-418*g* (only two called out in FIG. 4A). While illustrated with seven playing card receiving compartments 442*a*-442*g*, the playing card output receiver 406 may have fewer or greater playing card receiving compartments, which may equal the maximum number of expected participants for a given card table. As described in further detail below, each of the playing card receiving compartments 442*a*-442*g* stores a portion of at least one hand of playing cards for a respective hand to be dealt. Each set or packet of playing cards 418*a*, 418*b* may comprise a complete hand, may comprise a portion of a hand to which additional playing cards will be dealt, or may comprise a portion of a hand to which will be completed by a number of playing cards common to two or more hands.

The playing card output receiver 406 may pass through an output passage 419 that extends through the plate 416 and the playing surface of the gaming table 102 (FIG. 1), to allow the card elevator mechanism 408 to deliver the randomized playing cards 418 to the gaming table 102.

In one embodiment, the playing card handling system 120*b* is located completely below the playing surface of the gaming table 102. In another embodiment, the top portions of the playing card input receiver 404 and the output passage 419 may be flush with or extend just a little bit above the playing surface of the gaming table 102 (FIG. 1). Still other embodiments may not locate the card handling system 120*b* under the playing surface of the playing table 102, thus such embodiments may omit the passages 417, 419 through the gaming table 102. To conserve space, in one embodiment the playing card input receiver 404 and the output passage 419 are positioned adjacent to one another.

Depending upon the embodiments and/or the type of card game, the randomized playing cards 418 may be delivered individually or as a group of cards. Embodiments of the playing card handling system 120*b* may be user configurable to provide sets or packets of randomized playing cards 418 having any specified number of playing cards, and/or any specified suit of cards, and/or any specified rank(s) of cards, and/or other cards such as bonus cards or the like.

As discussed in reference to the embodiment of FIGS. 4A and 4B, the playing card handling system 120*b* may include a cover 421 that is manually moved from a closed position 423 to an opened position (not shown in FIG. 4A), where in the closed position 423 the cover 421 is disposed over the output passage 419 so as to limit or preclude access or a view into the output passage 419, and where in the opened position the cover 421 is spaced from the output passage 419 so as to not limit nor preclude access or a view into the output passage 419. The cover 421 may be pivotally or slideably coupled to the frame 402, plate 416 or other portion of the playing card handling system 120*b*. Alternatively, the cover 421 may be slideably or pivotally coupled directly to the gaming table 102.

As discussed in reference to the embodiment of FIGS. 4A and 4B, the playing card handling system 120*b*, the playing card output receiver 406 is moveable between a lowered position 422 and a raised position (not shown). In the raised position, at least a portion of the playing card output receiver 406 is positioned to permit the randomized playing cards 418 to be withdrawn from the playing card output receiver 406 by a dealer 114 (FIG. 1) or another person at the gaming table 102. In the lowered position 422, the playing card output receiver 406 is positioned such that the randomized playing cards 418 cannot be withdrawn from the playing card output receiver 406.

The card elevator mechanism 408 moves the playing card output receiver 406 between the raised and the lowered positions. The card elevator mechanism 408 may, for example, comprise a linkage 429 and an elevator motor 431 coupled to drive the linkage 429. FIG. 4A employs a partially exploded view, showing the playing card output receiver 406 spaced from linkage 429 to better illustrate the components. In use, the playing card output receiver 406 will be physically connected or coupled to the linkage 429. The elevator motor 431 may take the form of a DC stepper motor or alternatively a servo-motor.

After the playing card output receiver 406 delivers the randomized playing cards 418 to the gaming table 102, the card elevator mechanism 408 returns the playing card output receiver 406 to the lowered position 422. The lowered position 422 may be aligned with an elevator branch.

As discussed in reference to the embodiment of FIGS. 3A-3C, in some embodiments of the playing card handling system 120*b*, one or more external switches (not called out) are positioned to be accessible from an exterior of the playing card handling system 120*b*. The external switches may, for example, be carried by the plate 416, the playing surface of the gaming table 102, or a housing (not shown) of the playing card handling system 102*a*. The external switches may be selectively activated to cause the card elevator mechanism 408 to move the playing card output receiver 406 to the lowered position 422. Additionally, or alternatively, the external switches may be selectively activated to cause the card elevator mechanism 408 to move the playing card output receiver 406 to the raised position. In some embodiments, a cover switch (not called out) is responsive to movement and/or a position of the cover 421 to cause the card elevator mechanism 408 to automatically move the playing card output receiver 406 upward from the lowered position 422 to the raised position. Additionally or alternatively, the cover switch is responsive to movement and/or a position of the cover 421 to cause the card elevator mechanism 408 to automatically move the playing card output receiver 406 downward from the raised position to the lowered position 422. The cover switch may be employed in addition to, or in place of, the external switches 231. The cover switch may take the form of a contact switch or sensor such as a proximity sensor, light sensor, infrared sensor, pressure sensor, or magnetic sensor such as a Reed switch.

One or more lowered position sensors (not shown) may detect when the playing card output receiver 406 is at the lowered position 422. The lowered position sensors may take a variety of forms including, but not limited to a proximity sensor, optical eye type sensor, and/or positional or rotational encoder. The lowered position sensors may sense the position of the playing card output receiver 406, or the linkage 429 or shaft of elevator motor 431.

Some embodiments may employ an interlock or lockout feature. The lockout feature prevents the card elevator mechanism 408 from moving the playing card output receiver 406 to the raised position until the playing card output receiver 406 is loaded with a sufficient number of randomized playing cards 418. For example, the lockout feature may keep the playing card output receiver 406 in the lowered position 422 until at least one hundred and twelve cards (e.g., two standard decks) have been loaded in the playing card output receiver 406.

The playing card handling system 120*b* may include a control subsystem 450. The control subsystem 450 may include one or more controllers, processors, ASIC and/or memories. For example, the control subsystem 450 may include a microprocessor 452, ROM 454 and RAM 456 coupled via one or more buses 457. The microprocessor 452 may employ signals 453 received from one or more sensors or actuations of the playing card handling system 120*b*.

The control subsystem 450 may also include one or more motor controllers 460 to send control signals 461 to control operation of the various motors and/or actuators of the playing card handling system 120*b*.

The control subsystem 450 may also include one or more user interfaces 462 to provide information to, and/or receive information from a user, for example the dealer 114 (FIG. 1). Any known or later developed user interface may be suitable, for example a touch screen display, keyboard, and/or keypad.

The control subsystem 450 may include one or more network controllers 464 and/or communications ports 466 for providing communications via communications channels, for example LANs 208 (FIG. 2) and/or WANs 210.

The control subsystem 450 may also include one or more random number generators 458. While illustrated as a dedicated device, in some embodiments the random number generator functionality may be implemented by the microprocessor 452. As discussed in detail below, the random number generator 458 produces a random numbers or virtual playing card values based at least in part on the selected payout odds or house advantage.

FIG. 4B shows the first playing card receiver 410 in further detail according to one illustrated embodiment.

The first playing card receiver 410 includes a plurality of playing card receiving compartments 410*a*-410*c*, which are physically coupled to move as a unit. The playing card receiving compartments may be mounted for bi-directional pivotal movement (double headed arrow 476) about a horizontal axis (circle enclosing X 478), which is approximately horizontal with respect to the gravitational effect of the planet. The first playing card receiver 410 has an annular profile. Each of the playing card receiving compartments 410*a*-410*c* is sized and dimensioned to hold a plurality of playing cards (not shown).

Figure 5:
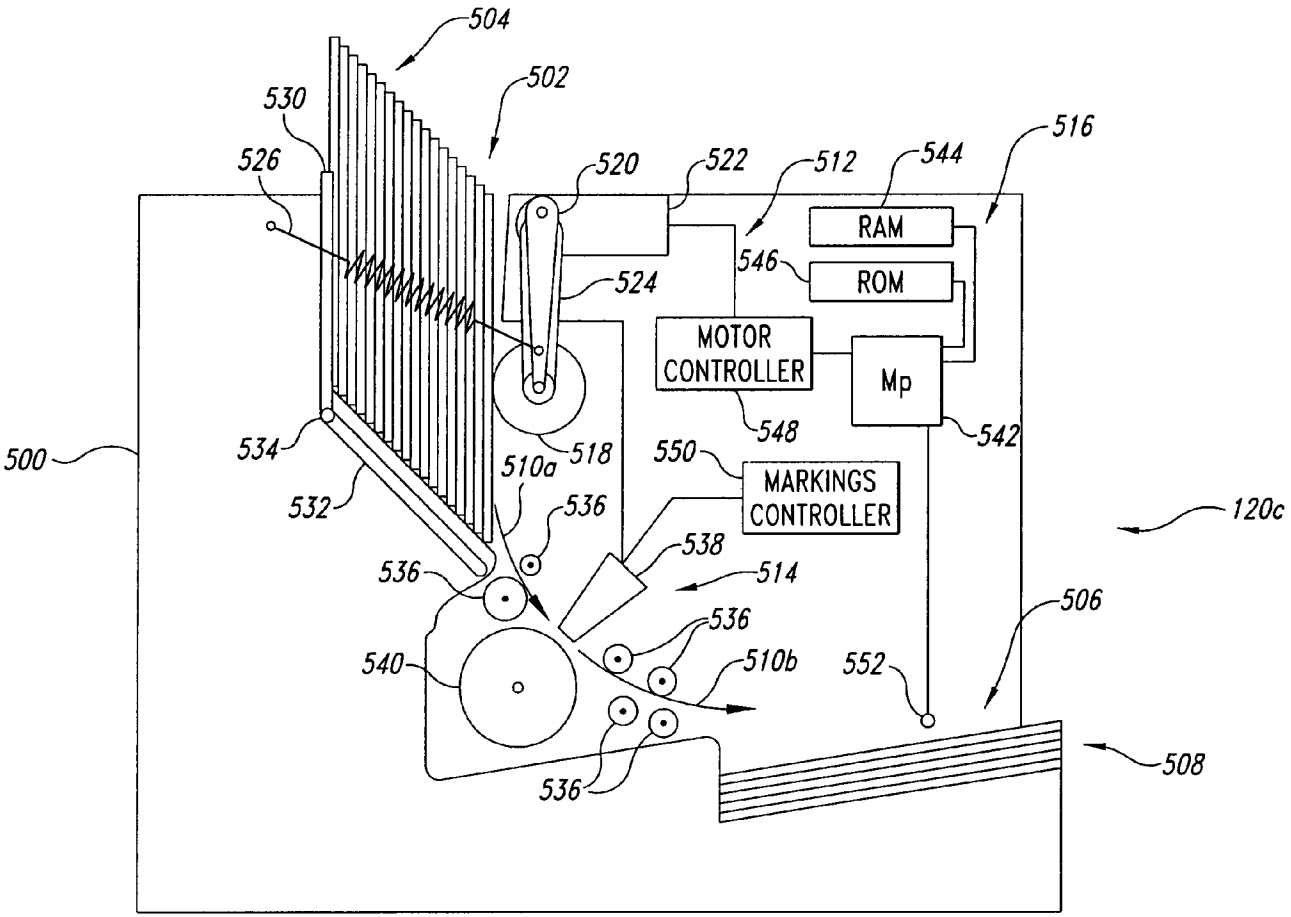
FIG. 5 is a block diagram of a playing card handling system employing a markings forming mechanism, according to a further illustrated embodiment.

FIG. 5 shows a playing card handling system 120*c*, according to another illustrated embodiment. As explained in detail below, the playing card handling system 120*c* is operable to provide one or more sets or packets of randomized playing cards 518 for use in a card game, which may, or may not be based on selected payout or house odds and/or house advantage.

The playing card handling system 120*c* includes a housing 500 having a playing card input receiver 502 for receiving playing card media 504, a playing card output receiver 506 for delivering randomized playing cards 508. A playing card input transport path identified by arrow 510*a* extends between the playing card input receiver 502 and a markings forming mechanism 514, while a playing card output transport path 510*b* extends from the markings forming mechanism 514 to the playing card output receiver 506. The playing card handling system 120*c* generally includes a drive mechanism 512, the markings forming mechanism 514 (e.g., print mechanism) and a control mechanism 516.

In some embodiments, the playing card media takes the form of playing card blanks without any markings. In other embodiments, the playing card media takes the form of playing card blanks with some playing card designs, but without playing card value markings (e.g., rank and/or suit symbols). Thus, the playing media may include identical ornamental designs on the backs of the playing card blanks, with the faces left blank for the playing card value markings. In still other embodiments, the playing card media may take the form of existing playing cards, from which the playing card value markings will be erased, prior to being reformed or otherwise generated. In some embodiments, the playing card media may take the form of a fiber based media, for example card stock, vellum, or polymer based media. In some embodiments, the playing card media takes the form of an active media, for example a form of electronic or "e-paper", smart paper, and/or ink code, which allows the formation and erasure of markings via electrical, magnetic, or electromagnetic radiation.

Smart paper is a product developed by Xerox Palo Alto Research Center, of Palo Alto, Calif. The smart paper consists of a flexible polymer containing millions of small balls and electronic circuitry. Each ball has a portion of a first color and a portion of a second color, each portion having an opposite charge from the other portion. Applying a charge causes the balls to rotate within the polymer structure, to display either the first or the second color. Charges can be selectively applied to form different ones or groups of the balls to from the respective markings on the playing cards 508. The markings remain visible until another charge is applied. Alternatively, the playing card handling system 120*c* can be adapted to employ color-changing inks such as thermochromatic inks (e.g., liquid crystal, leucodyes) which change color in response to temperature fluctuations, and photochromatic inks that respond to variations in UV light.

As illustrated in FIG. 5, the drive mechanism 512 includes a drive roller 518 rotatably mounted at the end of a pivot arm 520 and driven by a motor 522 via a drive belt 524. The motor 522 can take the form of a stepper motor, that drives the drive roller 518 in small increments or steps, such that the playing card media 504 is propelled incrementally or stepped through the card path 510 of the playing card handling system 120*c*, pausing slightly between each step. Stepper motors and their operation are well known in the art. A spring 526 biases the pivot arm 520 toward the playing card media 504 to maintain contact between the drive roller 518 and an outermost one of the playing card media 504 in the playing card input receiver 502. Thus, as the drive roller 518 rotates (e.g., counterclockwise with respect to the Figure), the outermost playing card media 504 is propelled along the card path 510. Additionally, or alternatively, a card support 530 positioned behind the playing card media 504 is supported along an inclined plane such as a guide channel 532 by one or more rollers 534. The weight of the card support 530 and or an additional attached weight (not shown) biases the card support 530 and the playing card media 504 toward the card path 510. The drive mechanism 512 also includes a number of guide rollers 536 to guide the playing card media 504 along the card path 510. Typically the guide rollers 536 are not driven, although in some embodiments one or more of the guide rollers 536 can be driven where suitable. For example, one or more guide rollers 536 may be driven where the card path 510 is longer than the length of the playing card media 504. While a particular drive mechanism 512 is illustrated, many other suitable drive mechanisms will be apparent to those skilled in the art of printing. Reference can be made to the numerous examples of drive mechanisms for both various types of printers, for example impact and non-impact printers.

The markings forming mechanism 514 may include a marking forming head 538 and a platen 540. In one embodiment, the markings forming mechanism 514 takes the form of a printing mechanism, and the marking forming head 538 take the form of a print head. The print head can take any of a variety of forms, such as a thermal print head, ink jet print head, electrostatic print head, or impact print head. The platen 540, by itself or with one or more of the guide rollers 536 (i.e., "bail rollers"), provides a flat printing surface positioned under the markings forming head 538 for the playing card media 504. While illustrated as a platen roller 540, the playing card handling system 120*c* can alternatively employ a stationary platen diametrically opposed from the markings forming head 538, where suitable for the particular playing card media 504. In an alternative embodiment, the platen roller 540 may be driven by the motor 522, or by a separate motor. In other embodiments, marking forming head 538 may take the form of a magnetic write head, similar to those employed to encode information into magnetic stripes. In other embodiments, marking forming head 538 may take the form of an inductive write head, an radio frequency transmitter, or transmitter of other frequencies of electro-magnetic radiation, including but not limited to optical magnetic radiation (e.g., visible light, ultraviolet light, and/or infrared light).

The control mechanism 516 includes a microprocessor 542, volatile memory such as a Random Access Memory ("RAM") 544, and a persistent memory such as a Read Only Memory ("ROM") 546. The microprocessor 542 executes instructions stored in RAM 544, ROM 546 and/or the microprocessor's 542 own onboard registers (not shown) for generating a random playing card sequence, and printing the appropriate markings on the playing cards in the order of the random playing card sequence. The control mechanism 516 also includes a motor controller 548 for controlling the motor 512 in response to motor control signals from the microprocessor 542, and a markings controller 550 for controlling the marking forming head 538 in response to marking forming control signals from the microprocessor 542.

The control mechanism 516 may further include a card level detector 552 for detecting a level or number of playing cards in the playing card output receiver 506. The card level detector 552 can include a light source and receiver pair and a reflector spaced across the playing card holder from the light source and receiver pair. Thus, when the level of playing cards 508 in the playing card output receiver 506 drops below the path of the light, the card level detector 552 detects light reflected by the reflector, and provides a signal to the microprocessor 542 indicating that additional playing cards 508 should be formed (e.g., printed or otherwise encoded). The playing card handling system 120*c* can employ other level detectors, such as mechanical detectors.

In operation the microprocessor 542 executes instructions stored in the RAM 544, ROM 546 and/or microprocessor's registers to computationally randomly generate virtual playing card values from a domain of playing card values, based at least in part on the selected payout or house odds and/or house advantage.

The microprocessor 542 generates markings forming data based on the computationally generated virtual playing card values. The markings forming data consists of instructions for forming playing card value markings, and optionally non-value markings, on respective ones of the playing card media 504 that correspond to respective virtual playing card values from the random playing card sequence. For example, the markings forming data can identify which elements of the markings forming head 538 to activate at each step of the motor 522 to form a desired image. During each pause between steps of the motor 522, a small portion of one of the playing card media 504 is aligned with the markings forming head 538 and selected elements of the markings forming head 538 are activated to produce a portion of an image on the portion of the playing card media 504 aligned with the markings forming head 538. The image portion is a small portion of an entire image to be formed. The entire image typically is produced by stepping the card blank 504 past the markings forming head 538, pausing the playing card media 504 after each step, determining the portion of the image corresponding to the step number, determining which elements of the markings forming head 538 to activate to produce the determined portion of the image, and activating the determined elements to produce the determined portion of the image on the playing card media 504. The microprocessor 542 provides the markings forming data as motor commands to the motor controller 548 and as markings forming commands to the markings forming controller 550, for respectively synchronizing and controlling the motor 522 and markings forming head 538. The markings may take a non-visible form, and/or may take the form of magnetically detectable markings, for example magnetic orientations in a magnetic stripe.

Thus, the playing card handling system 120*c* of FIG. 5 provides a standalone card distribution device for providing sets or packets of playing cards in a pseudo-random fashion based at least in part on the selected payout or house odds and/or house advantage, which may be used at any gaming position. Since the playing card handling system 120*c* includes a microprocessor 542 which may implement the RNG function, the playing card handling system 120*c* is particularly suited for a manually monitored gaming table, where the playing card handling system 120*c* operates in a standalone mode. However, the playing card handling system 120*c* can operate as an integral portion of the automated table game system, or in conjunction with such a system.

In another embodiment, the playing card handling system 120*c* may include at least one playing card reading sensor positioned between the playing card input receiver and the playing card output receiver, identical or similar to that of the previously discussed embodiments. Additionally, or alternatively, the playing card handling system 120*c* may include an erase mechanism (not shown) positioned between the playing card input receiver and the print mechanism. The erase mechanism is operable to erase marking from previously used playing cards. Erasing may include removing previously printed markings physically, chemically and/or via electromagnetic radiation. Alternatively, erasing may include electrically, inductively, or magnetically removing previously encoded markings, for example where the playing card characters or symbols were formed using smart or electronic paper media, ink code or other active media.

FIG. 6 shows a playing card handling system 120*d*, according to another illustrated embodiment. The playing card handling system 120*d* is similar in some respects to the playing card handling system 120*a* (FIGS. 3A-3B).

The playing card handling system 120*d* includes a playing card input receiver 604 that receives collected playing cards 615, a first intermediary playing card receiver 610, a single playing card output receiving compartment or area 606 sized to receive a set or packet of randomized playing cards 618. At least one playing card input transport path 609*a* extends between the playing card input receiver 604 and the first intermediary playing card receiver 610. At least one playing card output path 609*b* extends between the first intermediary playing card receiver 610 and the single playing card output receiving compartment or area 606. The first intermediary playing card receiver 610 comprises a plurality of playing card receiving compartments 610*a*-610*c* (only three called out in FIG. 6) that each receive at most one playing card during use. The playing card handling system 120*d* may include a picker mechanism 673 or some other mechanism for removing, retrieving or ejecting the playing cards from the playing card receiving compartments 610*a*-610*c* of the first intermediary playing card receiver 610. The playing card handling system 120*d* may also include a playing card input sensor 613 and/or inventory sensor 639 to read identifying information from the playing cards, as described in detail above.

In operation, sets or packets of randomized playing cards 618 (e.g., one-three cards) may be formed one at a time in the single playing card output receiving compartment or area 606, each set or packet intended to form at least part of a respective hand of playing cards in a round of a card game. The playing card handling system 120*d* may include a sensor (not shown in FIG. 6) to determine when the set or packet or randomized playing cards 618 has been removed, to trigger the formation of the next set or packet. The single playing card output receiving compartment or area 606 may be fixed with respect to the playing card output transport path 609*b*, simplifying the mechanical structure.

FIG. 7 shows a playing card handling system 120*e*, according to another illustrated embodiment. The playing card handling system 120*e* is similar in some respects to the playing card handling system 120*a* (FIGS. 3A-3B).

The playing card handling system 120*e* includes a playing card input receiver 704 that receives collected playing cards 715, a first intermediary playing card receiver 710, and a playing card output receiver 706. At least one playing card input transport path 709*a* extends between the playing card input receiver 704 and the at least first intermediary playing card receiver 710. A plurality of playing card output paths 709*b*-709*h* extend between the at least first intermediary playing card receiver 710 and respective ones of the playing card output receiving compartments 706*a*-706*g*, along with diverters (represented by triangles) operable to divert playing cards along the respective paths.

The first intermediary playing card receiver 710 comprises a plurality of playing card receiving compartments 710*a*-710*c* (only three called out in FIG. 7) that each receive at most one playing card during use. The playing card output receiver 706 has a plurality of playing card receiving compartments 706*a*-706*g*, each sized to receive a respective set or packet of randomized playing cards 718 (only one set or packet called out in FIG. 7). For example, there may be one playing card receiving compartment 706*a*-706*g* for each hand of playing cards that may be playing at a particular gaming table. The playing card handling system 120*e* may include a picker mechanism 773 or some other mechanism for removing or ejecting the playing cards from the playing card receiving compartments 710*a*-710*c* of the first intermediary playing card receiver 710. The playing card handling system 120*e* may also include a playing card input sensor 713 and/or inventory sensor 739 to read identifying information from the playing cards, as described in detail above.

In operation, sets or packets of randomized playing cards 718 (e.g., one-three cards) may be formed one at a time in respective ones of the playing card receiving compartments 706*a*-706*g* of the playing card output receiver 706, each set or packet intended to form at least part of a respective hand of playing cards in a round of a card game. The playing card handling system 120*e* may include a sensor (not shown in FIG. 7) to determine when the last set or packet or randomized playing cards 718 has been removed, to trigger the formation of the next sets or packets. The playing card output receiving compartments 706*a*-706*g* of the playing card output receiver 706 may be fixed with respect to respective playing card output transport paths 709*b*-709*h*, simplifying the mechanical structure.

FIG. 8 shows a playing card handling system 120*f*, according to another illustrated embodiment. The playing card handling system 120*f* is similar in some respects to the playing card handling system 120*a* (FIGS. 3A-3B).

The playing card handling system 120*f* includes a playing card input receiver 804 that receives collected playing cards 815, at least a first intermediary playing card receiver 810, and a playing card output receiver 806. At least one playing card input transport path 609*a* extends between the playing card input receiver 604 and the at least first intermediary playing card receiver 610. A playing card output path 609*b* extends between the at least first intermediary playing card receiver 810 and the playing card output receiver 806.

The first intermediary playing card receiver 810 comprises a plurality of playing card receiving compartments 810*a*-810*c* (only three called out in FIG. 8) that each receive at most one playing card during use. The playing card output receiver 806 comprises a plurality of playing card receiving compartments 806*a*-806*g*, each sized to receive a respective set or packet of randomized playing cards 818. The playing card output receiver 806 is moveable (e.g., double headed arrow) with respect to the laying card output transport path 609*b*, to selectively position respective ones of the playing card receiving compartments 806*a*-806*g* to receive playing cards moved along the playing card output transport path 809*b*. The playing card handling system 120*f* may include a picker mechanism 873 or some other mechanism for removing or ejecting the playing cards from the playing card receiving compartments 810*a*-810*c* of the first intermediary playing card receiver 810. The playing card handling system 120*f* may also include a playing card input sensor 813 and/or inventory sensor 839 to read identifying information from the playing cards, as described in detail above.

In operation, respective sets or packets of randomized playing cards 818 (e.g., one-three cards) may be formed one at a time in each of the playing card receiving compartments 806*a*-806*g*, each set or packet intended to form at least part of a respective hand of playing cards in a round of a card game. The playing card handling system 120*f* may include a sensor (not illustrated in FIG. 8) to determine when the last set or packet or randomized playing cards 818 has been removed, to trigger the formation of the next sets or packets.

Figure 9:
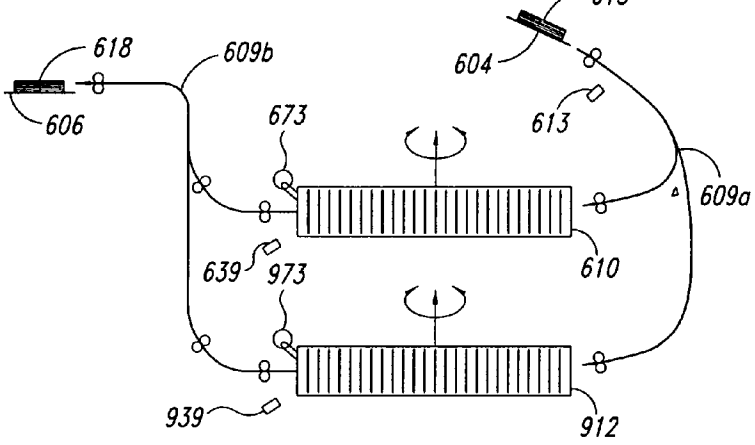
FIG. 9 is a schematic diagram of a simplified playing card handling system, according to another illustrated embodiment.

FIG. 9 shows a playing card handling system 120*g*, according to another illustrated embodiment. The playing card handling system 120*g* is similar in some respects to the playing card handling system 120*d* (FIG. 6), thus common reference numbers will be employed and only significant differences in structure and/or operation will be discussed.

The playing card handling system 120*g* includes a second intermediary playing card receiver 912, corresponding branches of the playing card input and output transport paths 609*a*, 609*b*, additional picker mechanism 973 and inventory sensor 939. The playing card handling system 120*g* may operate in a similar fashion to the playing card handling system 120*d*, although the playing card handling system 120*g* may use the first and the second intermediary playing card receivers 610, 912 concurrently or alternatively, as generally discussed above.

Figure 10:
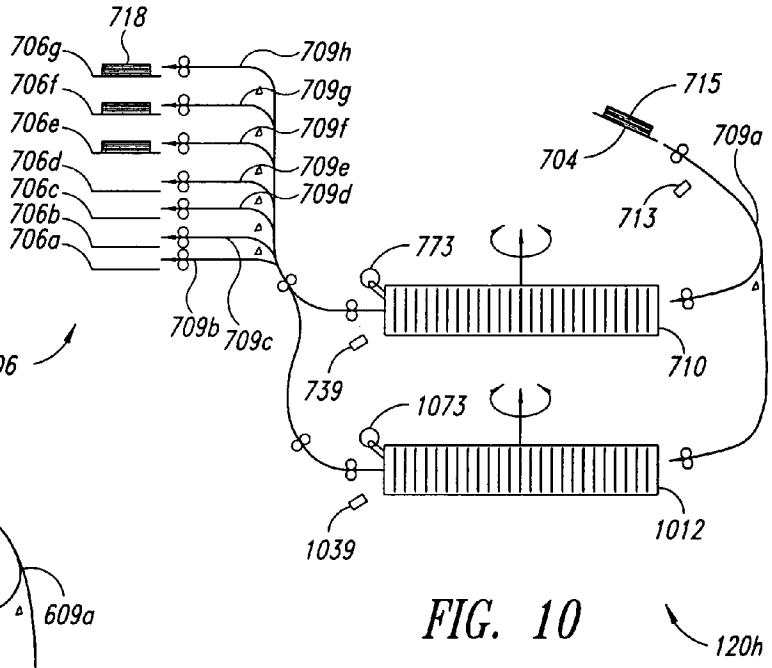
FIG. 10 is a schematic diagram of a simplified playing card handling system, according to another illustrated embodiment.

FIG. 10 shows a playing card handling system 120*h*, according to another illustrated embodiment. The playing card handling system 120*h* is similar in some respects to the playing card handling system 120*e* (FIG. 7), thus common reference numbers will be employed and only significant differences in structure and/or operation will be discussed.

The playing card handling system 120*h* includes a second intermediary playing card receiver 1012, corresponding branches of the playing card input and output transport paths 709*a*, 709*b*-709*h*, additional picker mechanism 1073 and inventory sensor 1039. The playing card handling system 120*h* may operate in a similar fashion to the playing card handling system 120*e*, although the playing card handling system 120*h* may use the first and the second intermediary playing card receivers 710, 1012 concurrently or alternatively, as generally discussed above.

Figure 11:
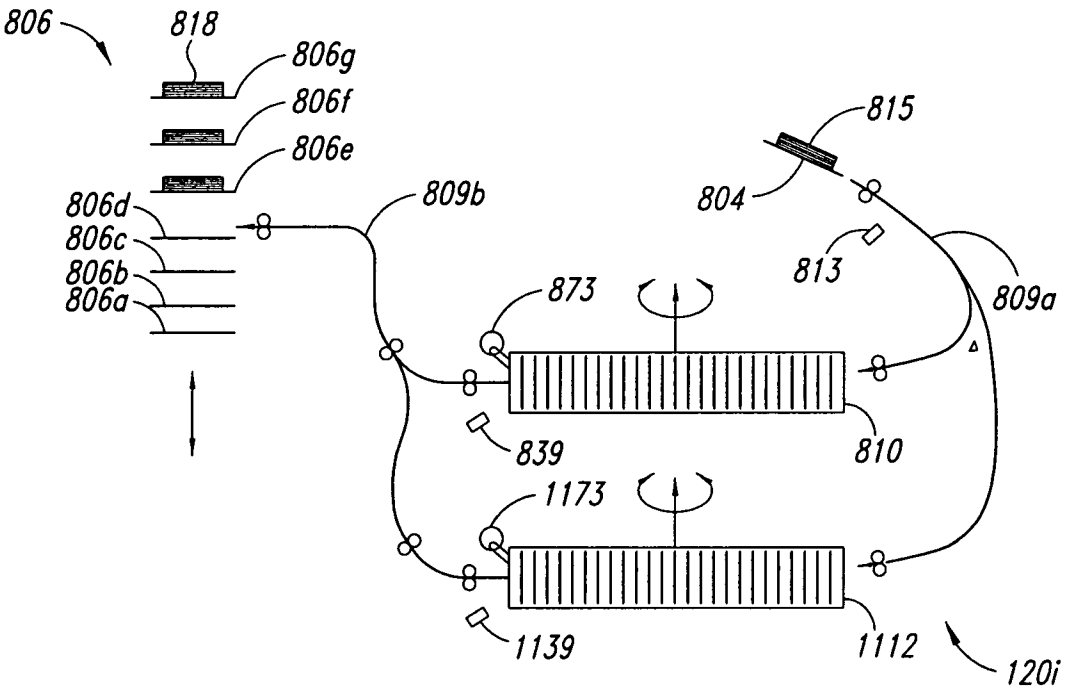
FIG. 11 is a schematic diagram of a simplified playing card handling system, according to another illustrated embodiment.

FIG. 11 shows a playing card handling system 120*i*, according to another illustrated embodiment. The playing card handling system 120*i* is similar in some respects to the playing card handling system 120*f* (FIG. 8), thus common reference numbers will be employed and only significant differences in structure and/or operation will be discussed.

The playing card handling system 120*i* includes a second intermediary playing card receiver 1112, corresponding branches of the playing card input and output transport paths 809*a*, 809*b*, additional picker mechanism 1173 and inventory sensor 1139. The playing card handling system 120*i* may operate in a similar fashion to the playing card handling system 120*f*, although the playing card handling system 120*i* may use the first and the second intermediary playing card receivers 810, 1112 concurrently or alternatively, as generally discussed above.

Figure 12:
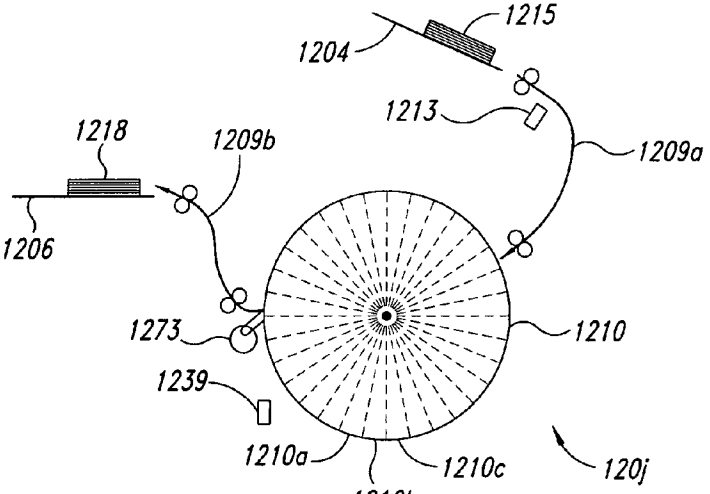
FIG. 12 is a schematic diagram of a simplified playing card handling system, according to another illustrated embodiment.

FIG. 12 shows a playing card handling system 120*j*, according to another illustrated embodiment. The playing card handling system 120*j* is similar in some respects to the playing card handling system 120*b* (FIGS. 4A, 4B).

The playing card handling system 120*j* includes a playing card input receiver 1204 that receives collected playing cards 1215, a first intermediary playing card receiver 1210, a single playing card output receiving compartment or area 1206 sized to receive a set or packet of randomized playing cards 1218. At least one playing card input transport path 1209*a* extends between the playing card input receiver 1204 and the at least first intermediary playing card receiver 1210. At least one playing card output path 1209*b* extends between the at least first intermediary playing card receiver 1210 and the single playing card output receiving compartment or area 1206.

The first intermediary playing card receiver 1210 comprises a plurality of playing card receiving compartments 1210*a*-1210*c* (only three called out in FIG. 12) that each receive at most one playing card during use. The playing card handling system 120*j* may include a picker mechanism 1273 or some other mechanism for removing, retrieving or ejecting the playing cards from the playing card receiving compartments 1210*a*-1210*c* of the first intermediary playing card receiver 1210. The playing card handling system 120*j* may also include a playing card input sensor 1213 and/or inventory sensor 1239 to read identifying information from the playing cards, as described in detail above.

In operation, sets or packets of randomized playing cards 1218 (e.g., one-three cards) may be formed one at a time in the single playing card output receiving compartment or area 1206, each set or packet intended to form at least part of a respective hand of playing cards in a round of a card game. The playing card handling system 120*j* may include a sensor (not illustrated in FIG. 12) to determine when the set or packet or randomized playing cards 1218 has been removed, to trigger the formation of the next set or packet. The single playing card output receiving compartment or area 1206 may be fixed with respect to the playing card output transport path 1209*b*, providing for a compact and mechanically simple structure.

Figure 13:
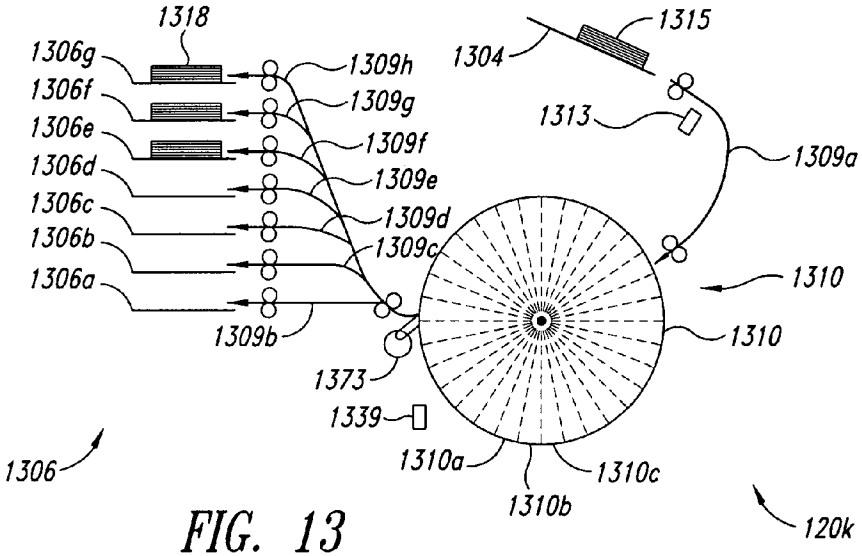
FIG. 13 is a schematic diagram of a simplified playing card handling system, according to another illustrated embodiment.

FIG. 13 shows a playing card handling system 120*k*, according to another illustrated embodiment. The playing card handling system 120*k* is similar in some respects to the playing card handling system 120*b* (FIGS. 4A, 4B).

The playing card handling system 120*k* includes a playing card input receiver 1304 that receives collected playing cards 1315, a first intermediary playing card receiver 1310, a playing card output receiver 1306. At least one playing card input transport path 1309*a* extends between the playing card input receiver 1304 and the first intermediary playing card receiver 1310. A plurality of playing card output paths 1309*b*-1309*h* extend between the first intermediary playing card receiver 1310 and respective ones of playing card output receiving compartments 1306*a*-1306*g* of the playing card output receiver 1306, along with diverters (represented by triangles) operable to divert playing cards along the respective paths.

The first intermediary playing card receiver 1310 comprises a plurality of playing card receiving compartments 1310*a*-1310*c* (only three called out in FIG. 13) that each receive at most one playing card during use. The playing card output receiver 1306 has a plurality of playing card receiving compartments 1306*a*-1306*g*, each sized to receive a respective set or packet of randomized playing cards 1318 (only one set or packet called out in FIG. 13). For example, there may be one playing card receiving compartment 1306*a*-1306*g* for each hand of playing cards that may be playing at a particular gaming table. The playing card handling system 120*j* may include a picker mechanism 1373 or some other mechanism for removing or ejecting the playing cards from the playing card receiving compartments 1310*a*-1310*c* of the first intermediary playing card receiver 710. The playing card handling system 120*j* may also include a playing card input sensor 1313 and/or inventory sensor 1339 to read identifying information from the playing cards, as described in detail above.

In operation, sets or packets of randomized playing cards 1318 (e.g., one-three cards) may be formed one at a time in respective ones of the playing card receiving compartments 1306*a*-1306*g* of the playing card output receiver 1306, each set or packet intended to form at least part of a respective hand of playing cards in a round of a card game. The playing card handling system 120*j* may include a sensor (not illustrated in FIG. 13) to determine when the last set or packet or randomized playing cards 1318 has been removed, to trigger the formation of the next sets or packets. The playing card output receiving compartments 1306*a*-1306*g* of the playing card output receiver 1306 may be fixed with respect to respective playing card output transport paths 1309*b*-1309*h*.

Figure 14:
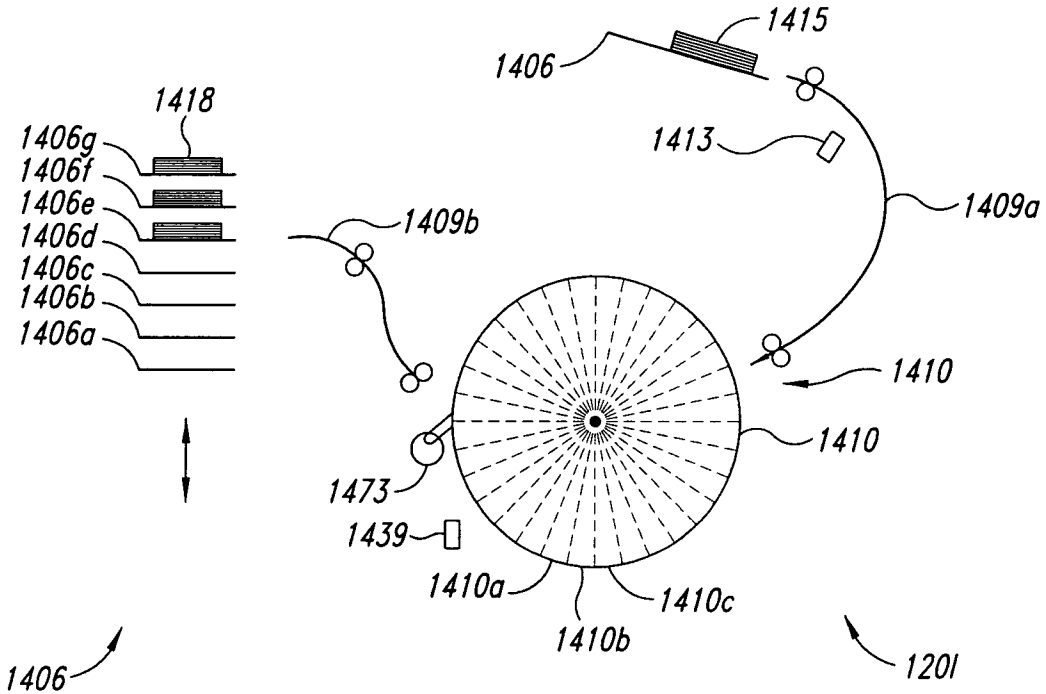
FIG. 14 is a schematic diagram of a simplified playing card handling system, according to another illustrated embodiment.

FIG. 14 shows a playing card handling system 120*l*, according to another illustrated embodiment. The playing card handling system 120*l* is similar in some respects to the playing card handling system 120*b* (FIGS. 4A, 4B).

The playing card handling system 120*l* includes a playing card input receiver 1404 that receives collected playing cards 1415, a first intermediary playing card receiver 1410, and a playing card output receiver 1406. At least one playing card input transport path 1409*a* extends between the playing card input receiver 1404 and the at least first intermediary playing card receiver 1410. A playing card output path 1409*b* extends between the at least first intermediary playing card receiver 1410 and the playing card output receiver 1406.

The first intermediary playing card receiver 810 comprises a plurality of playing card receiving compartments 1410*a*-1410*c* (only three called out in FIG. 14) that each receive at most one playing card during use. The playing card output receiver 1406 comprises a plurality of playing card receiving compartments 1406*a*-1406*g*, each sized to receive a respective set or packet of randomized playing cards 1418 (only one called out in FIG. 14). The playing card output receiver 1406 is moveable (e.g., double headed arrow) with respect to the laying card output transport path 1409*b*, to selectively position respective ones of the playing card receiving compartments 1406*a*-1406*g* to receive playing cards moved along the playing card output transport path 1409*b*. The playing card handling system 120*l* may include a picker mechanism 1473 or some other mechanism for removing or ejecting the playing cards from the playing card receiving compartments 1410*a*-1410*c* of the first intermediary playing card receiver 1410. The playing card handling system 120*l* may also include a playing card input sensor 1413 and/or inventory sensor 1439 to read identifying information from the playing cards, as described in detail above.

In operation, respective sets or packets of randomized playing cards 1418 (e.g., one-three cards) may be formed one at a time in each of the playing card receiving compartments 1406*a*-1406*g*, each set or packet intended to form at least part of a respective hand of playing cards in a round of a card game. The playing card handling system 120*l* may include a sensor (now illustrated in FIG. 14) to determine when the last set or packet or randomized playing cards 1418 has been removed, to trigger the formation of the next sets or packets.

Figure 15:
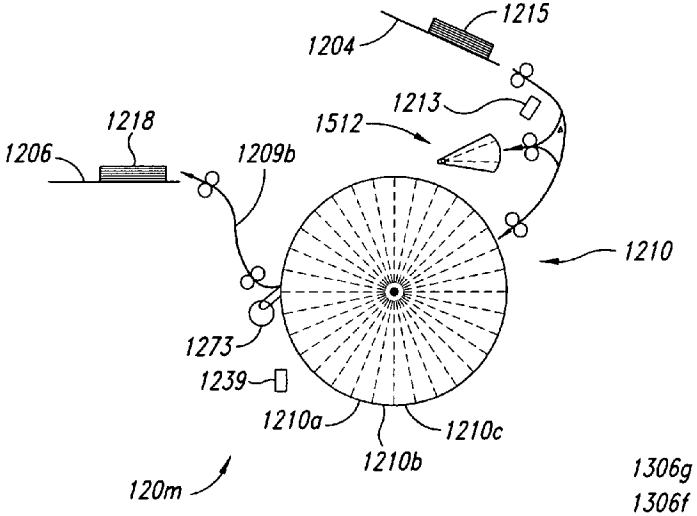
FIG. 15 is a schematic diagram of a simplified playing card handling system, according to another illustrated embodiment.

FIG. 15 shows a playing card handling system 120*m*, according to another illustrated embodiment. The playing card handling system 120*m* is similar in some respects to the playing card handling system 120*j* (FIG. 12), thus common reference numbers will be employed and only significant differences in structure and/or operation will be discussed.

The playing card handling system 120*m* includes a second intermediary playing card receiver 1512, corresponding branches of the playing card input and output transport paths 609*a*, 609*b*, additional picker mechanism 973 and inventory sensor 939. The second intermediary playing card receiver 1512 may include a plurality of playing card receiving compartments (e.g., three), each sized to receive a plurality of playing cards. The second intermediary playing card receiver 1512 may, for example, be used to pre- or rough sort playing cards, serving as a repository for playing cards which are not initially needed in the first intermediary playing card receiver 1210. In such use, the first intermediary playing card receiver 1210 may be used to post- or fine sort the playing cards which are needed to form the next several sets or packets 1218. The playing card handling system 120*m* may operate in a similar fashion to the playing card handling system 120*j*, although the playing card handling system 120*m* may use the first and the second intermediary playing card receivers 1210, 1512 concurrently or alternatively, as discussed above.

Figure 16:
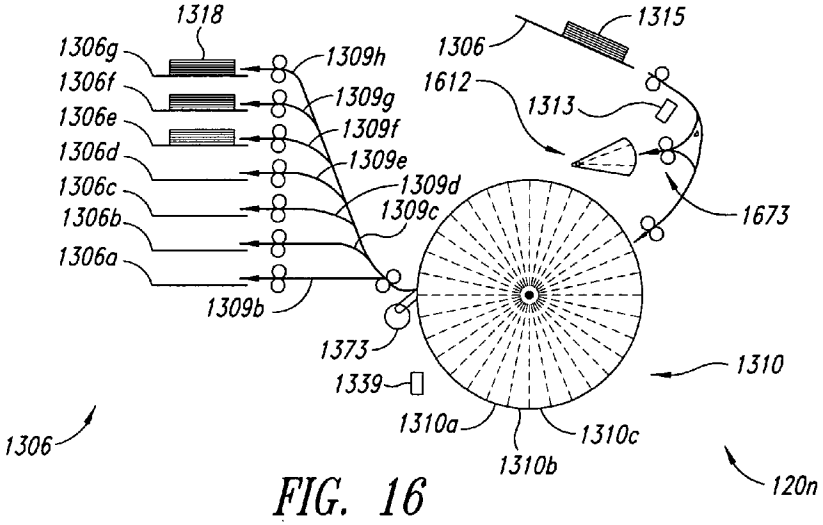
FIG. 16 is a schematic diagram of a simplified playing card handling system, according to another illustrated embodiment.

FIG. 16 shows a playing card handling system 120*n*, according to another illustrated embodiment. The playing card handling system 120*n* is similar in some respects to the playing card handling system 120*k* (FIG. 13), thus common reference numbers will be employed and only significant differences in structure and/or operation will be discussed.

The playing card handling system 120*n* includes a second intermediary playing card receiver 1612 similar to that discussed immediately above. The playing card input transport path 1309*a* may include multiple branches, for example leading to the first and the second intermediary playing card receivers 1310, 1612, respectively. Likewise, the playing card output transport paths 1309*b*-1309*h* may include multiple branches, for example leading from the first and the second intermediary playing card receivers 1310, 1612, respectively. The playing card handling system 120*n* may optionally include an additional picker mechanism 1673 for removing playing cards from the playing card receiving compartments of the second intermediary playing card receiver 1612. The playing card handling system 120*n* may operate in a similar fashion to the playing card handling system 120*k*, although the playing card handling system 120*n* may use the first and the second intermediary playing card receivers 1310, 1612 concurrently or alternatively, as generally discussed above.

Figure 17:
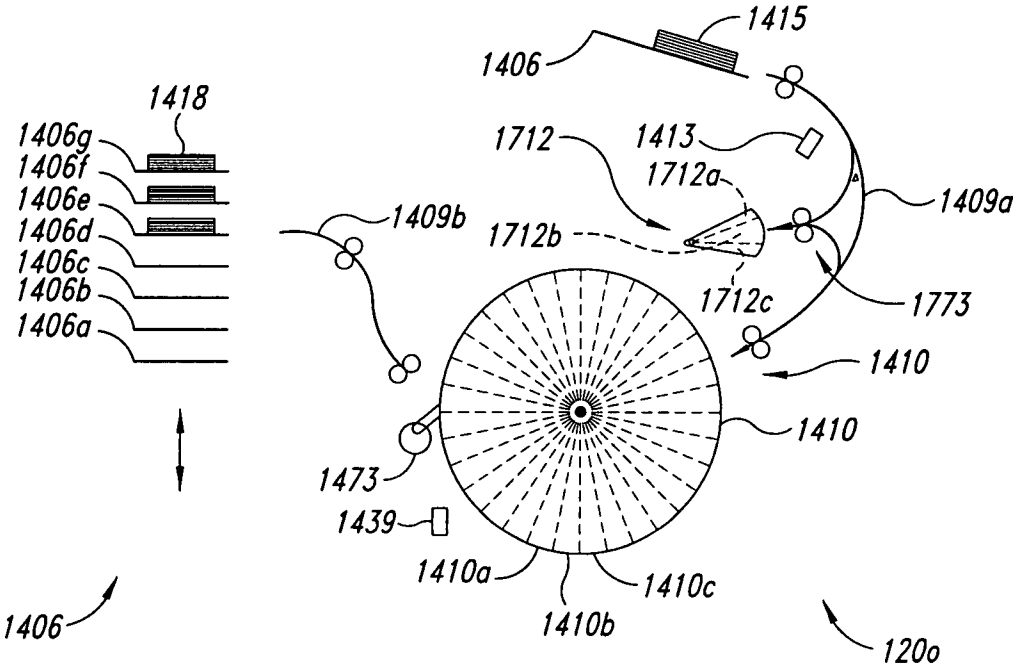
FIG. 17 is a schematic diagram of a simplified playing card handling system, according to another illustrated embodiment.

FIG. 17 shows a playing card handling system 120*o*, according to another illustrated embodiment. The playing card handling system 120*o* is similar in some respects to the playing card handling system 120*l* (FIG. 14), thus common reference numbers will be employed and only significant differences in structure and/or operation will be discussed.

The playing card handling system 120*o* includes a second intermediary playing card receiver 1712 having a plurality of playing card receiving compartments 1712*a*-1712*c*, similar to that discussed above. The playing card input transport path 1409*a* may include multiple branches, for example leading to the first and the second intermediary playing card receivers 1410, 1712, respectively. Likewise, the playing card output transport path 1409*b* may include multiple branches, for example leading from the first and the second intermediary playing card receivers 1410, 1712, respectively. The playing card handling system 120*o* may optionally include an additional picker mechanism 1773 operable to remove playing card form the playing card receiving compartments 1712*a*-1712*c* of the second intermediary playing card receiver 1712. The playing card handling system 120*o* may operate in a similar fashion to the playing card handling system 120*l*, although the playing card handling system 120*o* may use the first and the second intermediary playing card receivers 1410, 1712 concurrently or alternatively, as discussed above.

Figure 18:
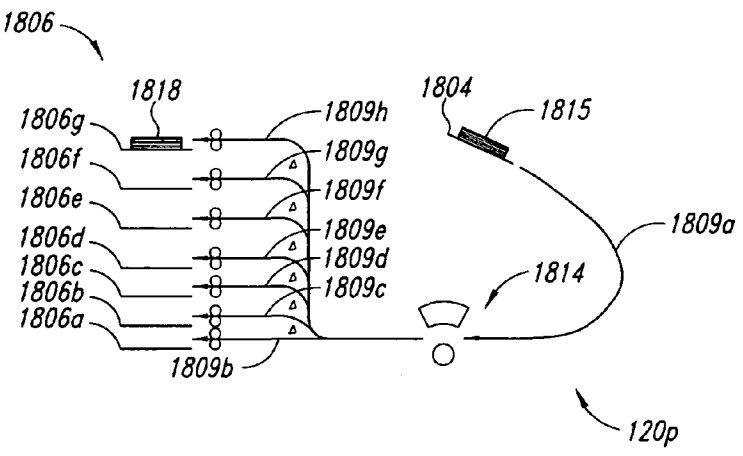
FIG. 18 is a schematic diagram of a simplified playing card handling system, according to another illustrated embodiment.

FIG. 18 shows a playing card handling system 120*p*, according to another illustrated embodiment. The playing card handling system 120*p* is similar in some respects to the playing card handling system 120*c* (FIG. 5).

The playing card handling system 120*p* includes a playing card input receiver 1804, a playing card marking forming mechanism 1814, and a playing card output receiver 1806. At least one playing card input transport path 1809*a* extends between the playing card input receiver 1804 and the playing card marking forming mechanism 1814.

The playing card input receiver 1804 is sized and dimensioned to receive playing card media or collected playing cards 1815. The playing card marking forming mechanism 1814 may take the form of a printer or other mechanism suitable for forming playing card markings, such as those discussed above in reference to the embodiment of FIG. 5. The playing card output receiver 1806 has a plurality of playing card receiving compartments 1806*a*-1806*g* each sized to receive a respective set or packet of randomized playing cards 1818 (only one set or packet called out in FIG. 18). For example, there may be one playing card receiving compartment 1806*a*-1806*g* for each hand of playing cards that may be playing at a particular gaming table. A plurality of playing card output paths 1809*b*-1809*h* extend between the playing card marking forming mechanism 1814 and respective ones of the playing card output receiving compartments 1806*a*-1806*g*, along with diverters (represented by triangles) operable to divert playing cards along the respective paths.

In operation, sets or packets of randomized playing cards 1818 (e.g., one-three cards) may be formed one at a time in respective ones of the playing card receiving compartments 1806*a*-1806*g* of the playing card output receiver 1806, each set or packet intended to form at least part of a respective hand of playing cards in a round of a card game. The playing card handling system 120*p* may include a sensor to determine when the last set or packet or randomized playing cards 1818 has been removed, to trigger the formation of the next sets or packets. The playing card output receiving compartments 1806*a*-1806*g* of the playing card output receiver 1806 may be fixed with respect to respective playing card output transport paths 1809*b*-1809*h*, simplifying the mechanical structure.

Figure 19:
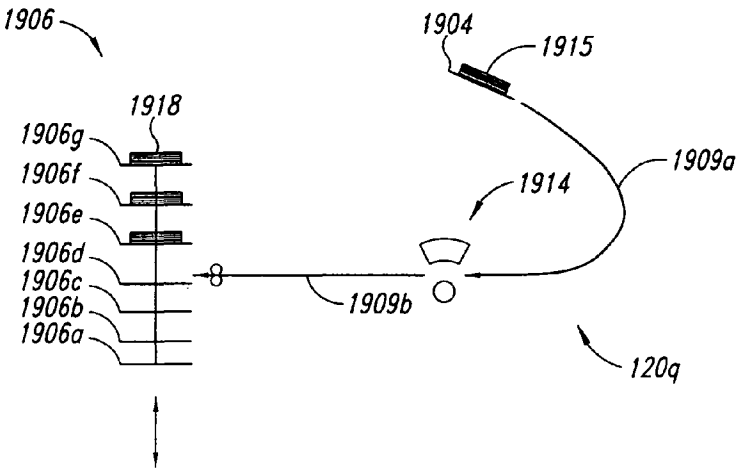
FIG. 19 is a schematic diagram of a simplified playing card handling system, according to another illustrated embodiment.

FIG. 19 shows a playing card handling system 120*q*, according to another illustrated embodiment. The playing card handling system 120*q* is similar in some respects to the playing card handling system 120*c* (FIG. 5).

The playing card handling system 120*q* includes a playing card input receiver 1904, a playing card marking forming mechanism 1914, and a playing card output receiver 1906. At least one playing card input transport path 1909*a* extends between the playing card input receiver 1904 and the playing card marking forming mechanism 1914.

The playing card input receiver 1904 is sized and dimensioned to receive playing card media or collected playing cards 1915. The playing card marking forming mechanism 1914 may take the form of a printer or other mechanism suitable for forming playing card markings, such as those discussed above in reference to the embodiment of FIG. 5. The playing card output receiver 1906 has a plurality of playing card receiving compartments 1906*a*-1906*g*, each sized to receive a respective set or packet of randomized playing cards 1918 (only one set or packet called out in FIG. 19). For example, there may be one playing card receiving compartment 1906*a*-1906*g* for each hand of playing cards that may be playing at a particular gaming table. A playing card output path 1909*b* extends between the playing card marking forming mechanism 1914 and the playing card output receiver 1906. The playing card output receiver 1906 is moveable (e.g., double headed arrow) with respect to the playing card output transport path 1909*b*, to selectively position respective ones of the playing card receiving compartments 1906*a*-1906*g* to receive playing cards moved along the playing card output transport path 1909*b*.

In operation, respective sets or packets of randomized playing cards 1918 (e.g., one-three cards) may be formed one at a time in each of the playing card receiving compartments 1906*a*-1906*g*, each set or packet intended to form at least part of a respective hand of playing cards in a round of a card game. The playing card handling system 120*q* may include a sensor (not illustrated in FIG. 19) to determine when the last set or packet or randomized playing cards 1918 has been removed, to trigger the formation of the next sets or packets.

Brief Overview of the Operation of Playing Card Handling Systems

Each of the playing card handling systems 120*a*-120*q* (collectively 120) provide sets or packets of randomized playing cards 318, 418, 518, 618, 718, 818, 1218, 1318, 1418, 1818, 1918 at the playing card output receiver 306, 406, 506, 606, 706, 806, 1206, 1306, 1406, 1806, 1906, which may or may not be based on a selected set of payout or house odds and/or house advantage.

In various embodiments, the sets or packets of randomized playing cards 318, 418, 518, 618, 718, 818, 1218, 1318, 1418, 1818, 1918 may be delivered to respective playing card receiving compartments of the playing card output receiver (e.g., 306, 406, 706, 806, 1306, 1406, 1806, 1906) as discussed below with reference to FIG. 20, or to a single playing card receiving compartment or area of the playing card output receiver (e.g., 506, 606, 1206) as discussed below with reference to FIG. 21.

As discussed above, each subset or packet of playing cards may form a hand or portion of a hand of playing cards intended for a respective one of the participant positions (e.g., player positions 104 and dealer position 106). The playing cards may be selected, retrieved, ejected or formed based on a number of virtual playing card values that have been pseudo-randomly generated. The virtual playing card values may, or may not, be pseudo-randomly generated based on the payout odds or house advantage selected for the particular player position 104 (FIG. 1) to which the subset or packet of playing cards will be dealt. These approaches may be suitable for card games in which complete hands are dealt to the participants 110, 114 at the start of the game. These approaches may be suitable for card games in which partial hands are dealt to the participants 110, 114 at the start of the game, and which may, or may not employ separately dealt playing cards that are common or shared by the various participants 110, 114 to complete the participant's respective hands. These approaches may additionally, or alternatively be suitable for card games where the rules dictate the number of playing cards that will be selected by, or dealt to, each participant position. For example, the rules of baccarat dictate when each of the participants (e.g., player and bank) must take additional playing cards (e.g., hit cards). Consequently, these approaches may advantageously simplify the dealing of playing cards to the various participants 110, 114. These approaches may also avoids the extra computational overhead required for positioning or interleaving the playing cards for various participant positions (e.g., player positions 104 and dealer position 106) with respect to one another in a set or stack of playing cards.

Figure 20:
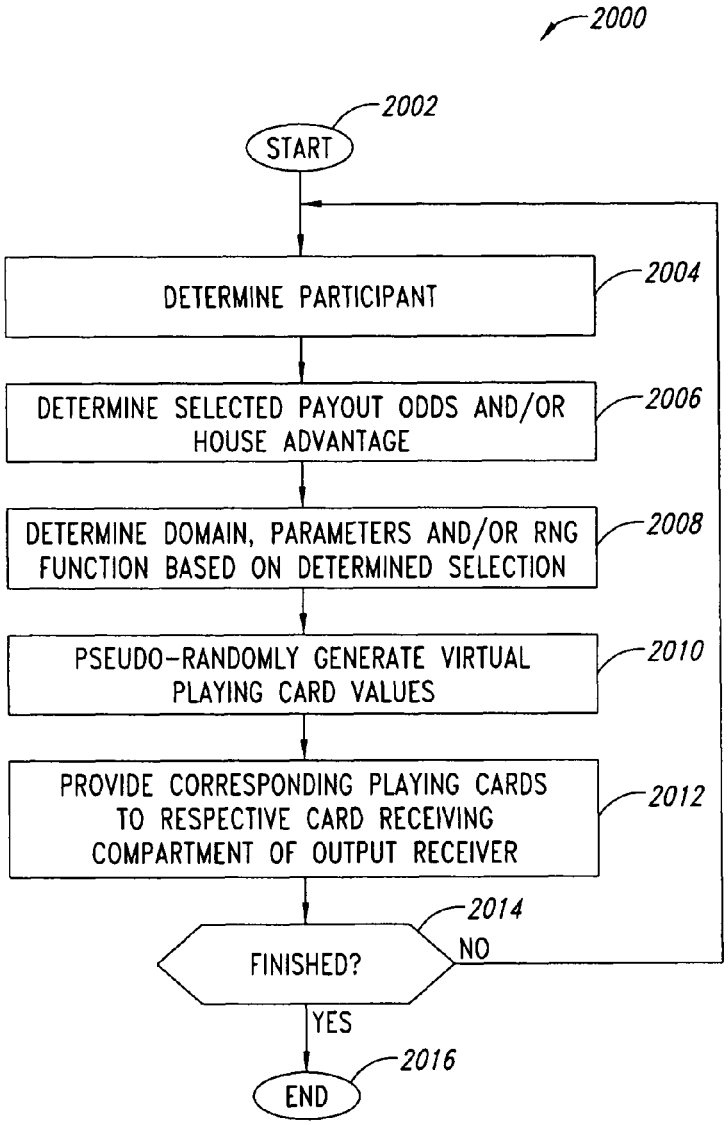
FIG. 20 is a flow diagram of a method of operating a playing card handling system to form sets or packets of playing cards one at a time in a plurality of playing card receiving compartments of a playing card output receiver, according to one illustrated embodiment.

FIG. 20 shows a method 2000 of delivering playing cards as subsets or packets of playing cards, starting at 2002.

Optionally at 2004, the playing card handling system 120 determines a participant 110, 114 (FIG. 1) or participant position 104, 106 to which the playing card will be dealt. Such may be based on the rules of the game and/or on information received from the players 110, the dealer 114, or various other gaming systems 204 (FIG. 2).

Optionally at 2006, the playing card handling system 120 determines the selected payout or house odds and/or house advantage for the participant 110, 114 or participant position 104, 106. Such determination may be based on the selection received by the playing card handling system 120.

Optionally at 2008, the playing card handling system 120 determines a domain of virtual playing card values, parameters for an RNG function and/or a particular RNG function for pseudo-randomly generating virtual playing card values.

The playing card handling system 120 may determine the domain, parameters, and/or a particular RNG function in a variety of ways. For example, the playing card handling system 120 may determine a total number of virtual playing card values composing the domain to achieve or partially achieve particular payout or house odds and/or house advantage. Alternatively, or additionally, the playing card handling system 120 may select the virtual playing card values composing the domain to achieve or partially achieve particular payout or house odds and/or house advantage. For example, the playing card handling system 120 may omit certain virtual playing card values (e.g., those corresponding to one or more Aces), or may over represent certain virtual playing card values (e.g., fives). Such may be used to control the probability of a bonus hand occurring (e.g., five Queen of hearts in a single hand), for which a bonus or progressive payout is made. Alternatively, or additionally, the playing card handling system 120 may select parameters that weight the RNG function to increase and/or decrease the probability of generating certain virtual playing card values. For example, the playing card handling system 120 may select parameters that increase, or alternatively, decrease the probability of generating a virtual playing card value corresponding to playing cards having a value of ten (e.g., tens and face cards). Alternatively, or additionally, the playing card handling system 120 may select between a plurality of RNG functions, each designed to produce on average a respective payout or house odds and/or house advantage. Further discussion of the various alternatives may be found in U.S. provisional patent application Ser. No. 60/808,161.

At 2010, the playing card handling system 120 pseudo-randomly generates virtual playing card values, for example based on the determined domain, parameters and/or RNG function. At 2012, the playing card handling system 120 provides playing cards corresponding to the pseudo-randomly generated virtual playing card values to a respective one of the playing card receiving compartments to form a set or packet of randomized playing cards 318, 418 intended for a particular participant 110, 114 or position.

At 2014, the playing card handling system 120 determines whether there are additional sets or packets of playing cards to be dealt. If so, control returns to 2004, otherwise the method 2000 terminates at 2016.

Figure 21:
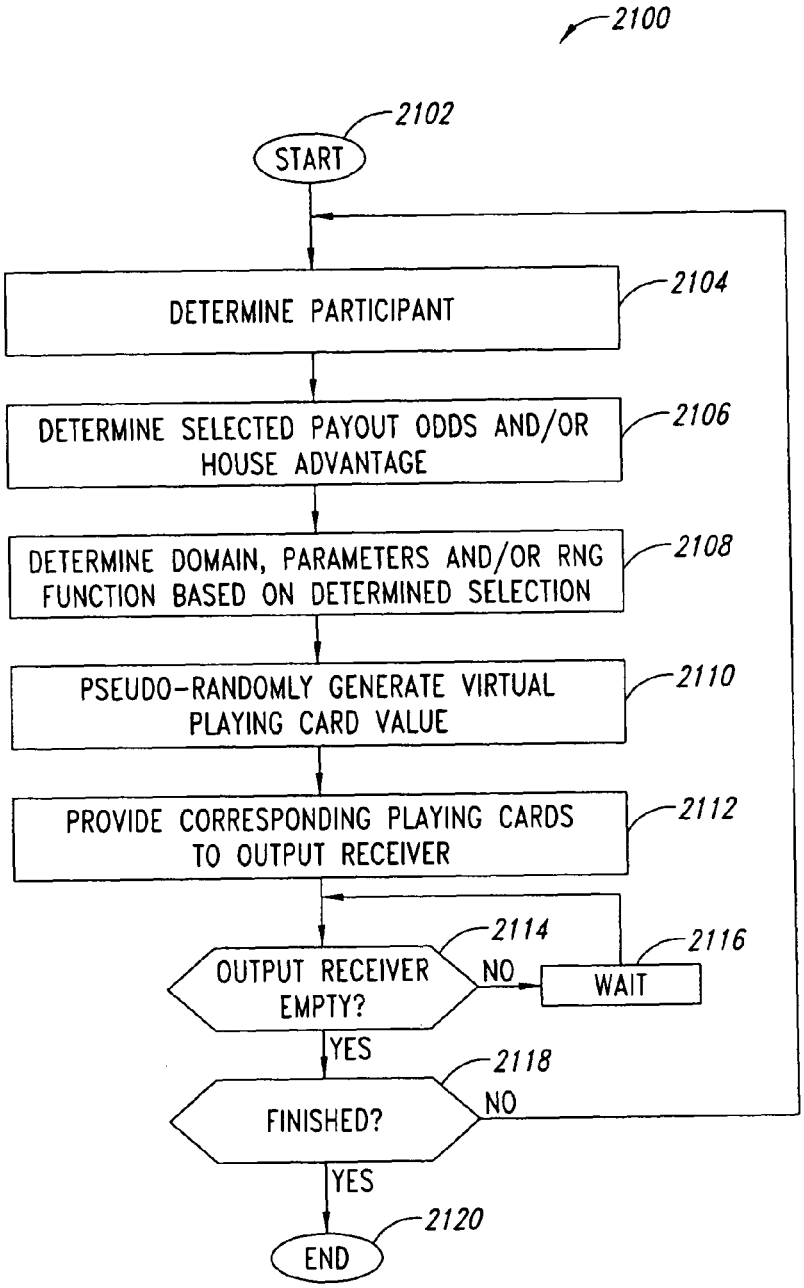
FIG. 21 is a flow diagram of a method of operating a playing card handling system to form sets or packets of playing cards one at a time in a single playing card receiving compartment or area of a playing card output receiver, according to one illustrated embodiment.

FIG. 21 shows a method 2100 of delivering playing cards to a single playing card receiving compartment or area of an playing card output receiver, starting at 2102.

Optionally at 2104, the playing card handling system 120 determines a participant 110, 114 (FIG. 1) or participant position 104, 106 to which the playing card will be dealt. Such may be based on the rules of the game and/or on information received from the players 110, the dealer 114, or various other gaming systems 204 (FIG. 2).

Optionally at 2106, the playing card handling system 120 determines the selected payout or house odds and/or house advantage for the participant 110, 114 or participant position 104, 106. Such may be based on the selection received by the playing card handling system 120.

Optionally at 2108, the playing card handling system 120 determines a domain of virtual playing card values, parameters for a Random Number Generator (RNG) function and/or a particular RNG function, for pseudo-randomly generating virtual playing card values, for example as discussed above in reference to FIG. 20.

At 2110, the playing card handling system 120 pseudo-randomly generates virtual playing card values, for example based on the determined domain, parameters and/or RNG function. At 2112, the playing card handling system 120 provides playing cards corresponding to the pseudo-randomly generated virtual playing card values to the single playing card receiving compartment or area of the playing card output receiver.

Since there is only a single location for the receiving or holding the set or packet of randomized playing cards, the playing card handling system 120 determines at 2114 whether the playing card output receiver is empty. If not, the method 2100 waits at 2116, and then returns control to 2114. If the playing card output receiver is empty, control passes to 2118. At 2118, the playing card handling system 120 determines whether there are additional playing cards to be dealt. If so, control returns to 2104, otherwise the method 2100 terminates at 2120. In this manner the sets or packets or randomized playing cards may consecutively formed and used in dealing multiple hands of playing cards to various participant positions (e.g., player positions 104 and dealer position 106).

Figure 22:
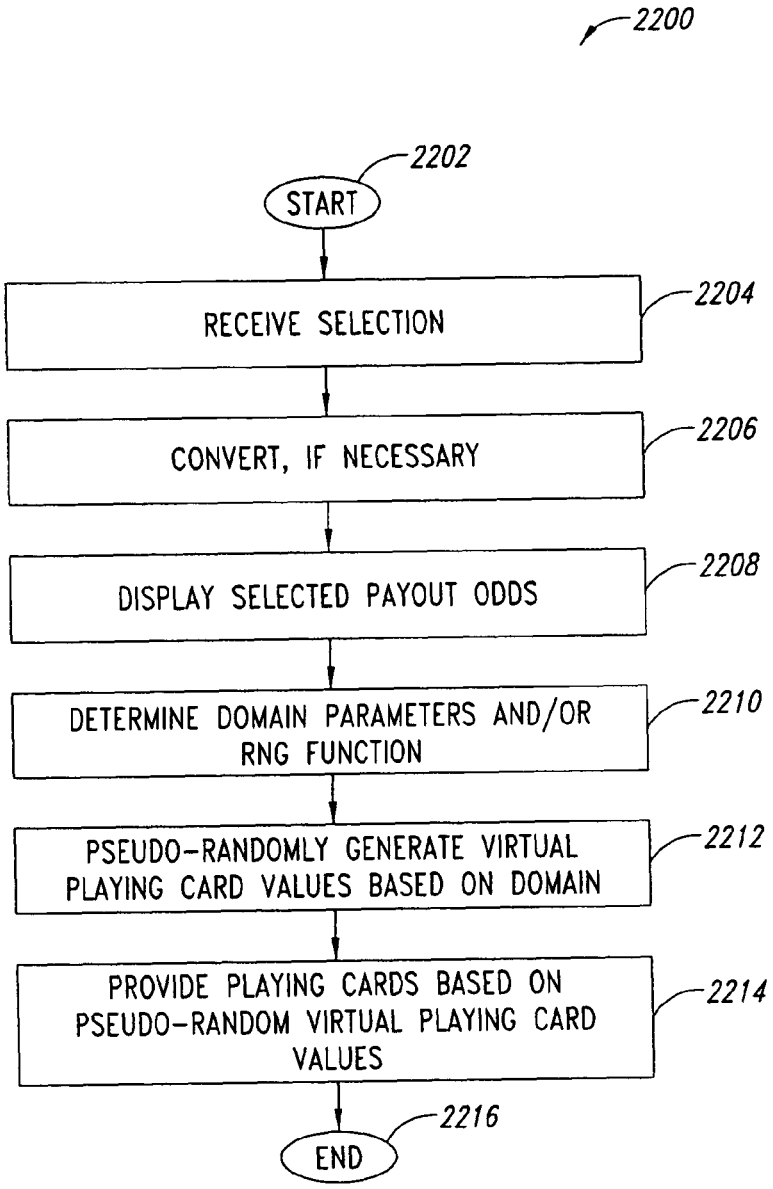
FIG. 22 is a flow diagram of a method of operating a gaming environment to allow selection and display of theoretical and/or payout odds, according to one illustrated embodiment.

FIG. 22 shows a method 2200 of operating a gaming environment according to one illustrated embodiment, starting at 1202.

Optionally at 2204, the host computing system 124 (FIGS. 1 and 2) and/or playing card handling system 120 receives selection from a player 110 or dealer 114 indicative of a set of payout or house odds and/or house advantage. Optionally at 2204, the host computing system 124 and/or playing card handling system 120 converts the received, if necessary. For example, the host computing system 124 and/or playing card handling system 120 may convert player defined payout or house odds to an acceptable value, for example an pair of integer values, and/or may convert payout or house odds to a house advantage. Optionally at 2208, the host computing system 124 and/or playing card handling system 120 causes one or more displays 126 to display the payout or house odds and/or house advantage to at least one of the participants 110, 114.

Optionally at 2210, the host computing system 124 and/or playing card handling system 120 determines a domain, parameters and/or RGN function based on the payout or house odds and/or house advantage. The host computing system 124 and/or playing card handling system 120 may, for example, employ a mathematical function, algorithm or lookup table.

The randomization of playing cards employs an RNG function to produce random virtual playing card values, based at least in part on the selected payout or house odds and/or house advantage. Performance of RNG on computers is well known in the computing arts. Mathematicians do not generally consider computer generated random numbers to be truly random, and thus commonly refer to such numbers as being pseudo-random. However such numbers are sufficiently random for most practical purposes, such as distributing playing cards to players. Hence, while we typically denominate the computer generated values as being random and the playing cards as being randomized, such terms as used herein and in the claims encompasses pseudo-random numbers and ordering, and includes any values or ordering having a suitable random distribution or probability of occurrence based on a selected set of odds or probabilities, whether truly mathematically random or not.

In some embodiments, the virtual playing card values may be computationally generated (e.g., via an RNG algorithm) executed by a suitable controller. In some embodiments, the virtual playing card values may be determined from predefined data that is randomly selected, such as from one or more lookup tables. For example, the virtual playing card values may comprise a sorted order, such as the order of playing cards in a new deck, prior to shuffling.

In order to reflect the selected payout or house odds and/or house advantage, the playing card handling system 120 may select or form a suitable domain of playing card values on which the RNG will operate. Thus, for example, the playing card handling system 120 may select or adjust the size of the domain, and/or the composition of the domain of playing card values before or while executing the RNG algorithm. Additionally, or alternatively, in order to reflect the selected payout or house odds and/or house advantage, the playing card handling system 120 may select suitable parameters for the RNG algorithm from a number of parameters, the parameters weighting or biasing the RNG algorithm towards or away from generating certain virtual playing card values. Additionally, or alternatively, in order to reflect the selected payout or house odds and/or house advantage, the playing card handling system 120 may select a suitable RNG algorithm from a number of RNG algorithms, the RNG algorithms weighted or biased towards or away from generating certain virtual playing card values.

As discussed above, the virtual playing card values may be generated one at a time, for example on an as needed basis. Alternatively, the virtual playing card values may be generated as subsets, or sets formed of two or more subsets. The particular approach may depend on the rules of the card game and whether playing cards will be dealt individual in groups such as packets.

The virtual playing card values may take a variety of forms. The virtual playing card values may take the form of electronic or other data that represent or are otherwise indicative of a playing card value (e.g., rank) or identity (e.g., rank and suit). The electronic data may, for example, take the form of an ordered list of virtual playing card values. The virtual playing card values may be generated from a domain of virtual playing card values. The domain may include playing card values representative of respective ones of the playing cards in a standard, fifty-two (52) card deck. For example, the domain of playing card values consist of the integers 0-51, each associated with a respective rank and suit combination. Alternatively, the domain of playing card values may, for example, take the form of two integers, a first integer representing a rank (e.g., 0-12) and a second integer representing a suit (e.g., 0-13).

The domain of playing card values may comprise a fewer or greater number of playing cards than the number of playing cards in a standard, fifty-two (52) card deck. For example, the domain of playing card values may take the form of set of identifiers (e.g. serial) numbers that are each uniquely associated with a playing card from a set of playing cards greater than a standard deck of 52 playing cards. Thus, there may be two or more playing cards of the same rank and suit, each of which is identified by a unique identifier in the domain of playing card values. Alternatively, the domain may include fewer than an integer multiple of a standard fifty-two playing card deck.

Additionally or alternatively, the virtual sequence 120 may be determined from predefined data such as one or more lookup tables, for example a sorted order that corresponds to the order of cards, un-shuffled, from a new playing deck.

At 2212, the provides one or more playing cards to the single or respective playing card receiving receptacle, for example based on one or more pseudo-randomly generated virtual play card values. Where there is a single playing card receiving compartment or area, the playing cards for a first set or packet will necessarily be provided before any playing cards for a second or later set or packet of playing cards. Where there are multiple playing card receiving compartments, the playing cards for a first set or packet may be provided before any playing cards for a second or later set or packet of playing cards are provided. The may advantageously facilitate the forming of sets or packets of playing cards based on respective odds for the different sets or packets.

The method 2200 may terminate at 2216, until the occurrence of another trigger event, or may continually repeat as a loop.

Detailed Discussion of Operation of Various Playing Card Handling Systems

The specific operation of the various playing card handling systems 120 to provide sets or packets of randomized playing cards 318, 418, 518, 618, 718, 818, 1218, 1318, 1418, 1818, 1918 is discussed in detail below.

Figure 23:
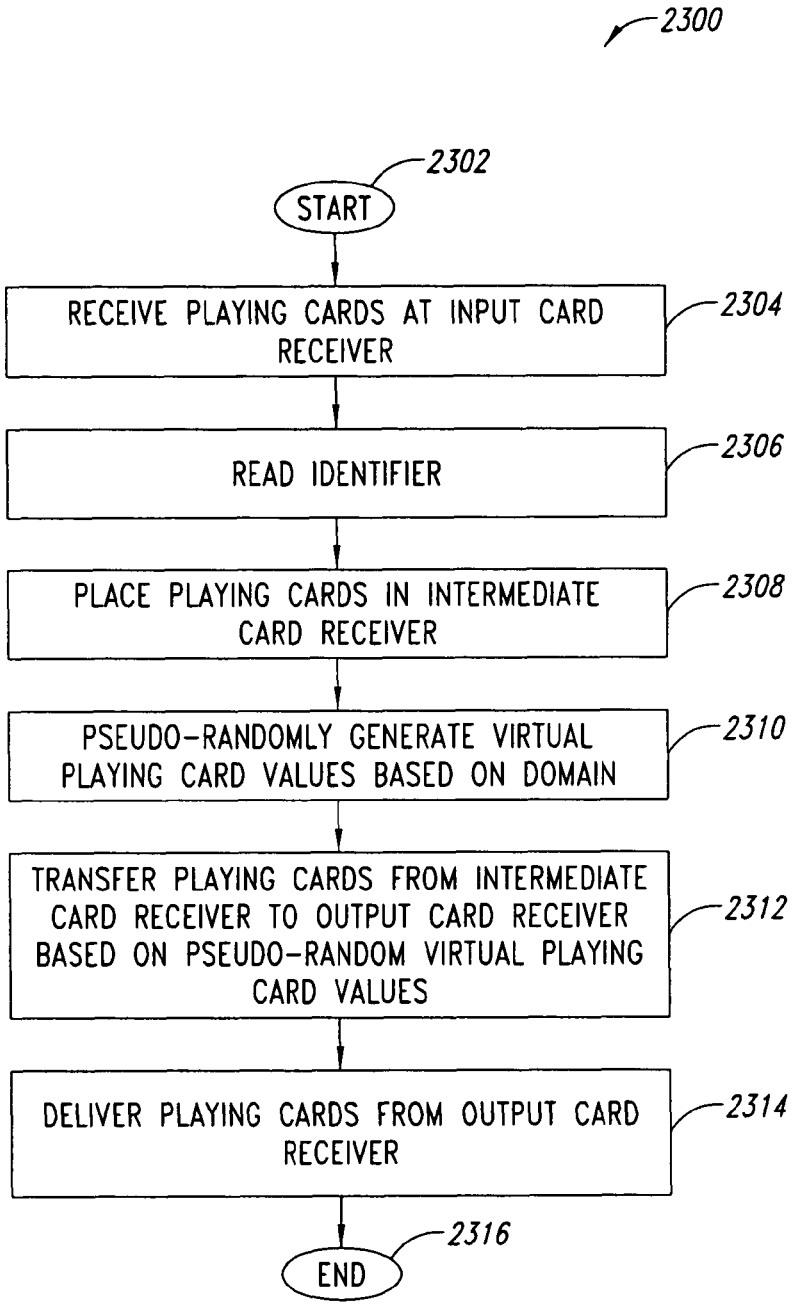
FIG. 23 is a flow diagram of a method of operating a playing card handling system to form sets or packets of playing cards one at a time by removing, retrieving or ejecting playing cards from respective playing card receiving compartments of an intermediary playing card receiver, according to one illustrated embodiment.

FIG. 23 shows a method 2300 of operating one of the playing card handling systems 120*a*, 120*b*, 120*d*-120*o* (FIGS. 3A-3*b*, 4A, 4B, 6-17), according to one illustrated embodiment starting at 2302.

At 2304, the playing card handling system 120*a*, 120*b*, 120*d*-120*o* receives collected playing cards 315, 415, 615, 715, 815, 1215, 1315, 1415 at the playing card input receiver 304, 404, 604, 704, 804, 1204, 1304, 1404. At 2306, the playing card input reading sensor 313, 413 reads identifying information from the playing cards. At 2308, the playing card handling system 120*a*, 120*b*, 120*d*-120*o* places the playing cards in one or more of the intermediary playing card receivers 310, 312, 410, 412, 610, 612, 710, 810, 912, 1012, 1112, 1210, 1310, 1410, 1512, 1612, 1712. The playing card handling system 120*a*, 120*b*, 120*d*-120*o* may advantageously place each playing card in a closest empty card receiving compartment of the intermediary playing card receiver 310, 312, 410, 412, 610, 612, 710, 810, 912, 1012, 1112, 1210, 1310, 1410, 1512, 1612, 1712. The most immediate empty card receiving compartment may be the card receiving compartment that is nearest the playing card transport path based on movement of the intermediary playing card receiver 310, 312, 410, 412, 610, 612, 710, 810, 912, 1012, 1112, 1210, 1310, 1410, 1512, 1612, 1712 in either of two directions of movement (e.g., clockwise/counterclockwise, or up/down). This advantageously reduces the time to load the intermediary playing card receivers 310, 312, 410, 412, 610, 612, 710, 810, 912, 1012, 1112, 1210, 1310, 1410, 1512, 1612, 1712. The playing card handling system 120*a*, 120*b*, 120*d*-120*o* keeps track in memory of the identity of the playing cards in the respective card receiving compartments.

At 2310, the playing card handling system 120*a*, 120*b*, 120*d*-120*o* randomly or pseudo-randomly generates one or more virtual playing card values, for example based on a domain, parameters, and/or RNG function. Such has been discussed in detail above.

At 2312, the playing card handling system 120*a*, 120*b*, 120*d*-120*o* transfers playing cards from the intermediary playing card receiver 310, 312, 410, 412, 610, 612, 710, 810, 912, 1012, 1112, 1210, 1310, 1410, 1512, 1612, 1712 to the output card receiver 306, 406, based on the random or pseudo-random virtual playing card values. Thus, the playing card handling system 120*a*, 120*b*, 120*d*-120*o* may advantageously select and/or otherwise remove playing cards from the intermediary playing card receivers 310, 312, 410, 412, 610, 612, 710, 810, 912, 1012, 1112, 1210, 1310, 1410, 1512, 1612, 1712 in a random order.

At 2314, the playing card handling system 120*a*, 120*b*, 120*d*-120*o* delivers the playing cards from the output card receiver 306, 406, 606, 706, 806, 1206, 1306, 1406. The method 2300 terminates at 2316.

Figure 24:
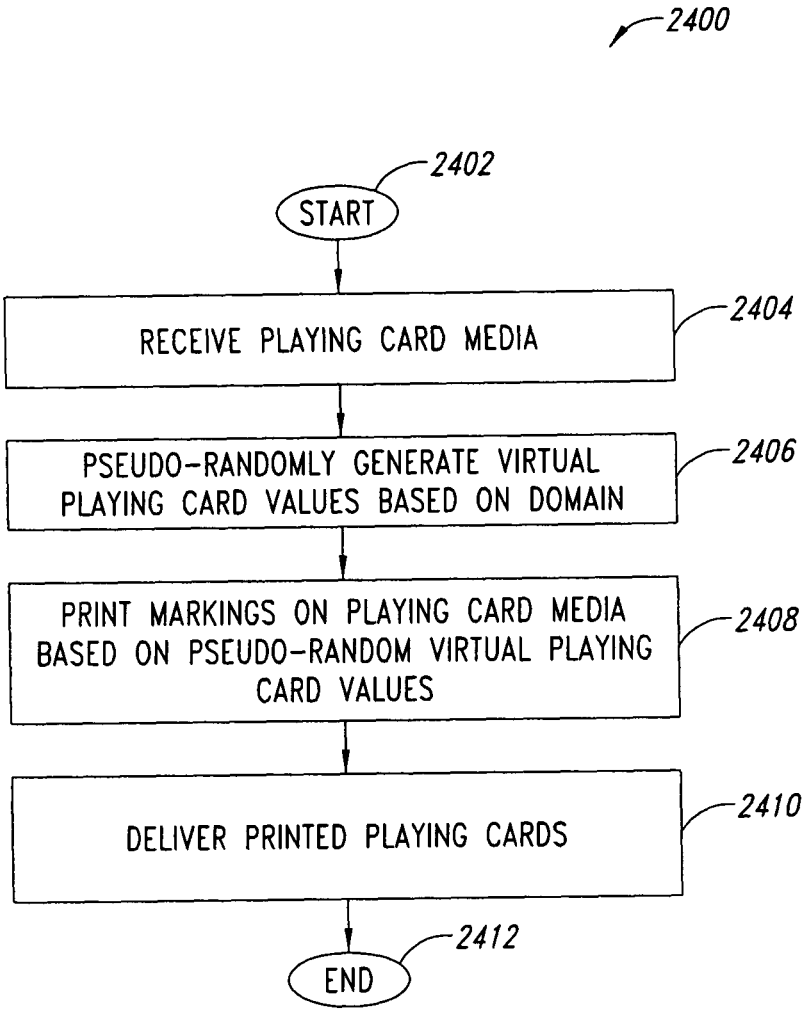
FIG. 24 is a flow diagram of a method of operating a playing card handling system to form sets or packets of playing cards one at a time by forming playing card markings on playing card media, according to one illustrated embodiment.

FIG. 24 shows a method 2400 of operating a playing card handling system 120*c*, 120*p*, 120*q* (FIGS. 5, 18, 19), according to one illustrated embodiment.

The method 2400 starts at 2402, for example, in response to activation of a switch by a user, detection of playing card media 504, 1815, 1915 at the playing card media input receiver 502, 1804, 1904 or detection of a lack of playing cards at the playing card output receiver 506, 1806, 1906. At 2404, the playing card handling system 120*c*, 120*p*, 120*q* receives playing card media 504, 1815, 1915 at a playing card input receiver 502, 1804, 1904. At 2406, the playing card handling system 120*c*, 120*p*, 120*q* randomly or pseudo-randomly generates virtual playing card values, for example based on a domain, parameters, and/or RNG function. The determination or selection of the domain, parameters, and/or RNG function is discussed above and is not repeated here in the interest of brevity.

At 2408, the playing card handling system 120*c*, 120*p*, 120*q* forms markings on the playing card media 504, 1815, 1915 based on the random or pseudo-random virtual playing card values. The markings may take the form of one or more markings indicative of a playing card value (e.g., rank, suit, and/or point value). The markings may include additional indicia, for example, pips, traditional indicia such as drawings of jacks, queens, kings, ornamental designs, or nontraditional value markings.

At 2410, the playing card handling system 120*c*, 120*p*, 120*q* delivers playing cards at the playing card output receiver 506, 1806, 1906. The method 2400 terminates at 2412.

Summary of Various Embodiments

It is appreciated that concurrent provision of randomized playing cards 518, 618, 718, random generation of virtual playing cards values, and/or transportation of collected playing cards 515, 615 or playing card media 704 to through the playing card handling system 120 allows a series of card games to progress in an uninterrupted, or nearly uninterrupted, manner. That is, when the set of playing cards being dealt by hand or from the card shoe 118 is exhausted or nearly exhausted, one or more randomized playing cards 518, 618, 718 are readily available so that game play may continue.

The playing card handling system 120 may advantageously permit a payout or house odds and/or house advantage or theoretical hold to be set for individual participants 110, 114 at the gaming table 102.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the teachings, as will be recognized by those skilled in the relevant art. The teachings provided herein can be applied to other playing card distributing systems, not necessarily the exemplary playing card handling systems generally described above.

For example, in some embodiments, the playing cards used are standard playing cards from one or more standard decks of fifty-two (52) playing cards. The standard playing cards have a uniform back and the faces each bear a respective combination of a first primary symbol and a second primary symbol. The first primary symbol is selected from a standard set of playing card rank symbols comprising: 2, 3, 4, 5, 6, 7, 8, 9, 10, J, Q, K, and A; and the second primary symbol is selected from a standard set of playing card suit symbols comprising: ♡, ♧, ♢, and ♤. One or more of the primary symbols may identify a value of the playing card under the rules of a specific card game. For example, in blackjack or twenty-one the ranks 2-10 are worth 2-10 points respectively, the ranks J-K are each worth 10 points, and the rank A is worth 10 or 1 point at the player's option. In other embodiments, the playing cards may have other symbols, graphics, backings, etc., and may even be modified within the playing card handling system 120 to add, enhance, or alter the value or significance of the playing card. In one embodiment, the playing cards are dual sided playing cards as described in U.S. patent application Ser. No. 10/902,436, which published on Jun. 2, 2005.

The foregoing detailed description has set forth various embodiments of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of logic including hardware, software, firmware, or virtually any combination thereof. In one embodiment, the present subject matter may be implemented via Application Specific Integrated Circuits (ASICs). However, those skilled in the art will recognize that the embodiments disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure. In the context of this specification, a "computer readable medium" can be any means that can store, communicate, propagate, or transport the program associated with logic and/or information for use by or in connection with the instruction execution system, apparatus, and/or device. The computer readable medium can be, for example, but not limited to, an electronic, magnetic, optical, electromagnetic, infrared, or semiconductor system, apparatus, device, or propagation medium. More specific examples (a non-exhaustive list) of the computer readable medium would include the following: an electrical connection having one or more wires, a portable computer diskette (magnetic, compact flash card, secure digital, or the like), a random access memory (RAM), a read-only memory (ROM), an erasable programmable read-only memory (EPROM, EEPROM, or Flash memory), an optical fiber, and a portable compact disc read-only memory (CDROM). Note that the computer-readable medium, could even be paper or another suitable medium upon which the program associated with logic and/or information is printed, as the program can be electronically captured, via for instance optical scanning of the paper or other medium, then compiled, interpreted or otherwise processed in a suitable manner if necessary, and then stored in memory.

In addition, those skilled in the art will appreciate that certain mechanisms of taught herein are capable of being distributed as a program product in a variety of forms, and that an illustrative embodiment applies equally regardless of the particular type of signal bearing media used to actually carry out the distribution. Examples of signal bearing media include, but are not limited to, the following: recordable type media such as floppy disks, hard disk drives, CD ROMs, digital tape, and computer memory; and transmission type media such as digital and analog communication links using TDM or IP based communication links (e.g., packet links).

Further, the logic or instructions may, in one embodiment, reside within the card handling system 120 as an internal, integrated component. In another embodiment, the logic may be external to the card handling system 120 as a stand alone device. Or, if external, the card handling system 120 may be part of another system having other functionality. In such embodiments, the logic could include suitable convenient plug-in connector devices to facilitate coupling between the external card handling system 120 and other elements of the gaming environment 100.

The card handling system 120 may be forming sets or packets from one intermediary playing card receiver while storing new playing cards to another intermediary playing card receiver. Further, the intermediary playing card receivers may be interchangeable, allowing new playing cards to be introduced when desired.

Some embodiments may employ one or more look-forward algorithms. For example, some embodiments may position the intermediary card receivers while executing an unrelated act or while waiting for a particular playing card to arrive. Also for example, some embodiments may transport playing cards based on when the playing card will be needed to form the sets or packets. Thus, for example, playing cards that are needed most immediately may be immediately transported to an intermediary playing card receiver having playing card receiving compartments that hold at most one playing card during use. Such an intermediary playing card receiver functions as a fine sort mechanism. Playing cards that are not needed immediately, may be transported to an intermediary playing card receiver having playing card receiving compartments that each hold a plurality of playing cards, and may be placed in those compartments at least partially based on the order of need. For example, the playing cards that are needed next are placed in one playing card receiving compartment, those needed after that are placed in another playing card receiving compartment, etc. The location and identity of playing cards may be tracked through all or a portion of the playing card handling system 120. It is appreciated that the various possibilities of concurrently managing, tracking or transporting physical cards through the card handling system 120, and/or concurrently performing virtual card operations, are too numerous to describe in detail herein. Such embodiments performing a plurality functions are intended to be within the scope of this disclosure and be protected by any accompanying claims.

The various embodiments described above can be combined to provide further embodiments. All of the above U.S. patents, U.S. patent application publications, U.S. patent applications, foreign patents, foreign patent applications and non-patent publications referred to in this specification and/or listed in the Application Data Sheet, including but not limited to: U.S. provisional patent application Serial Nos. 60/130,368, filed Apr. 21, 1999; 60/259,658, filed Jan. 4, 2001; 60/296,866, filed Jun. 8, 2001; 60/300,253, filed Jun. 21, 2001; 60/716,538, filed Sep. 12, 2005; 60/791,549, filed Apr. 12, 2006; 60/808,161, filed May 23, 2006; 60/791,554, filed Apr. 12, 2006; 60/791,398, filed Apr. 12, 2006; 60/791,513, filed Apr. 12, 2006; and 60/815,910, entitled "SYSTEMS, METHODS AND ARTICLES TO FACILITATE DELIVERY OF SETS OR PACKETS OF PLAYING CARDS," and filed Jun. 21, 2006; and U.S. nonprovisional patent application Ser. No. 09/474,858, filed Dec. 30, 1999, and issued as U.S. Pat. No. 6,460,848 on Oct. 8, 2002; Ser. No. 09/849,456, filed May 4, 2001, and issued as U.S. Pat. No. 6,652,379 on Nov. 25, 2003; Ser. No. 09/790,480, filed Feb. 21, 2001, and issued as U.S. Pat. No. 6,685,568 on Feb. 3, 2004; Ser. No. 10/017,276, filed Dec. 13, 2001; Ser. No. 10/885,875, filed Jul. 7, 2004; Ser. No. 10/902,436, filed Jul. 29, 2004; Ser. No. 10/981,132, filed Nov. 3, 2004; Ser. No. 10/934,785, filed Sep. 2, 2004; and Ser. No. 10/823,051, filed Apr. 13, 2004, are incorporated herein by reference, in their entirety.

From the foregoing it will be appreciated that, although specific embodiments have been described herein for purposes of illustration, various modifications may be made without deviating from the spirit and scope of the teachings. Accordingly, the claims are not limited by the disclosed embodiments.

I claim:

1. A method of operating a card handling system having a playing card input receiver, a playing card output receiver, a first and at least a second intermediary playing card receiver positioned relative between the playing card input and playing card output receivers along at least one playing card transport path, the first and the second intermediary playing card receivers each having a plurality of playing card receiving compartments, the method comprising:

transporting a number of playing cards from the playing card input receiver to the plurality of playing card receiving compartments of at least one of the first or the second intermediary playing card receivers;

for each of at least some of a number of participants, retrieving at least two playing cards from respective ones of the plurality of playing card receiving compartments of at least one of the first or the second intermediary playing card receivers based on a number of pseudo-randomly generated virtual playing card values; and for each of the at least some of the number of participants, forming a distinct set of playing cards from the at least two retrieved playing cards for delivery to the respective participant as a packet of playing cards.

2. The method of claim 1 wherein transporting a number of playing cards from the playing card input receiver to the plurality of playing card receiving compartments of at least one of the first or the second intermediary playing card receivers comprises transporting at least one of the playing cards to at least one of the playing card receiving compartments of the first intermediary playing card receiver and transporting at least one of the playing cards to at least one of the playing card receiving compartments of the second intermediary playing card receiver.

3. The method of claim 1 wherein transporting a number of playing cards from the playing card input receiver to the plurality of playing card receiving compartments of at least one of the first or the second intermediary playing card receivers comprises transporting at least one of the playing cards to at least one of the playing card receiving compartments of the first intermediary playing card receiver based at least in part on when the playing card will be needed to form the distinct set of playing cards and transporting at least one of the playing cards to at least one of the playing card receiving compartments of the second intermediary playing card receiver based at least in part on when the playing card will be needed to form the distinct set of playing cards.

4. The method of claim 3, further comprising:

delivering the distinct set of playing cards as the packet at the playing card output receiver.

5. The method of claim 1 wherein forming a distinct set of playing cards from the at least two retrieved playing cards for delivery to the respective one of the at least some of the participants comprises transferring the at least two retrieved playing cards to one of a plurality of card receiving areas of the playing card output receiver.

6. The method of claim 1 wherein forming a distinct set of playing cards from the at least two retrieved playing cards for delivery to the respective one of the at least some of the participants comprises transferring the at least two retrieved playing cards to a playing card receiving area of the playing card output receiver wherein the playing card output receiver has a single playing card receiving area, and the playing card receiving area is accessible from an exterior of the playing card handling system.

7. The method of claim 1 wherein retrieving at least two playing cards from respective ones of the plurality of playing card receiving compartments of at least one of the first or the second intermediary playing card receivers based on a number of randomly generated virtual playing card values comprises retrieving a first one of the playing cards having a playing card value corresponding to one of the virtual playing card values from the respective one of the playing card compartments of the first intermediary playing card receiver and retrieving a second one of the playing cards having a playing card value corresponding to another one of the virtual playing card values from the respective one of the playing card compartments of the second intermediary playing card receiver.

8. The method of claim 1 wherein retrieving at least two playing cards from respective ones of the plurality of playing card receiving compartments of at least one of the first or the second intermediary playing card receivers based on a number of randomly generated virtual playing card values comprises selecting the respective one of the playing card receiving compartments of the first playing card receiver based on a stored relationship indicative of a mapping between the respective playing card receiving compartment and a playing card value of the playing card stored in the respective playing card receiving compartment.

9. The method of claim 1, further comprising:

reading identifying information from the playing cards as each of the playing cards is transferred along the at least one playing card transport path; and locating at least some of the transferred playing cards at least partially into respective ones of the playing card receiving compartments of the first intermediary playing card receiver, such that there is no more than one playing card in any one of the playing card receiving compartments of the first intermediary playing card receiver at a time.

10. The method of claim 9 wherein locating at least some of the playing cards at least partially into respective ones of the playing card receiving compartments of the first intermediary playing card receiver comprises locating the playing card in a bi-directionally closest one of the playing card receiving compartments of the first intermediary playing card receiver that is currently empty.

11. The method of claim 1, further comprising:

pseudo-randomly generating the virtual playing card values.

12. The method of claim 1, further comprising:

pseudo-randomly generating the virtual playing card values for each of at least some of the participants based on at least one of a respective set of house odds or house advantage, where the set of house odds or house advantage for at least one participant is different from the set of house odds or house advantage for at least one other participant.

13. A method of operating a card handling system, the method comprising:

transferring a plurality of playing cards from a playing card input receiver along at least one playing card transport path toward at least a first intermediary playing card receiver;

locating at least some of the playing cards at least partially into respective ones of a number of playing card receiving compartments of the first intermediary playing card receiver, such that there is no more than one playing card in any one of the playing card receiving compartments of the first intermediary playing card receiver at a time;

for each of at least one playing card receiving compartment of a plurality of playing card receiving compartments of a second intermediary playing card receiver:

retrieving at least two playing cards from respective ones of the playing card receiving compartments of the first intermediary playing card receiver based on a number of randomly generated virtual playing card values, and forming a distinct set of at least two playing cards at least partially received in the respective one of the playing card receiving compartments from the playing cards retrieved from the playing card receiving compartments of the first playing card receiver; and transferring the distinct set of at least two playing cards into a playing card output receiver.

14. The method of claim 13, further comprising:

reading identifying information from the playing cards as each of the playing cards is transferred along the at least one playing card transport path; and storing a set of relationships indicative of a playing card value of each of the playing cards and the playing card receiving compartment of the first intermediary playing card receiver in which the respective playing card is at least partially received.

15. The method of claim 13 wherein locating at least some of the playing cards at least partially into respective ones of the playing card receiving compartments of the first intermediary playing card receiver comprises locating the playing card in a bi-directionally closest one of the playing card receiving compartments of the first intermediary playing card receiver that is currently empty.

16. The method of claim 13, further comprising:

pseudo-randomly generating the virtual playing card values for each of at least some of a number of participants based on a respective set of house odds or house advantage, where the set of house odds or house advantage for at least one participant is different from the set of house odds or house advantage for at least one other participant.

17. A processor-readable medium storing instructions that cause a processor to operate a playing card handling system, by:

transferring a plurality of playing cards from a playing card input receiver along at least one playing card transport path toward at least a first intermediary playing card receiver;

locating at least some of the playing cards at least partially into respective ones of a number of playing card receiving compartments of the first intermediary playing card receiver, such that there is no more than one playing card in any one of the playing card receiving compartments of the first intermediary playing card receiver at a time;

for each of at least one playing card receiving compartment of a plurality of playing card receiving compartments of a second intermediary playing card receiver:

retrieving at least two playing cards from respective ones of the playing card receiving compartments of the first intermediary playing card receiver based on a number of randomly generated virtual playing card values, and forming a distinct set of at least two playing cards at least partially received in the respective one of the playing card receiving compartments of the second intermediary playing card receiver from the playing cards retrieved from the playing card receiving compartments of the first playing card receiver; and transferring the distinct set of at least two playing cards to a playing card output receiver.

18. The processor-readable medium of claim 17, wherein the instructions cause the processor to operate the playing card handling system, further by:

reading identifying information from the playing cards as each of the playing cards is transferred along the at least one playing card transport path; and storing a set of relationships indicative of a playing card value of each of the playing cards and the playing card receiving compartment of the first intermediary playing card receiver in which the respective playing card is at least partially received.

19. The processor-readable medium of claim 17 wherein locating at least some of the playing cards at least partially into respective ones of the playing card receiving compartments of the first intermediary playing card receiver comprises locating the playing card in a bi-directionally closest one of the playing card receiving compartments of the first intermediary playing card receiver that is currently empty.

20. The processor-readable medium of claim 17, wherein the instructions cause the processor to operate the playing card handling system, further by:

pseudo-randomly generating the virtual playing card values for each of at least some of a number of participants based on at least one of a respective set of house odds or house advantage, where the set of house odds or house advantage for at least one participant is different from the set of house odds or house advantage for at least one other participant.

21. A card handling system, comprising:

a playing card input receiver sized and dimensioned to receive a number of playing cards;

a playing card output receiver sized and dimensioned to receive a number of playing cards;

a first intermediary playing card receiver comprising a plurality of playing card receiving compartments that each store at most one of the playing cards when in use;

a second playing card receiver comprising a plurality of playing card compartments at least some of which each store at least two of the playing cards when in use; and a processor configured to cause a retrieval of at least two playing cards for each of at least some of a number of participants in a card game from respective ones of the plurality of playing card receiving compartments of the first intermediary playing card receiver and the second playing card receiver based on a number of randomly generated virtual playing card values; and to cause a delivery of the at least two retrieved playing cards for each of the participants to the playing card output receiver to form packets of playing cards.

22. The apparatus of claim 21 wherein the first intermediary playing card receiver comprises at least fifty-two playing card receiving compartments.

23. The apparatus of claim 21 wherein the first intermediary playing card receiver comprises at least one hundred and four playing card receiving compartments.

24. The apparatus of claim 21 wherein the second playing card receiver comprises at most 8 playing card receiving compartments.

25. The apparatus of claim 21 wherein the processor is further configured to pseudo-randomly generate the virtual playing card values.

26. The apparatus of claim 21 wherein the processor is further configured to pseudo-randomly generate the virtual playing card values based on at least one of a selected set of house odds or a house advantage for the respective participant.

27. The apparatus of claim 21, further comprising:

a sensor positioned to read identifying information from the playing cards as the playing cards are transported between the playing card input receiver and at least the first intermediary playing card receiver.

28. The apparatus of claim 21, further comprising:

a sensor positioned to read identifying information from the playing cards while the playing cards are at least partially stored in the playing card receiving compartments of the first intermediary playing card receiver.

29. A card handling system, comprising:

a playing card input receiver sized and dimensioned to receive a number of playing cards;

a playing card output receiver sized and dimensioned to receive a number of playing cards;

a first intermediary playing card receiver comprising a plurality of playing card receiving compartments that each store at most one of the playing cards when in use;

a second playing card receiver comprising a plurality of playing card compartments at least some of which each store at least two of the playing cards when in use;

means for retrieving at least two playing cards for each of at least some of a number of participants in a card game from respective ones of the plurality of playing card receiving compartments of the first intermediary playing card receiver and the second playing card receiver based on a number of randomly generated virtual playing card values; and means for delivering of the at least two retrieved playing cards for each of the participants to the playing card output receiver to form packets of playing cards.

30. The apparatus of claim 29, further comprising:

means for pseudo-randomly generating virtual playing card values.

31. The apparatus of claim 29, further comprising:

means for locating at least some of the playing cards at least partially into a bi-directionally closest one of the playing card receiving compartments that is currently empty.

32. A method of operating a playing card handling system, the method comprising:

determining a number of random virtual playing card values;

forming a first set of at least two playing cards that will comprise at least a portion of a first hand of playing cards for a round of a card game based on at least some of the number of virtual playing card values, before delivering any playing cards to form a second set of at least two playing cards that will comprise at least a portion of a second hand of playing cards for the same round of the card game, wherein the first set of at least two playing cards is formed from a third set of playing cards held in a first intermediary playing card receiver and a fourth set of playing cards held in a second intermediary playing card receiver; and delivering the first set of at least two playing cards through a playing card output receiver.

33. The method of claim 32 wherein determining a number of random virtual playing card values comprises pseudo-randomly generating the number of random virtual playing card values.

34. The method of claim 32 wherein determining a number of random virtual playing card values comprises pseudo-randomly generating the virtual playing card values for each of at least some of a number of hands of playing cards based on a respective set of house odds or house advantage, where the set of house odds or house advantage for at least one hand of playing cards is different from the set of house odds or house advantage for at least one other hand of playing cards.

35. The method of claim 32 wherein determining a number of random virtual playing card values comprises receiving the number of random virtual playing card values.

36. The method of claim 32 wherein forming a first set of at least two playing cards that will comprise at least a portion of a first hand of playing cards based on at least some of the number of virtual playing card values comprises retrieving the at least two playing cards from the second intermediary playing card receiver.

37. The method of claim 32 wherein forming a first set of at least two playing cards that will comprise at least a portion of a first hand of playing cards based on at least some of the number of virtual playing card values comprises retrieving the at least two playing cards from respective playing card receiving compartments of the first intermediary playing card receiver, where each of the playing card receiving compartments holds at most a single playing card.

38. The method of claim 32 wherein forming a first set of at least two playing cards that will comprise at least a portion of a first hand of playing cards based on at least some of the number of virtual playing card values comprises transporting the at least two playing cards from the second intermediary playing card receiver to a common one of at least two playing card receiving compartments of the playing card output receiver.

39. The method of claim 32 wherein forming a first set of at least two playing cards that will comprise at least a portion of a first hand of playing cards based on at least some of the number of virtual playing card values comprises transporting the at least two playing cards from the first intermediary playing card receiver to a playing card receiving area of the playing card output receiver having a single playing card receiving area which is accessible by a user during use of the playing card handling device.

40. The method of claim 32 wherein forming a first set of at least two playing cards that will comprise at least a portion of a first hand of playing cards based on at least some of the number of virtual playing card values comprises printing at least one playing card value marking on each of at least two playing card blanks, the playing card value markings corresponding to respective ones of the virtual playing card values.

41. The method of claim 32, further comprising:

forming the second set of at least two playing cards that will comprise at least the portion of the second hand of playing cards for the round of the card game based on at least some of the number of virtual playing card values, before delivering any playing cards to form a fifth set of at least two playing cards that will comprise at least a portion of a third hand of playing cards for the same round of the card game.

42. The method of claim 32, further comprising:

transporting a plurality of playing cards from a playing card input receiver to at least the first intermediary playing card receiver comprising a plurality of playing card receiving compartments; and for each of the playing cards, locating the playing cards in a bi-directionally closest one of the playing card receiving compartments of the first intermediary playing card receiver that is currently empty.

43. The method of claim 42, further comprising:

reading identifying information from the playing cards that are transported from the playing card input receiver to at least the first intermediary playing card receiver; and storing a set of relationships indicative of a respective playing card value of each of the playing cards and the playing card receiving compartment of the first intermediary playing card receiver in which the respective playing card is at least partially received.

44. A playing card handling system, comprising:

a playing card input receiver to receive a plurality of playing cards that are to be handled;

a playing card output receiver having a single playing card receiving compartment to provide a respective set of at least two playing cards for forming at least a portion of each of at least two hands of playing cards dealt in a card game;

a first intermediary playing card receiver comprising a plurality of playing card receiving compartments that each receive at most one playing card during use;

a second intermediary playing card receiver comprising a plurality of playing card receiving compartments;

at least a first playing card input transport path extending between the playing card input receiver and at least one of the first intermediary playing card receiver or the second intermediary playing card receiver, along which the playing cards are transported from the playing card input receiver to at least one of the first intermediary playing card receiver and the second intermediary playing card receiver; and at least a first playing card output transport path extending between at least one of the first intermediary playing card receiver or the second intermediary playing card receiver, and the playing card output receiver, along which the playing cards are transported from at least one of the first intermediary playing card receiver or the second intermediary playing card receiver to the playing card output receiver without any intervening multiple compartment playing card receivers therebetween.

45. The playing card handling system of claim 44, further comprising:

a controller configured to cause a first one of the sets of at least two playing cards that will comprise at least a portion of a first one of the hands of playing cards for a round of the card game to be formed, before delivering any playing cards to form a second one of the sets of at least two playing cards that will comprise at least a portion of a second one of the hands of playing cards for the same round of the card game.

46. The playing card handling system of claim 45 wherein the controller is configured to cause the first set of at least two playing cards to be formed based on a number of random virtual playing card values.

47. The playing card handling system of claim 46 wherein the controller is configured to pseudo-randomly generate the random virtual playing card values.

48. The playing card handling system of claim 44, further comprising:

a sensor positioned to read identifying information from the playing cards between the playing card input receiver and the first intermediary playing card receiver.

49. The playing card handling system of claim 44, further comprising:

a memory that stores information that identifies a respective one of the playing card receiving compartments that stores each of the playing cards in the first intermediary playing card receiver and the second intermediary playing card receiver when in use.

50. The playing card handling system of claim 44, further comprising:

a sensor positioned to read identifying information from the playing cards while the playing cards are at least partially stored in the playing card receiving compartments of the first intermediary playing card receiver.

51. A playing card handling system, comprising:

at least a first intermediate playing card receiver comprising a plurality of playing card receiving compartments that each receive at most one playing card during use;

at least a second intermediate playing card receiver comprising a plurality of playing card receiving compartments;

a playing card output receiver to make accessible to a user a number of sets of at least two playing cards for each of a plurality of hands of playing cards; and at least a first playing card output transport path extending between at least one of the first intermediary playing card receiver or the second intermediary playing card receiver, and the playing card output receiver along which the playing cards are transported without stopping at any intervening locations therebetween.

52. The playing card handling system of claim 51, further comprising:

a playing card input receiver to receive a plurality of playing cards that are to be handled; and at least a first playing card input transport path extending between the playing card input receiver and at least one of the first intermediary playing card receiver or the second intermediary playing card receiver, along which the playing cards are transported from the playing card input receiver to at least one of the first intermediary playing card receiver or the second intermediary playing card receiver.

53. The playing card handling system of claim 52, further comprising:

a sensor positioned to read identifying information from the playing cards on the first playing card input transport path between the playing card input receiver and the first intermediary playing card receiver.

54. The playing card handling system of claim 53, further comprising:

a memory that stores information that identifies a respective one of the playing card receiving compartments that stores each of the playing cards in the first intermediary playing card receiver when in use.

55. The playing card handling system of claim 53 wherein the playing card output receiver comprises at least two playing card receiving compartments, each of the playing card receiving compartments to receive a respective one of the sets of at least two playing cards when at least two sets of playing cards are formed for respective hands in a round of a card game.

56. The playing card handling system of claim 53 wherein the playing card output receiver comprises a single playing card receiving area to successively receive respective ones of the sets of at least two playing cards when at least two sets of playing cards are formed for respective hands in a round of a card game.

57. The playing card handling system of claim 44, further comprising:

a controller configured to cause a first one of the sets of at least two playing cards that will comprise at least a portion of a first one of the hands of playing cards for a round of a card game to be formed, before delivering any playing cards to form a second one of the sets of at least two playing cards that will comprise at least a portion of a second one of the hands of playing cards of the same round of the card game.

58. The playing card handling system of claim 57 wherein the controller is configured to cause the first set of at least two playing cards to be formed based on a number of random virtual playing card values.

59. The playing card handling system of claim 58 wherein the controller is configured to pseudo-randomly generate the random virtual playing card values.

60. The playing card handling system of claim 53, further comprising:

a sensor positioned to read identifying information from the playing cards while the playing cards are at least partially stored in the playing card receiving compartments of the first intermediary playing card receiver.

* * * * *